US010843850B2

(12) United States Patent
Jacobsen et al.

(10) Patent No.: US 10,843,850 B2
(45) Date of Patent: Nov. 24, 2020

(54) CONTAINERS AND CONTAINER CLOSURES

(71) Applicant: Runway Blue, LLC, Alpine, UT (US)

(72) Inventors: Joseph O. Jacobsen, American Fork, UT (US); Timothy Tyler Bond, Provo, UT (US); Daniel Kendall Harden, Palo Alto, CA (US)

(73) Assignee: Runway Blue, LLC, Alpine, UT (US)

( * ) Notice: Subject to any disclaimer, the term of this patent is extended or adjusted under 35 U.S.C. 154(b) by 270 days.

(21) Appl. No.: 15/730,625

(22) Filed: Oct. 11, 2017

(65) Prior Publication Data

US 2018/0099792 A1 Apr. 12, 2018

Related U.S. Application Data

(60) Provisional application No. 62/563,019, filed on Sep. 25, 2017, provisional application No. 62/406,879, filed on Oct. 11, 2016.

(51) Int. Cl.
*B65D 47/20* (2006.01)
*B65D 77/28* (2006.01)
(Continued)

(52) U.S. Cl.
CPC ..... *B65D 47/2018* (2013.01); *B65D 47/06* (2013.01); *B65D 47/12* (2013.01);
(Continued)

(58) Field of Classification Search
CPC .. B65D 47/12; B65D 47/121; B65D 47/2018; B65D 47/06; B65D 51/242; B65D 77/286
(Continued)

(56) References Cited

U.S. PATENT DOCUMENTS 2,573,378 A 10/1951 Zurlinden
2,661,870 A 12/1953 Huenergardt
(Continued)

FOREIGN PATENT DOCUMENTS

CA 2615851 C 8/2012
CN 101623162 1/2010
(Continued)

OTHER PUBLICATIONS

International Search Report dated Jan. 8, 2018 as received in Application No. PCT/US2017/056211.
(Continued)

*Primary Examiner* — Chun Hoi Cheung
*Assistant Examiner* — Brijesh V. Patel
(74) *Attorney, Agent, or Firm* — Sterne, Kessler, Goldstein & Fox, P.L.L.C.

(57) ABSTRACT

A container can include a container body, a container top, a closure, and a closure seal. The container top can be connected to the container body. The container top includes a first opening and a second opening. The closure is selectively connected to the container top to control access to the first opening and the second opening. The closure seal is positioned between the closure and the container top. The closure seal comprises a first sealing surface and a second sealing surface. The first sealing surface is sized and configured to at least partially seal the first opening when the closure is connected to the container top. The second sealing surface is sized and configured to at least partially seal the second opening when the closure is connected to the container top.

29 Claims, 26 Drawing Sheets

(51) Int. Cl.
*B65D 47/12* (2006.01)
*B65D 51/24* (2006.01)
*B65D 47/06* (2006.01)

(52) U.S. Cl.
CPC ..... *B65D 47/121* (2013.01); *B65D 51/242* (2013.01); *B65D 77/286* (2013.01)

(58) Field of Classification Search
USPC ..... 220/254.5, 254.3, 254.1, 259.1, 256.1, 220/705, 212.5, 212; 215/229, 228, 243, 215/237, 235, 239; 222/469, 465.1, 556, 222/544, 568, 567, 566
See application file for complete search history.

(56) References Cited

U.S. PATENT DOCUMENTS 2,678,758 A 5/1954 Richmond
3,269,389 A 8/1966 Meurer et al.
3,288,344 A 11/1966 Woollen et al.
3,469,747 A 9/1969 Richmond
3,770,160 A 11/1973 Flider
4,065,024 A 12/1977 Atwell
4,491,251 A 1/1985 Pratz
4,732,303 A 3/1988 Wang
4,756,440 A 7/1988 Gartner
4,805,790 A 2/1989 Leonetti et al.
4,810,245 A 3/1989 Aagesen
4,890,770 A 1/1990 Haga et al.
4,948,009 A 8/1990 Sawatani
4,964,539 A 10/1990 Mueller
5,160,058 A 11/1992 Ahn
5,209,909 A 5/1993 Siegel et al.
5,232,110 A 8/1993 Purnell
5,252,312 A 10/1993 Gentile et al.
5,292,021 A 3/1994 Lyon
5,295,609 A 3/1994 Robbins, III
5,318,203 A 6/1994 Iaia et al.
5,392,947 A * 2/1995 Gentile ..... A61K 8/19 215/6
5,588,561 A 12/1996 Ness
5,873,478 A 2/1999 Sullivan et al.
5,873,494 A * 2/1999 Dallas, Jr. ..... B65D 47/2006 222/129
5,899,361 A * 5/1999 Durliat ..... B65D 81/3227 222/556
6,079,586 A 6/2000 Hanneman
6,213,339 B1 4/2001 Lee
D490,653 S 6/2004 Kleckauskas et al.
6,845,884 B2 1/2005 Chan et al.
6,871,764 B2 3/2005 Stoneberg et al.
6,913,777 B2 7/2005 Rebhorn et al.
6,981,962 B1 1/2006 Lenkersdorf
7,124,917 B2 10/2006 Lee
D538,597 S 3/2007 Kim
7,246,715 B2 7/2007 Smith et al.
7,686,194 B2 3/2010 Kasting
D623,017 S 9/2010 George
D626,837 S 11/2010 Meyers et al.
D626,838 S 11/2010 Meyers et al.
D643,245 S 8/2011 Minarsch
8,146,770 B2 4/2012 Newman
8,272,525 B1 9/2012 LaTorre et al.
8,297,462 B1 10/2012 Joyce
D677,121 S 3/2013 Meyers et al.
D677,162 S 3/2013 Sharma et al.
D682,016 S 5/2013 Knight
D682,612 S 5/2013 Rzepecki
8,485,378 B2 7/2013 Zoss et al.
D688,520 S 8/2013 Lin
D691,849 S 10/2013 Cetera et al.
D696,551 S 12/2013 Meyers et al.
8,602,238 B2 12/2013 El-Saden et al.
8,622,229 B2 1/2014 Lane
8,695,830 B2 4/2014 Meyers
8,783,506 B2 7/2014 Lee
D721,540 S 1/2015 Grcic
D725,436 S 3/2015 Miller
9,078,535 B1 7/2015 Buck
D745,827 S 12/2015 Sorensen et al.
9,199,779 B2 12/2015 Zoss et al.
9,242,772 B1 1/2016 Anderson et al.
D748,430 S 2/2016 Sorensen et al.
D748,478 S 2/2016 Sorensen et al.
9,392,893 B2 7/2016 Sorensen et al.
D768,491 S 10/2016 Sorensen et al.
D773,895 S 12/2016 Jin
D776,339 S 1/2017 Rutherford et al.
9,622,605 B2 4/2017 Buck
9,718,582 B2 8/2017 Hylton
10,004,348 B2 6/2018 Soresnsen et al.
10,172,488 B2 1/2019 Sorensen et al.
2002/0110622 A1 8/2002 Lloyd et al.
2002/0179604 A1 12/2002 Germain et al.
2003/0052126 A1 3/2003 Zettle et al.
2003/0102318 A1 6/2003 Lee
2004/0118847 A1 6/2004 Giraud
2008/0099514 A1 5/2008 Carter
2009/0283535 A1 11/2009 Mesalic
2010/0065588 A1 3/2010 Brannon et al.
2011/0017760 A1 1/2011 Newman
2012/0012617 A1 1/2012 Gill et al.
2012/0055818 A1 3/2012 Zimmern
2012/0187075 A1 7/2012 Ei-Saden et al.
2013/0062304 A1 3/2013 Meyers et al.
2013/0062351 A1 3/2013 Meyers et al.
2013/0233869 A1 9/2013 Tamarit Rios
2014/0048549 A1 2/2014 Wille
2015/0034673 A1 2/2015 Hopkins et al.
2015/0048124 A1 2/2015 Wisniewski
2015/0164254 A1 6/2015 Niedens
2015/0201773 A1 7/2015 Sorensen et al.
2015/0201774 A1 7/2015 Sorensen et al.
2015/0201775 A1 7/2015 Sorensen et al.
2016/0214771 A1* 7/2016 Walton ..... B65D 47/06
2016/0324344 A1 11/2016 Sorensen et al.
2018/0168377 A1 6/2018 Sorensen et al.
2019/0082869 A1 3/2019 Sorensen et al.

FOREIGN PATENT DOCUMENTS

JP S6235952 3/1987
JP H03140128 6/1991
JP H05-22328 U 3/1993
JP H11240549 9/1999
JP 2001233370 8/2001
JP 2004-509814 A 4/2004
JP 3875687 B2 1/2007
JP 2007-502758 A 2/2007
JP 2007-521192 A 8/2007
KR 20-0455016 Y1 8/2011
WO 2007069257 6/2007
WO 2018071589 4/2018

OTHER PUBLICATIONS

Written Opinion of the International Searching Authority dated Jan. 8, 2018 as received in Application No. PCT/US2017/056211.
KR Notice of Preliminary Rejection dated Jan. 30, 2018 as received Application No. 10/2016-7015156, 15 pages. (English Translation).
JP Notification of Reasons for Refusal dated Mar. 6, 2018 as received in Application No. 2016-544086, 6 pages. (Machine Translation).
CA Examiners Report in Canadian Patent Application No. 2931104 dated Jan. 15, 2018, 4 pages.
U.S. Ex Parte Quayle Office Action in U.S. Appl. No. 15/213,360 dated Jan. 30, 2018, 6 pages.
U.S. Office Action in U.S. Appl. No. 14/598,090 dated Dec. 28, 2017, 11 pages.
Extended European Search Report dated Jul. 28, 2017 as received in Application No. 15737718.5, 7 Pages.

(56) References Cited

OTHER PUBLICATIONS

KR Notice of Preliminary Rejection dated Jun. 20, 2017 as received Application No. 10/2016-7015156 (English Translation) 11Pages.
AU Patent Re-Issued Examination Report No. 2 dated Sep. 18, 2017 as received in Application No. 2015206301, 5 Pages.
U.S. Office Action in U.S. Appl. No. 14/598,087, dated Jul. 23, 2015, 13 pages.
U.S. Office Action in U.S. Appl. No. 15/213,360 dated May 15, 2017, 15 pages.
Chinese Office Action in Chinese Patent Application No. 201580004239.9 dated Feb. 4, 2017, 14 Pages.
Chinese Office Action in Chinese Patent Application No. 201580004707.2 dated Jan. 26, 2017, 14 Pages.
CA Examiners Report in Canadian Patent Application No. 2931104 dated Apr. 5, 2017, 3 pages.
U.S. Office Action in U.S. Appl. No. 14/598,087, dated May 18, 2017, 11 pages.
Chinese Office Action in Chinese Patent Application No. 2015800042399 dated Jan. 20, 2017, 2 pages.
U.S Office Action, as issued in connection with U.S. Appl. No. 14/598,075, dated Dec. 7, 2015, 16 pages.
U.S. Office Action in U.S. Appl. No. 29/497,736 dated Jun. 4, 2015, 10 Pages.
International Search Report and Written Opinion, as issued in connection with International Patent Application No. PCT/US2015/011775, dated May 4, 2015, 10 pgs.
International Search Report and Written Opinion, as issued in connection with International Patent Application No. PCT/US2015/011777, dated May 8, 2015, 8 pgs.
International Search Report and Written Opinion, as issued in connection with International Patent Application No. PCT/US2015/011780, dated May 11, 2015, 11 pgs.
International Preliminary Report on Patentability from PCT/US2015/011775, dated Jul. 28, 2016. 7pgs.
International Preliminary Report on Patentability from PCT/US2015/011777, dated Jul. 28, 2016 6pgs.
International Preliminary Report on Patentability from PCT/US2015/011780, dated Jul. 28, 2016 9pgs.
Extended European Search Report dated Sep. 11, 2017 as received in Application No. 15737832.4, 7 pages.
Examination Report in Australian Patent Application No. 2015206301 dated Oct. 7, 2016, 3 pages.
Final Office Action in U.S. Appl. No. 14/598,087 dated Oct. 26, 2016, 11 pages.
U.S. Appl. No. 61/944,536, filed Feb. 25, 2014.
U.S. Appl. No. 62/004,673, filed May 29, 2014.
U.S. Appl. No. 61/929,081, filed Jan. 19, 2014.
Chinese Office Action in Chinese Patent Application No. 201580004707.2 dated Dec. 20, 2017.
AU Patent Examination Report No. 1 dated Jun. 29, 2018 as received in Application No. 2017245299, 4 pgs.
AU Patent Examination Report No. 2 dated Mar. 26, 2019 as received in Application No. 2017245299, 6 pgs.
European Search Report dated Oct. 12, 2018 as received in Application No. 15737718.5, 4 pgs.
Extended European Search report in European Application No. 15877288.9 dated Aug. 24, 2018, 7 pgs.
U.S. Appl. No. 16/230,915, filed Dec. 21, 2018 79 pgs.

* cited by examiner

CONTAINERS AND CONTAINER CLOSURES

CROSS-REFERENCE TO RELATED APPLICATIONS

This application claims the benefit of and priority to U.S. Provisional App. No. 62/406,879, filed Oct. 11, 2016, and U.S. Provisional App. No. 62/563,019, filed Sep. 25, 2017, each of which is herein incorporated by reference in its entirety.

FIELD OF THE DISCLOSURE

The present disclosure generally relates to containers and closures for containers.

BACKGROUND

Containers can hold a variety of different types of liquids such as water, beverages, drinks, juices, or other liquids. Containers also can hold various items such as energy drinks, protein drinks, shakes, foodstuffs, dressings, sauces, and liquid meal replacements.

SUMMARY

In some embodiments of the subject disclosure, a container can hold or contain liquids, beverages, drinks, and the like. The container can allow water and other types of fluids to be transported and/or consumed, such as water, flavored waters, juices, vitamin enhanced beverages, energy drinks, thirst-quenchers and the like. In addition, the container can hold mixtures and solutions, which can include vitamins, supplements, protein powders, meal replacements, etc. Further, the container can hold various powders, solids and/or other types of materials including foodstuffs such as fruits, vegetables, soups, dressings, and the like. In some embodiments, the container can be insulated to help keep the contents at a desired temperature.

Some aspects of the subject disclosure relate to closures for containers. In some embodiments, the closure can be selectively attached and/or detached from the container. The closure can cover one or more openings, and the closure can be attached to the container to inhibit or prevent leaking or spilling. In some embodiments, the closure can comprise air and/or fluid-tight seal(s), which can prevent the contents from leaking or spilling. The one or more openings can allow contents to be quickly and easily added to or removed from the container. While the closure can be selectively attached to the container in some embodiments, the closure can be permanently attached to the container in other embodiments.

In some embodiments, containers can be sized and configured to hold one or more liquids, fluids, solutions, etc. The container can be a bottle, vessel, or the like, and the container can have a variety of different shapes, sizes, configurations, and arrangements depending, for example, upon the intended use of the container.

Some aspects of the subject disclosure relate to container tops that can be used with containers, such as those disclosed herein. The container top can be a part or object that comes near or in contact with a user's mouth during use and the container top can facilitate drinking from or consuming the contents of the container. The container top can include one or more flow pathways for contents to leave or be introduced into the container. In embodiments having multiple flow pathways, the different pathways can accommodate different rates of flow, and/or can facilitate or enable different modes of consuming the contents of the container. For example, in some embodiments, the container top can create a flow pathway including a straw and/or a flow pathway without a straw. In some embodiments, the container top is selectively attached to the container, e.g., by a threaded connection. One or more seals between the container top and container can help inhibit or prevent fluid from leaking between them. The container top can be connected to the container by other suitable connections. For example, in some embodiments, the container top can be permanently connected to the container, such as by monolithic formation.

In some embodiments, a container top includes one or more openings. For example, the container top can include an opening and fluid can be easily poured or dispensed through the opening. This opening can be relatively large to allow a large volume of fluid to flow through the opening. The container top can also include an opening that is relatively small to allow a small volume of fluid to flow through the opening. For example, the smaller opening can be sized and configured to allow a user to sip or drink from the container. If desired, a conduit, such as a straw or tube, can be used to facilitate the flow of fluid through one or more of the openings. For example, a conduit can be connected to an opening, such as the smaller opening, and the conduit and opening can create a flow pathway that facilitates sipping or drinking from the container. If the container top includes a plurality of openings, one or more of the openings can be disposed adjacent or proximate to each other. The openings can be disposed in an upper portion of the container top and the openings can be disposed within an outer wall of the container top. It will be appreciated, after review of this disclosure, that the container top can include any suitable number, size, shape, configuration, and/or arrangement of openings. Thus, while certain container tops disclosed herein include two openings, it will be understood that the container top can include any suitable number of openings.

Advantageously, if the container top includes two openings, the openings can be used for different purposes and/or allow different rates of fluid to flow through the openings. For example, one opening can allow a relatively large volume of fluid to pass through the opening and the other opening can allow a smaller volume of fluid to pass through the opening. For example, one opening can be two, three, four, five, six or more times the size of the other opening. For example, the larger opening can be used when a larger volume or flow rate of fluid is desired such as when filling the container or when it is wanted to rapidly drink from the container, such as during or after exercising. On the other hand, the smaller opening can be used when a smaller volume or flow rate of fluid is desired such as when sipping from the container. The one or more openings can provide increased uses and/or flexibility because the openings can have different sizes, shapes, configurations and/or arrangements, which can allow the openings to be used for different purposes. For example, in an example embodiment, a larger opening can have a generally circular configuration and a smaller opening can have an oblong, arc, curved or crescent shaped configuration. The openings can be disposed adjacent to the each other and the openings can be separated by a divider, such as a partition or wall, which can define at least a portion of one of the openings. After reviewing this disclosure, it will be appreciated that the openings can have various suitable shapes, sizes, configurations, and arrangements such as circular, oval, round, oblong, curved, semi-circular, rectangular, square, polygonal, and the like. It will further be appreciated that the openings can be used for similar or different purposes, and the multiple openings can increase the potential uses and functionality of the container.

In some embodiments, a first opening in the container top can create at least a portion of a first flow pathway and a second opening in the container top can create at least a portion of a second flow pathway. The first opening, for example, can provide a direct opening to the container and the first flow pathway can allow fluid to flow directly from the container and through the first opening. The second opening can include or be selectively connected to a conduit, such as a straw or tube, and the second flow pathway can allow fluid to flow through the conduit and second opening. The different pathways can be in fluid communication with different portions of the container. In one example, the first pathway can be in fluid communication with a first portion of the container, such as an upper portion of the container, and the second pathway can be in fluid communication with a second portion of the container, such as a lower portion of the container. After reviewing this disclosure, it will be appreciated that the pathways can be in fluid communication with other desired portions of the container and that different pathways are not required.

In some embodiments, a conduit can be selectively or permanently coupled to one or more of the openings of the container top. For example, a conduit, such as a straw, can be coupled to an opening, such as a smaller opening, and a user can drink through the straw, which can facilitate sipping and/or drinking relatively slowly from the container. Advantageously, the straw can allow fluid flow when the container is in a generally upright configuration. As discussed above, the container top can include another opening, such as a second opening, that allows the contents to be poured or dispensed from the container. Fluid can flow through the second opening when the container is tilted or inverted.

In some embodiments, a closure provides controlled access to the contents of a container. In particular, the closure can provide controlled access to the one or more openings so that the contents of the container are only accessed when desired. For example, the closure can selectively cover or close one or more openings of the container top to control access to the contents of the container. Advantageously, the closure can cover multiple openings at one time, which can includes some or all of the openings in a container top, and allow such openings to be quickly and easily sealed. The closure can create a watertight seal to prevent the contents from leaking or spilling, which can facilitate transporting liquids, e.g., beverages, and can allow the container to be used before, during, or after activities such as exercising and/or traveling.

Some aspects of the subject disclosure relate to carrying assemblies that can be connected to the closure or container. In some embodiments, the carrying assembly can be selectively connected to the closure or container, such as, for example, by a threaded connection or other mechanism for creating a secure connection of the carrying assembly to the closure. When the carrying assembly is connected to the closure, an intentional act can be required to disconnect the carrying assembly, which can help prevent unintended removal of the carrying assembly. In some embodiments, the carrying assembly can have a loop-shaped configuration and the carrying assembly can be constructed to be flexible or bendable, such as by use of materials such as fabric, leather, plastic, and the like, or by flexible or bendable constructions, e.g. interlinked elements, of these or other materials. The carrying assembly can also have constructions that are not flexible or bendable. In some embodiments, all or a portion of the carrying assembly can be interchangeable with another carrying assemblies, which can facilitate use of the container in different environments. It will be appreciated, in view of this disclosure, that the carrying assembly can have various suitable shapes, sizes, configurations and arrangements depending, for example, upon the intended use of the container.

In some embodiments, a container top can be connected to a container and the container top can include one or more openings. A closure can be connected to the container top and the closure can be sized and configured to control access to the one or more openings in the container top. The closure can comprise one or more seals positioned to abut the one or more openings when the closure is fully engaged with the container. For example, the container top can include a first opening and a first sealing surface that is sized and configured to at least partially seal the first opening when the closure is connected to the container top. The container top can also include a second opening and a second sealing surface that is sized and configured to at least partially seal the second opening when the closure is connected to the container top. In some embodiments, a single seal can comprise the first and second sealing surfaces. In some embodiments, a first seal can comprise the first sealing surface and a second, discrete seal can comprise the second sealing surface.

One of ordinary skill in the art, after reviewing this disclosure, will appreciate that the container, container top, closure, and carrying assembly can include any suitable number of parts and components. One of ordinary skill in the art, after reviewing this disclosure, will also appreciate that the container, container top, closure, and carrying assembly can have appropriate shapes, sizes, configurations and arrangements other than those explicitly disclosed, depending, for example, upon the intended use of the container.

In some embodiments of the subject disclosure, a container can hold or contain liquids, beverages, drinks, or other substances. The container can allow water and other types of fluids to be transported and/or consumed. For example, the container can be used to transport or consume water, flavored waters, juices, vitamin enhanced beverages, energy drinks, thirst-quenchers or other contents. In addition, the container can hold mixtures and solutions, which can include, for example, vitamins, supplements, protein powders, meal replacements, etc. Further, the container can hold various powders, solids and/or other types of materials including foodstuffs such as fruits, vegetables, soups, dressings, or other types of materials. In some embodiments, the container can be insulated to help keep the contents at a desired temperature. The container can comprise, for example, a bottle or vessel, and the container can have a variety of different shapes, sizes, configurations, and arrangements depending, for example, upon the intended use of the container.

Some aspects of the subject disclosure relate to closures for containers. In some embodiments, the closure can be selectively attached and/or detached from the container. The closure can cover one or more openings, and the closure can be attached to the container to inhibit or prevent leaking or spilling. In some embodiments, the closure can comprise (an) air and/or fluid-tight seal(s), which can prevent the contents from leaking or spilling. The one or more openings can allow contents to be quickly and easily added to or removed from the container. While the closure can be selectively attached to the container in some embodiments, the closure can be permanently attached to the container in other embodiments.

Some aspects of the subject disclosure relate to container tops that can be used with containers, such as those disclosed herein, for example. The container top can be a part or object that comes near or in contact with a user's mouth during use and the container top can facilitate drinking from or consuming the contents of the container. The container top can include one or more flow pathways for contents to leave or be introduced into the container. In embodiments having multiple flow pathways, the different pathways can accommodate different rates of flow and/or can facilitate or enable different modes of consuming the contents of the container. For example, in some embodiments, the container top can include a flow pathway including a straw and a flow pathway without a straw. In some embodiments, the container top is selectively attached to the container, e.g., by a threaded connection. One or more seals between the container top and the container can help inhibit or prevent fluid from leaking between them.

In some such embodiments, the closure of the container can be configured to close multiple flow pathways. One or more seals can be positioned between the container top and the closure for inhibiting or preventing fluid from leaking or spilling from the container through the closed flow pathways when the closure is in a closed position.

If a container is used to store or transport certain types of liquids, pressure can build up in the container. For example, if carbonated liquid, such as soda, is stored in the container, pressure can build up inside of the container, especially if the container is shaken. In another example, if a heated liquid, such as a hot beverage, is stored in the container, pressure can build up inside of the container. When the pressure in a container becomes greater than the ambient pressure and the closure is opened, the pressure differential can be reduced by, inter alia, expansion of the container's contents, which can push a portion of the contents out of the container.

If a pressurized container has a container top with a flow pathway including a straw and the straw contains liquid or is positioned to take up liquid within the container, expansion of container contents (e.g., gas(es)) outside the straw-including pathway can expel fluid through the straw-including passage when the straw-including passage is opened, unless the pressure is released before the straw-including flow pathway is opened or concurrently therewith. On the other hand, if another flow pathway can be opened to allow expansion of container contents and depressurization of the container without expelling liquid before opening the straw-including flow pathway, liquid expulsion from the container through the straw-including passage can be avoided.

Some aspects of the present disclosure address one or more of the deficiencies mentioned above and/or other(s). Furthermore, the subject matter recited in the appended claimed can address some, none, or all of the deficiencies mentioned herein.

For example, some aspects of this disclosure relate to a container top with at least two flow pathways, a closure, and/or a seal. A first flow pathway formed in the container top can include a straw and a second flow pathway formed in the container top. The closure and/or the seal can be configured to cover openings of both the first and the second flow pathways when the closure is coupled to the container top. When the closure is removed from the container top, the closure and/or the seal can be configured such that the second flow pathway opens before the first flow pathway opens, thereby relieving some or all of any pressure built up inside of the container before the first flow pathway opens. Such configurations can avoid, prevent, or reduce the likelihood of fluid unintentionally exiting the container, and potentially getting on a user of the container. For example, if a heated or carbonated liquid is stored in the container, the closure can be removed from the container top, and as it is being removed, the pressure can be partially or completely relieved via the second flow pathway by opening it before the first flow pathway. Accordingly, such configurations can contribute to preventing or reducing the potential for pressurized liquid to unintentionally exit the container as a result of rapid depressurization when the closure is opened.

In one example, the seal can be positioned between the container top and the closure. The seal can include one or more biasing members, and the biasing members can be positioned to bias the seal to cover the first flow pathway when the closure is coupled to the container top. As the closure is removed from the container top, the biasing members can continue to bias the seal against the first flow pathway while the second flow pathway of the container top is opened, thereby permitting pressure built up in the container to be released through the second flow pathway before the first flow pathway is opened. As the closure continues to be removed from the container top, the first flow pathway is also uncovered, but the first flow pathway can be uncovered after the main opening is uncovered and the pressure has been released. Accordingly, the configuration of the seal, the closure, and/or the container top can contribute in preventing or inhibiting liquid from unintentionally exiting the container as a result of pressurization of the container.

In another example, a container can include a container body, a container top, a closure, a first sealing portion, a second sealing portion, and at least one biasing member. The container top can be sized and shaped to be selectively connected to the container body and can have a first flow pathway opening and a second flow pathway opening. The closure can removably cover the container top. The first sealing portion can cover and seal the first flow pathway opening. The second sealing portion can cover and seal the second flow pathway opening. The biasing member can bias the second sealing portion against the second flow pathway opening. The biasing member can bias the second sealing portion against the second flow pathway opening as the closure is opened and/or removed from the container top such that the first opening opens before the second opening.

In yet another example, a closure assembly for a container can include a container top, a closure, and one or more seals. The container top can be sized and shaped to be selectively connected to a container body, and can have a first opening and a second opening. The closure can be sized and shaped to removably cover the container top. The one or more seals can include a first sealing portion, a second sealing portion, and at least one biasing member. The first sealing portion can be sized and shaped to close the first opening. The second sealing portion can be sized and shaped to close the second opening. The biasing member can be configured to bias the second sealing portion against the second opening. The biasing member can bias the second sealing portion against the second opening as the closure is opened and/or removed from the container top such that the first opening opens before the second opening.

These and other aspects, features, and advantages of the subject technology will become more fully apparent from the following brief description of the drawings, the drawings, the detailed description of preferred embodiments, and appended claims.

BRIEF DESCRIPTION OF THE DRAWINGS

The appended drawings are incorporated in and constitute a part of this description, and contain figures of certain embodiments to further disclose the above and other aspects, principles, advantages, and features of the subject technology. It will be appreciated that these drawings depict only certain embodiments and are not intended to limit the scope of the invention. Additionally, it will be appreciated that while the drawings may illustrate certain sizes, scales, relationships, and configurations of the subject technology, the drawings are not intended to limit the scope of the claimed invention.

DETAILED DESCRIPTION

Figure 1:
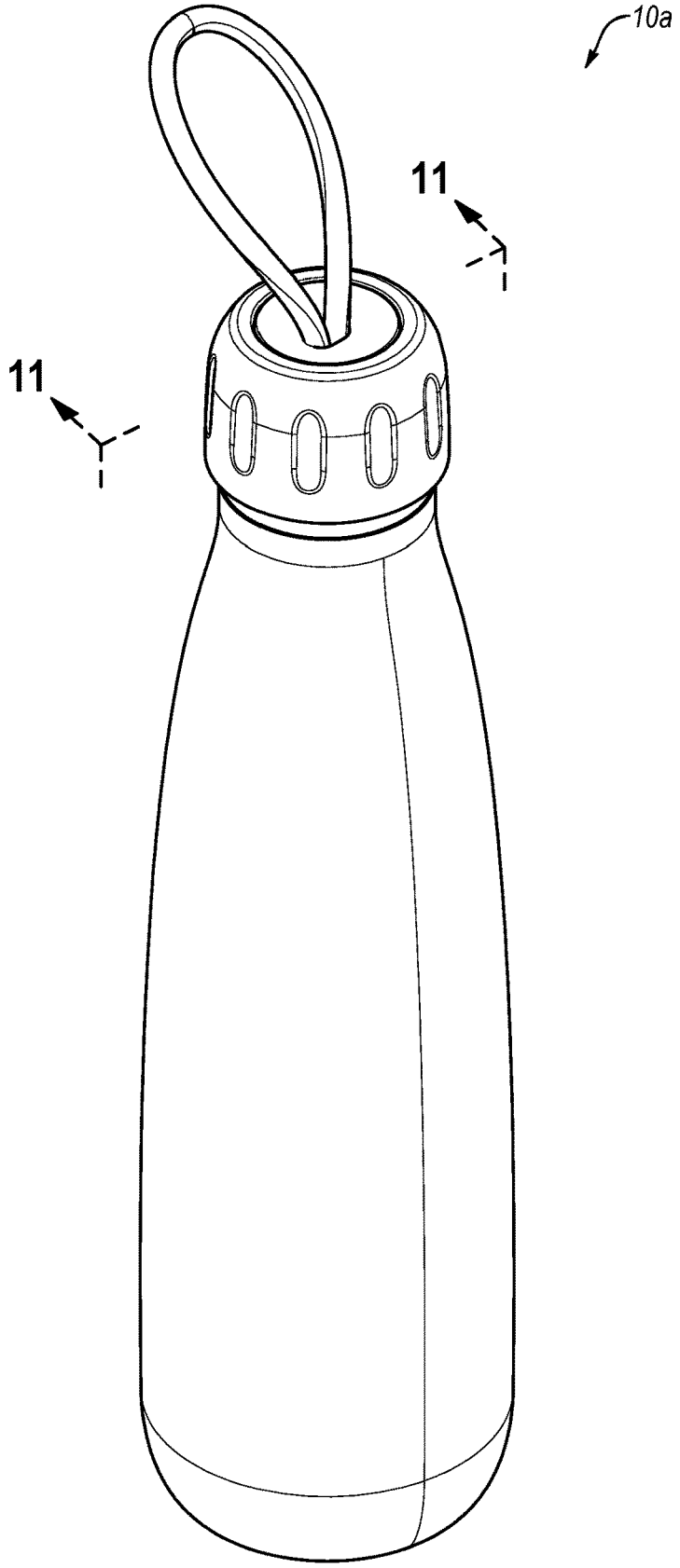
FIG. 1 is an upper perspective view of an example container.

The detailed description set forth below includes a description of various configurations of the subject technology and is not intended to represent the only configurations in which the subject technology can be practiced. The detailed description includes specific details for the purpose of providing a thorough understanding of the subject technology. However, the subject technology can be practiced without these specific details. In some instances, well-known structures and components are not shown, or are shown schematically, to avoid obscuring the concepts of the subject technology.

Although various aspects, principles, advantages, and features of the subject technology are disclosed herein with reference to liquid-dispensing containers or container lids, the present disclosure is not limited to liquid-dispensing containers or container lids. It will be understood that, in light of the present disclosure, the liquid-dispensing containers disclosed herein can have a variety of suitable shapes, sizes, configurations, and arrangements. It will also be understood that containers and container lids according to the subject technology can include any suitable number of parts and components, such as vessels, lid bodies, straws, or other parts or components; and the containers and container lids can include any appropriate number and combination of features, parts, and/or aspects. The disclosed components can be combined or subdivided in some embodiments of the subject technology. In addition, while the accompanying figures illustrate containers and container lids having particular styles and configurations, it will be appreciated that the claimed subject matter may not be limited to the illustrated styles and configurations. Further, the containers and container lids can be successfully used in connection with other types of devices.

Various example embodiments are shown in the accompanying figures. To assist in the description of the various example embodiments, words such as top, bottom, front, rear, sides, right, and left can be used to describe the accompanying figures which can be, but are not necessarily, drawn to scale. It will further be appreciated that the containers can be disposed in a variety of desired positions or orientations, and used in numerous locations, environments, and arrangements.

The present disclosure is generally directed towards containers and container closures. The principles of the present disclosure, however, are not limited to containers or container closures. It will be understood that, in light of the present disclosure, the containers and container closures disclosed herein can have a variety of shapes, sizes, configurations, and arrangements. It will also be understood that the containers and container closures can include any suitable number and combination of features, components, aspects, and the like. In addition, while the containers and container closures shown in the accompanying figures is illustrated as having a particular style and configuration, it will be appreciated the containers and container closures can have other suitable styles, shapes, sizes, configurations, and arrangements.

Additionally, to assist in the description of various example embodiments of the containers and container closures, words such as top, bottom, front, rear, sides, right, and left are used to describe the accompanying figures which can be, but are not necessarily, drawn to scale. It will further be appreciated that the containers and/or container closures can be disposed in a variety of desired positions or orientations, and used in numerous locations, environments, and arrangements.

The example containers and container closures shown in the attached figures and described in more detail below can be used independently and/or in combination with other parts and components. In addition, while the containers and container closures can be described as including various features and aspects, the containers and container closures can include any desired number and combination of features and/or aspects.

Please note that while example embodiments are disclosed and described in detail below, different embodiments can include various parts, components, features, and the like. Thus, it will be understood that different embodiments can have different parts, components, features and aspects; and the different parts, components, features and aspects cannot be required. Further, it will be understood that different embodiments can include various combinations of these parts, components, features and aspects depending, for example, upon its intended use.

Figure 2:
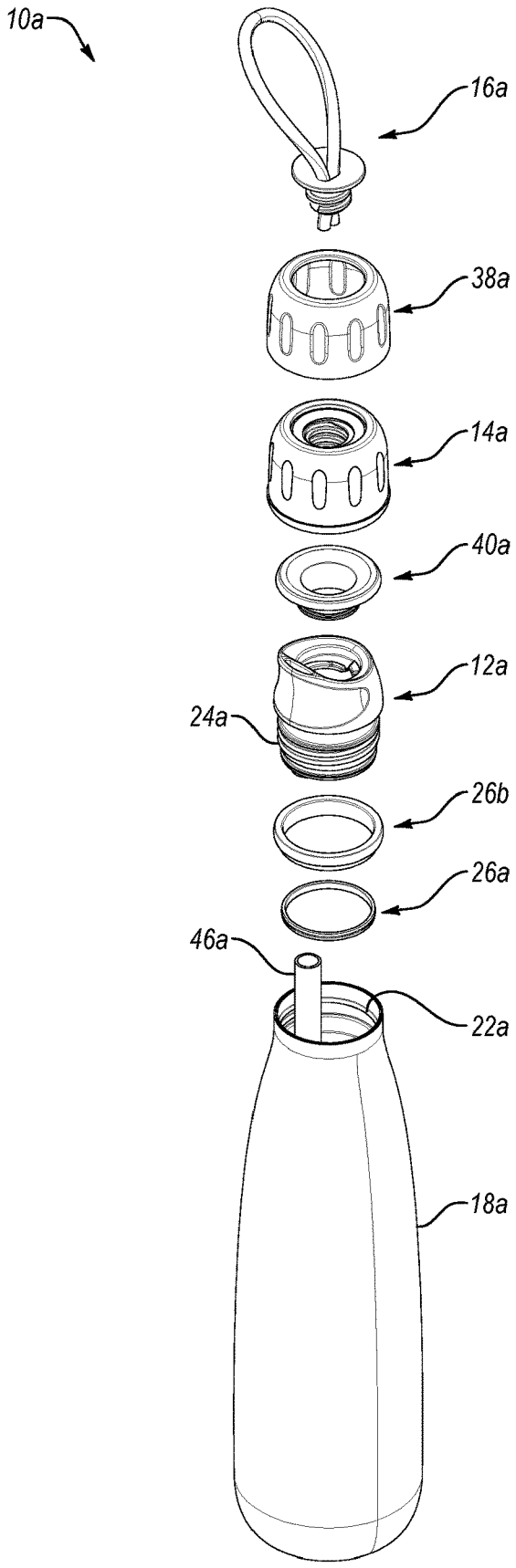
FIG. 2 is an exploded upper perspective view of the container of FIG. 1.

FIG. 1 is an upper perspective view of an example container 10*a*. FIG. 2 is an exploded upper perspective view of the container 10*a* of FIG. 1. With combined reference to FIGS. 1 and 2, the container 10*a* can include a container body 18*a*, a container top 12*a*, a closure 14*a*, and a carrying assembly 16*a*.

Figure 3B:
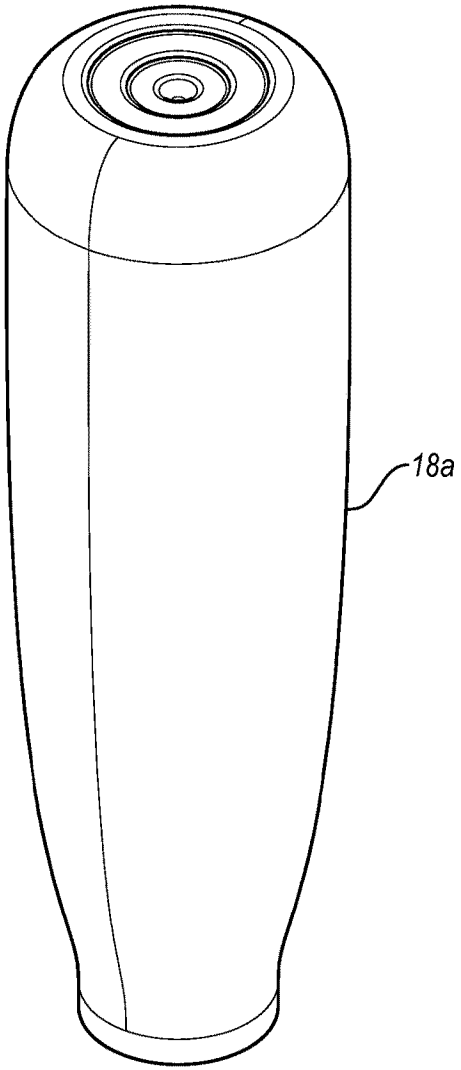
FIG. 3B is a lower perspective view of the container body of FIG. 3A.
Figure 3A:
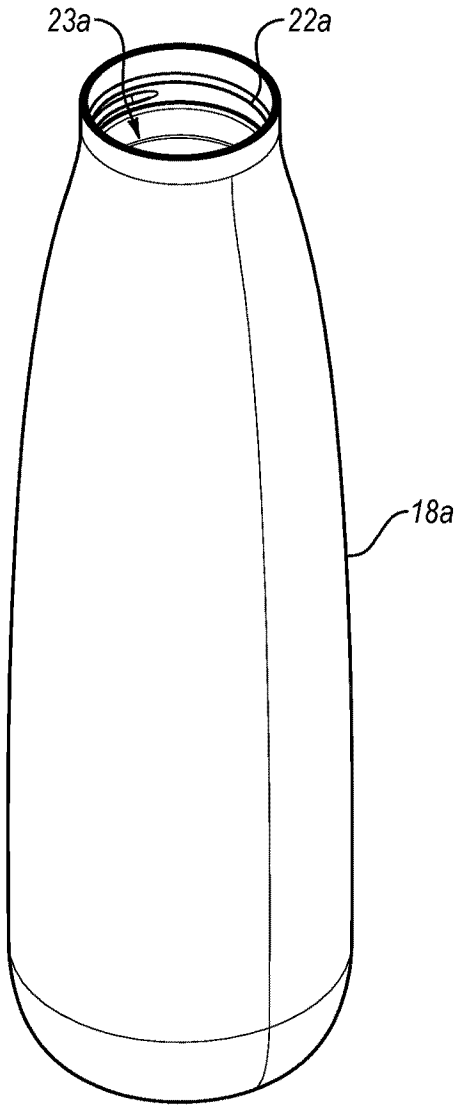
FIG. 3A is an upper perspective view of an example container body of the container of FIG. 1.

FIG. 3A is an upper perspective view of the container body 18*a* of the container 10*a* of FIG. 1. FIG. 3B is a lower perspective view of the container body 18*a* of FIG. 3A.

The container 10*a* can have different shapes, sizes, configurations, and arrangements depending, for example, upon the intended use of the container 10*a*. The container 10*a* can be made of plastic, glass, metal, and/or other materials with suitable properties and characteristics. The container 10*a* can be sized and configured to hold, retain and/or store one or more liquids and/or solids. In particular, the container 10*a* can be a vessel or bottle and the container 10*a* can be used to store liquids such as water, flavored water, vitamin enhanced water, and the like. The container 10*a* can also store fluids and solutions such as juices, energy drinks, thirst-quenchers, and other types of beverages. The container 10*a* can also be used to store solids such as powders, concentrates, mixes, and foodstuffs.

The container 10*a* can be of any suitable size. For example, the container 10*a* can hold approximately 8, 12, 16, 20, 24, 28, 32, or 45 ounces (or about 200, 300, 400, 500, 600, 700, 800, 900, 1000, 1100, 1200, 1300, 1400 milliliters (ml) or a liter). One of ordinary skill in the art will appreciate after reviewing this disclosure that the container 10*a* can have any suitable size, including smaller and larger sizes. In addition, the container 10*a* can have other shapes and configurations other than those disclosed herein, depending, for example, upon the intended use of the container. Further, the container 10*a* can be insulated to help keep the contents at a desired temperature.

Figure 6B:
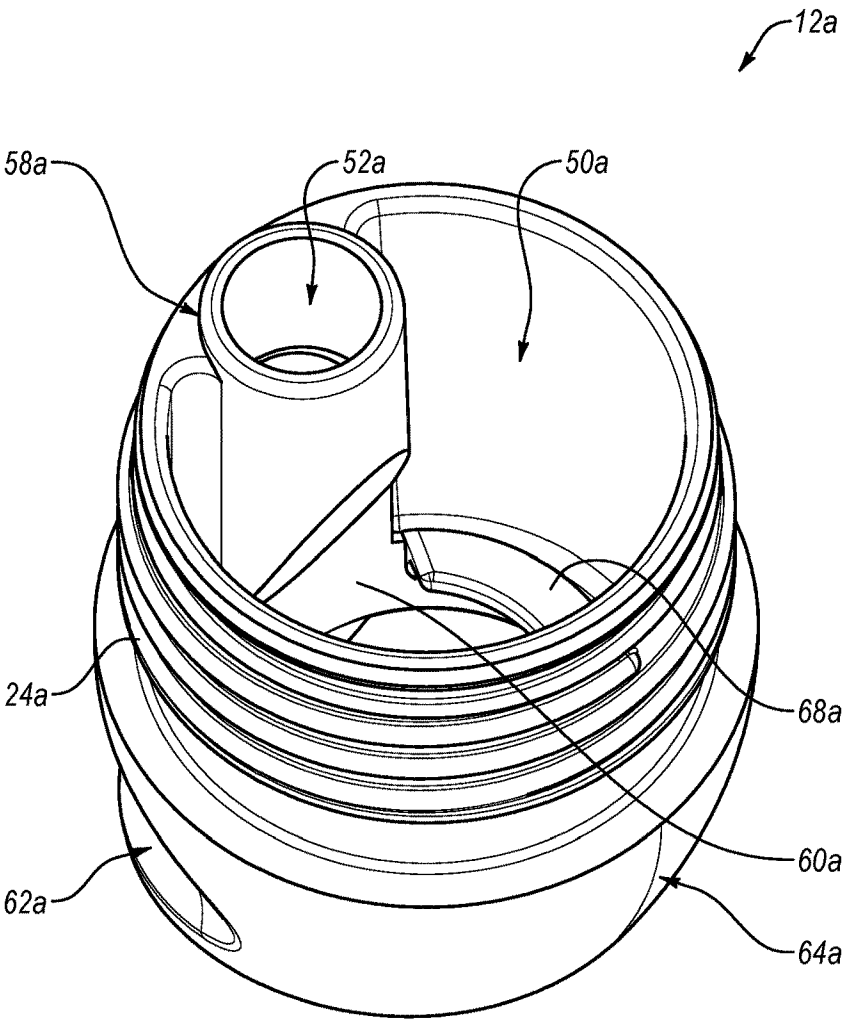
FIG. 6B is a lower rear perspective view of the container top of FIG. 6A.
Figure 6A:
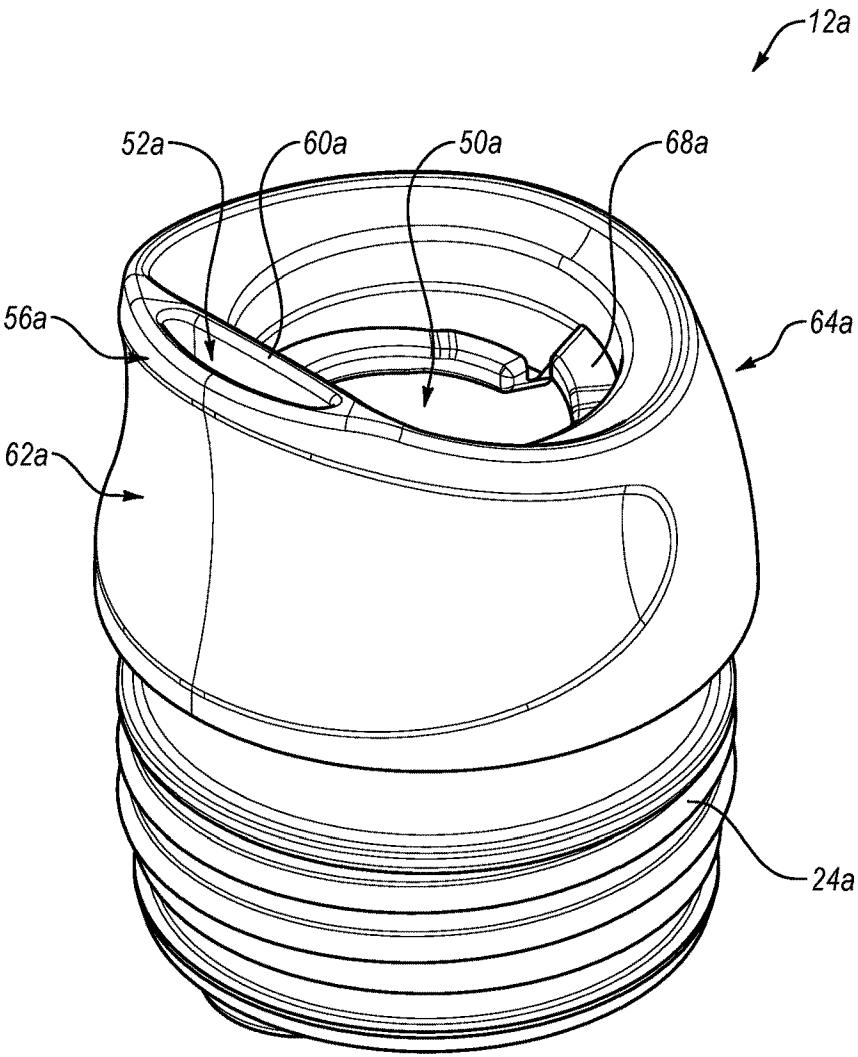
FIG. 6A is an upper front perspective view of an example container top of the container of FIG. 1.

FIG. 6A is an upper front perspective view of the container top 12*a* of the container 10*a* of FIG. 1. FIG. 6B is a lower rear perspective view of the container top 12*a* of FIG. 6A. The container top 12*a* can be selectively connected to the container body 18*a*. For example, the container top 12*a* can be selectively connected to the container body 18*a* by threading, snapping, twisting, sliding, or screwing the container top 12*a* to the container body 18*a*. For example, as illustrated, an upper portion of the container body 18*a* can include one or more threads, such as internal threads 22*a*, and a lower portion of the container top 12*a* can include one or more corresponding threads, such as external threads 24*a*. The threads 22*a*, 24*a* can mate to allow the container top 12*a* to be selectively connected to the container body 18*a*. The threaded connection of the container top 12*a* to the container body 18*a* can create a secure, airtight, watertight and/or leak-proof seal. The threaded connection can require multiple turns to securely connect the container body 18*a* and the container top 12*a*, and it will be appreciated that the container body 18*a* and the container cop 12*a* can be connected by any suitable number of turns. The container body 18*a* and the container top 12*a* can also be connected using other suitable types of connections and structures depending, for example, upon the intended use of the container 10*a*.

Figure 4:
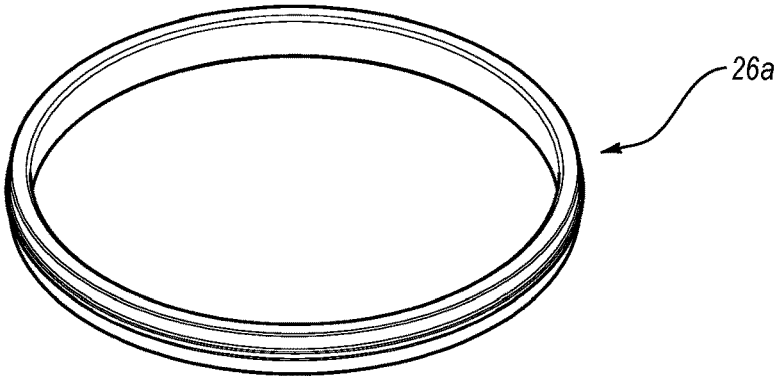
FIG. 4 is an upper perspective view of an example lower seal of the container of FIG. 1.
Figure 5A:
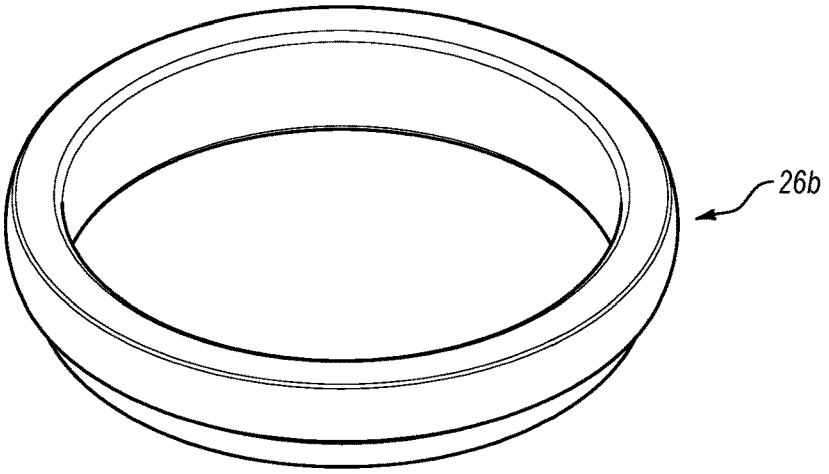
FIG. 5A is an upper perspective view of an example upper seal of the container of FIG. 1.
Figure 5B:
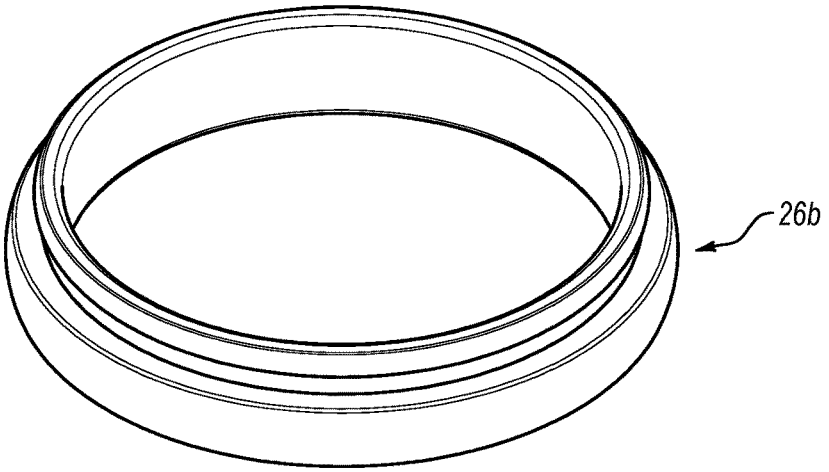
FIG. 5B is a lower perspective view of the upper seal of FIG. 5A.

One or more seals, such as a gasket, washer, O-ring or the like, can be used in connection with the connection of the container body 18*a* and the container top 12*a*. For example, FIG. 4 is an upper perspective view of an example lower seal 26*a* of the container 10*a* of FIG. 1, FIG. 5A is an upper perspective view of an example upper seal 26*b* of the container 10*a* of FIG. 1, and FIG. 5B is a lower perspective view of the upper seal 26*b* of FIG. 5A.

The lower seal 26*a* can be disposed at least proximate a first portion of the container top 12*a* and the upper seal 26*b* can be disposed at least proximate a second portion of the container top 12*a*. In greater detail, the lower seal 26*a* can be disposed at least proximate a lower portion of the container top 12*a* and the upper seal 26*b* can be disposed at least proximate an upper portion of the container top 12*a*. The one or more seals 26*a*, 26*b* can help create an airtight, watertight and/or leak-proof connection of the container body 18*a* and the container top 12*a*. In some embodiments, one or both of these seals 26*a*, 26*b* remain with the container top 12*a*, and can be attached to and removed from the container body 18*a* with the container top 12*a*. In some embodiments, one or both of these seals 26*a*, 26*b* remain with the container body 18*a* and can be attached to and removed from the container top 12*a* with the container body 18*a*.

The container top 12*a* can include one or more openings and the openings can provide access to the contents of the container 10*a*. For example, as shown in FIGS. 6A and 6B, the container top 12*a* can include a first opening 50*a* and a second opening 50*b*. The first opening 50*a* can provide direct access to contents of the container 10*a* and the contents of the container 10*a* can be poured or discharged through the first opening 10*a*. As shown in, e.g., FIGS. 6A and 6B, the first opening 50*a* can be larger than the second opening 52*a* and can allow a larger rate of fluid flow through the first opening 50*a* in comparison to the second opening 52*a*. For example, the first opening 50*a* can be two, three, four, five, six or more times the size of the second opening 52*a*. It will be appreciated that the first opening 50*a* can be smaller than the second opening 52*a* and the openings 50*a*, 52*a* can have various sizes depending, for example, upon the intended use of the container 10*a*.

In at least one embodiment in which the closure 14*a* is secured to the container top 12*a* by screwing the closure 14*a* to the container top 12*a* or the container body 18*a* or in attachment types involving alignment of central axes of the closure 14*a* and the container top 12*a* and rotation of one relative to the other about the aligned central axes, the first opening 50*a* can be at least partially defined by an inwardly facing, outer wall of the container top 12*a*. The first opening 50*a* can comprise a portion (e.g., a portion of the inwardly facing, outer wall) that can be radially symmetric. This portion can be defined by revolution of a line around an axis of revolution, such as, for example, axis 51 illustrated in FIG. 11. The line can be straight, curved, or comprise a combination of straight and curved segments. Curvature of the line can be concave or convex. In some embodiments, this portion of the first opening 50*a* can have a generally cylindrical or frustoconical configuration. For example, this portion of the first opening 50*a* can have a substantially circular cross-section with a constant diameter as a function of vertical position within the cylindrical portion or with a diameter that increases as a function of increasing vertical position within the frustoconical portion. This portion of the first opening 50*a* can narrow in diameter as the portion extends downwardly, e.g., toward a location where the container body 18*a* is disposed when the container top 12*a* and container body are coupled together. The axis of revolution for this portion can be aligned (e.g., coincident or coaxial) with an axis of movement (e.g., rotation and/or translation) of the closure 14*a* relative to the container body 18*a* and/or the container top 12*a* as the closure 14*a* is attached to the container body 18*a* and/or the container top 12*a*.

The second opening 52*a* can have a generally arcuate, curved, round, rounded, oval, or other suitable configuration. The second opening 52*a* can be proximate to and extend along a portion of the first opening 50*a*. The first and second openings 50*a*, 52*a* can extend to an upper or top portion 56*a* of the container top 12*a* and the first and second openings 50*a*, 52*a* can be disposed within an outer wall of the container top 12*a*. The second opening 52*a* can be implemented for drinking through a straw or other conduit. In some such configurations, the top portion 56*a* can be shaped to facilitate forming a seal between a user's lips and the container top 12*a* around the second opening 52*a*. Additionally or alternatively, the container top 12*a* can include a shape that facilitates positioning a user's lips for drinking out of the container 10*a* through the first opening 50*a*.

Figure 11:
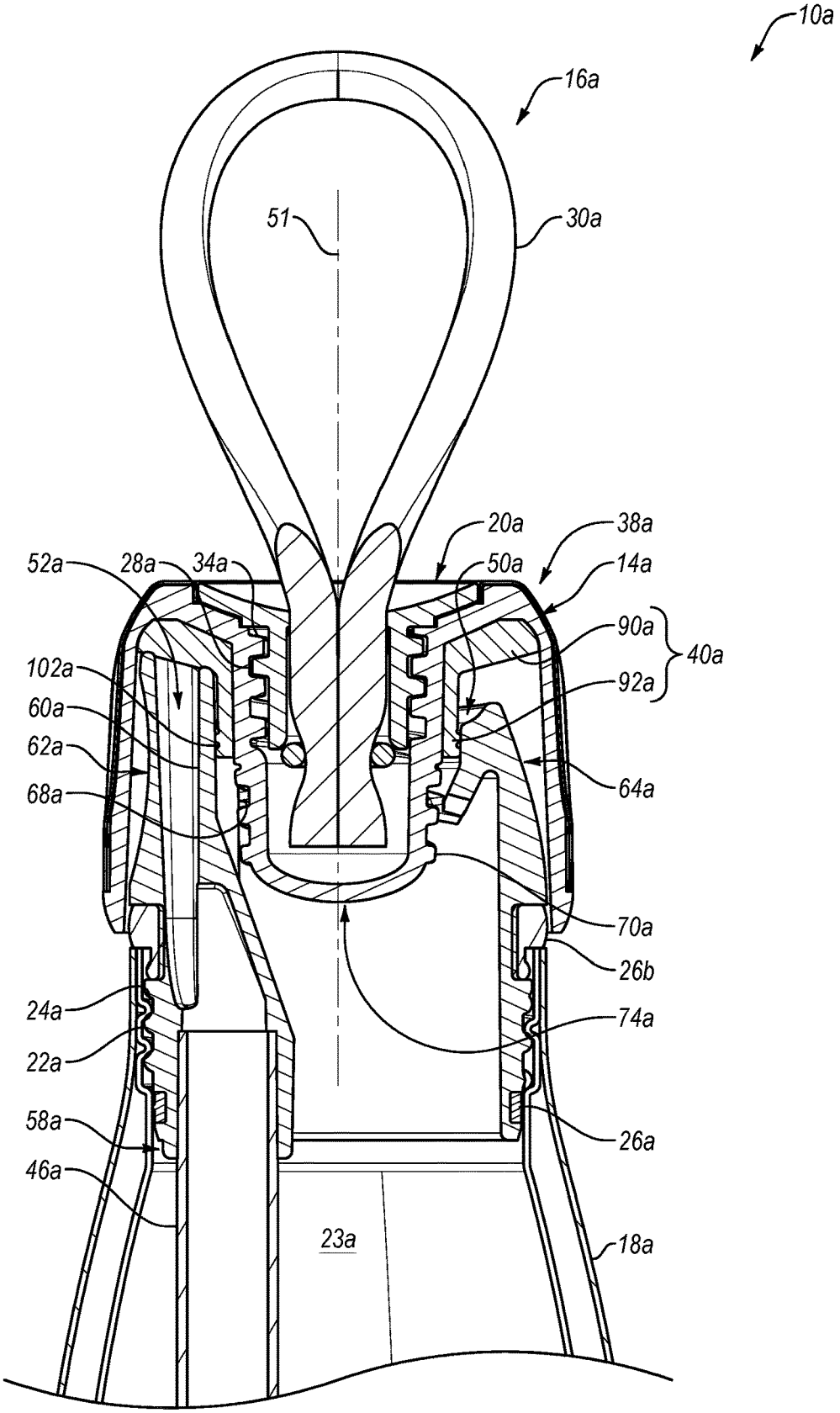
FIG. 11 is a cross sectional side view of a portion of the container of FIG. 1 along lines 11-11 shown in FIG. 1.

In at least one embodiment in which the closure 14*a* is secured to the container top 12*a* by screwing the closure 14*a* to the container top 12*a* or the container body 18*a* or in attachment types involving alignment of central axes of the closure 14*a* and the container top 12*a* and rotation of one relative to the other about the aligned central axes, the top portion 56*a* can comprise a region surrounding the second opening 52*a* and defined by partial revolution of a line around an axis of revolution, such as, for example, the axis 51 illustrated in FIG. 11. The line can be straight, curved, or comprise a combination of straight and curved segments. Curvature of the line can be concave or convex. In some embodiments, this region of the top portion 56*a* can have a generally flat or frustoconical configuration. For example, this region can have a substantially circular cross-section with a diameter that increases or decreases as a function of increasing vertical position within the frustoconical surface. The axis of revolution for this region can be aligned (e.g., coincident or coaxial) with an axis of movement (e.g., rotation and/or translation) of the closure 14*a* relative to the container body 18*a* and/or the container top 12*a* as the closure 14*a* is attached to the container body 18*a* and/or the container top 12*a*.

A divider 60*a* can at least partially separate or divide the first and second openings 50*a*, 52*a*. For example, the first and second openings 50*a*, 52*a* can be disposed adjacent or near each other and the divider 60*a* can at least partially separate the first and second openings 50*a*, 52*a*. The divider 60*a*, which can be a wall or partition, can be a common wall to the first and second openings, and the divider 60*a* can form or define at least a portion of the first and/or second openings 50*a*, 52*a*. For example, the divider 60*a* can include a first surface facing the first opening 50*a* that forms or defines a portion of the first opening 50*a* and a second surface facing the second opening 52*a* that forms or defines a portion of the second opening 52*a*. After reviewing this disclosure, it will be understood that the first and second openings 50*a*, 52*a* do not have to be separated by a divider 60*a*, and the first and second openings 50*a*, 52*a* can be independently formed and/or defined.

As seen in one or more of FIGS. 1-11, a portion of the container top 12*a* can extend upwardly. For example, a front portion 62*a* of the container top 12*a* and the second opening 52*a* can extend farther upwardly than does a rear portion 64*a* of the container top 12 and the first opening 50*aa*. For example, if the second opening 52*a* is located in the front portion 62*a* of the container top 12*a*, at least a portion of the second opening 52*a* can be disposed upwardly relative to the rear portion 64*a* of the container top 12*a*. The front portion 62*a* of the container top 12*a* and the second opening 52*a* can also be disposed upwardly relative to a rear portion of the second opening 52*a*, where the rear portion of the second opening 52*a* can correspond to or include the divider 60*a* in some embodiments.

The front portion 62*a* of the container top 12*a* can be disposed in a different plane than the rear portion 64*a* of the container top 12*a*. For example, a plane can be generally aligned with a top of the front portion 62*a* of the container top 12*a* and another plane can be generally aligned with a top of the rear portion 64*a* of the container top 12*a*, and the planes can be separated by a distance. In this example embodiment, the plane generally aligned with top of the front portion 62*a* of the container top 12*a* can be disposed above the plane generally aligned with the top of the rear portion 64*a* of the container top 12*a*. If desired, a top of the rear portion of the second opening 52*a*, e.g., the divider 60*a*, can be generally aligned with a plane and this plane can be disposed between the plane generally aligned with the top of the front portion 62*a* of the container top 12*a* and the plane generally aligned with the top of the rear portion 64*a* of the container top 12*a*. Stated another way, the front portion 62*a* of the container top 12*a* can extend to a first height, the rear portion of the second opening 52*a*, e.g., the divider 60*a*, can extend to a second height lower than the first height, and the rear portion 64*a* of the container top 12*a* can extend to a third height lower than both the first height and the second height.

In addition or alternative to extending upwardly, the front portion 62*a* of the container top 12*a* can extend outwardly or forwardly. For example, the front portion 62*a* of the container top 12*a* can extend outwardly or be angled forward relative to other portions of the outer wall of the container top 12*a* and/or relative to vertical. If the second opening 52*a* is located in the front portion 62*a* of the container top 12*a*, at least a portion of the second opening 62*a* can extend outward relative to other portions of the outer wall of the container top 12*a* and/or relative to vertical. For example, an upper portion of the front portion 62*a* of the second opening 52*a* can be disposed at an angle between about 0° and about 20° relative to other portions of the outer wall of the container top 12*a* and/or relative to vertical. In particular, the front portion of the second opening can be disposed at an angle between about 5° and about 10° relative to the outer wall of the container top 12*a* and/or relative to vertical.

In some embodiments, an upper surface of the first opening 50*a* can be generally aligned and generally disposed in the same plane. Thus, the upper surface of front and rear portions of the first opening 50*a* can be generally aligned and generally disposed in the same plane. The upper surface of the divider 60*a* separating the first and second openings 50*a*, 52*a* can also be generally aligned and disposed in the same plane as the upper surface of the front portion of the first opening 50*a* and the rear surface of the second opening 52*a*.

In some embodiments, the upper surface of the front portion of the first opening 50*a* and/or the rear portion of the second opening 52*a* can be disposed upwardly and in a different plane, e.g., at a different height, than the rear portion of the first opening 50*a*. In addition or alternatively, the upper surface of the front portion of the second opening 52*a* can be disposed upwardly and in a different plane, e.g., at a different height, than the rear portion of the second opening 52*a*, the front portion of the first opening 50*a*, and/or the rear portion of the first opening 50*a*. The front portion of the second opening 52*a* can be generally aligned with a plane that is a first distance away from a plane that is generally aligned with a rear portion of the first opening 50*a*. The rear portion of the second opening 52*a* can be generally aligned with a plane that is a second distance away from the plane that is generally aligned with the rear portion of the first opening 50*a*. In some embodiments, the first distance can be larger than the second distance, and/or the second distance can be zero, depending, for example, upon the intended use of the container 10*a*. In some embodiments, the first distance can be smaller than or equal to the second distance.

In some embodiments, the upper surface of the first opening 50*a* can generally curve upward from the rear portion of the first opening 50*a* to the front portion of the first opening 50*a*. Alternatively or additionally, from the rear portion to the front portion of the first opening 50*a*, the upper surface of the first opening 50*a* can curve downward a first distance before curving upward a second distance greater than the first distance.

The upper surfaces of the first opening 50*a*, the second opening 52*a*, and the divider 60*a* can facilitate fluid flow through the first and second openings 50*a*, 52*a*. In particular, the first opening 50*a*, the second opening 52*a*, and/or the divider 60*a* can include upwardly extending, curved, sloping, angled, and/or downwardly extending surfaces that facilitate fluid flow through the first and second openings 50*a*, 52*a*. For example, the upwardly and/or forwardly curved surfaces of, e.g., the front portion 62*a*, can facilitate sipping or sucking fluid through the second opening 52*a*. This configuration can also allow fluid to be poured or dispensed from the first opening 50*a*.

In some embodiments, the front portion 62*a* of the container top 12*a* can include a recessed portion that can be an indentation or depression. The recessed portion can be disposed at least proximate the second opening 52*a* and the recessed portion can be disposed in the outer wall of the container top 12*a*. The recessed portion can form a receiving portion that is sized and configured to receive a lower lip of a person consuming a fluid flowing through the second opening 52*a* of the container top 12*a*. Advantageously, the recessed portion can allow a user to more easily and conveniently position their mouth and lips to sip or suck fluid through the second opening 52*a*. It will be appreciated, however, that the recessed portion is not required.

As shown in, e.g., FIG. 2, a conduit 46*a*, such as a tube or straw, can be used in connection with one or more of the first and second openings 50*a*, 52*a*. For example, the conduit 46*a* can be used in connection with the second opening 52*a* and the conduit 46*a* can aid in drinking from the container 10*a*. Thus, a user can sip or drink by sucking on the second opening 52*a* and fluid can flow through the conduit 46*a*, the second opening 52*a*, and into the mouth of the user.

The conduit 46*a* can be selectively or permanently connected to the container top 12*a*. For example, the second opening 52*a* can include a coupling portion 58*a*, such as a receiving portion, and an end of the conduit 46*a* can be connected to the coupling portion 58*a*. The conduit 46*a* can have a length such that the conduit 46*a* extends into the container body 18*a*. For example, the conduit 46*a* can extend into at least a portion, a majority, substantially all or an entire length of the container body 18*a*. A lower end of the conduit 46*a* can be disposed towards a bottom or lower portion of the container body 18*a*, which can allow the lower end of the conduit 46*a* to be in fluid communication with fluids disposed in the lower portion of the container body 18*a*.

The first and second openings 50*a*, 52*a* can form parts of different flow pathways. For example, the first opening 50*a* can provide or form part of a first pathway with direct access to the container body 18*a*, and fluid can flow through the first opening 50*a* when the container 10*a* is tilted or inverted. Thus, fluid can flow through the first opening 50*a* when the container 10*a* is tilted such that fluid in the container 50*a* reaches the upper portion of the first opening 50*a*. The large size of the first opening 50*a* can allow a large quantity of fluid to flow through the first opening 50*a*, which can allow the contents of the container 10*a* to be quickly consumed or poured. The first opening 50*a* can also allow the container 10*a* to be quickly refilled, replenished, and/or topped off.

The second opening 52*a* can provide or form part of a second pathway in which fluid can be sipped or sucked from the container body 18*a*. The second opening 52*a* can be used in connection with the conduit 46*a* and, in this example embodiment, fluid can be sipped or sucked through the second opening 52*a* when the container 10*a* is in a generally upright position. Therefore, fluid can flow through the second opening 52*a* as long as the end of the conduit 46*a* is disposed within the fluid in the container body 18*a*. Thus, the positioning of the container 10*a* (e.g., upright, tilted, angled, inverted, and the like) can determine whether fluid is capable of flowing through the first and/or second openings 50*a*, 52*a*.

Advantageously, the multiple openings (e.g., the first opening 50*a* and the second opening 52*a*) can provide increased functionality and flexibility by allowing fluid to be poured, sipped or sucked from the container 10*a*. In addition, the multiple openings can allow fluid to be discharged or dispensed when the container 10*a* is disposed in upright, tilted, angled, and inverted positions. After reviewing this disclosure, it will be appreciated that openings can have other suitable sizes, shapes, configurations, and arrangements depending, for example, upon the intended use of the container 10*a*.

Figure 8B:
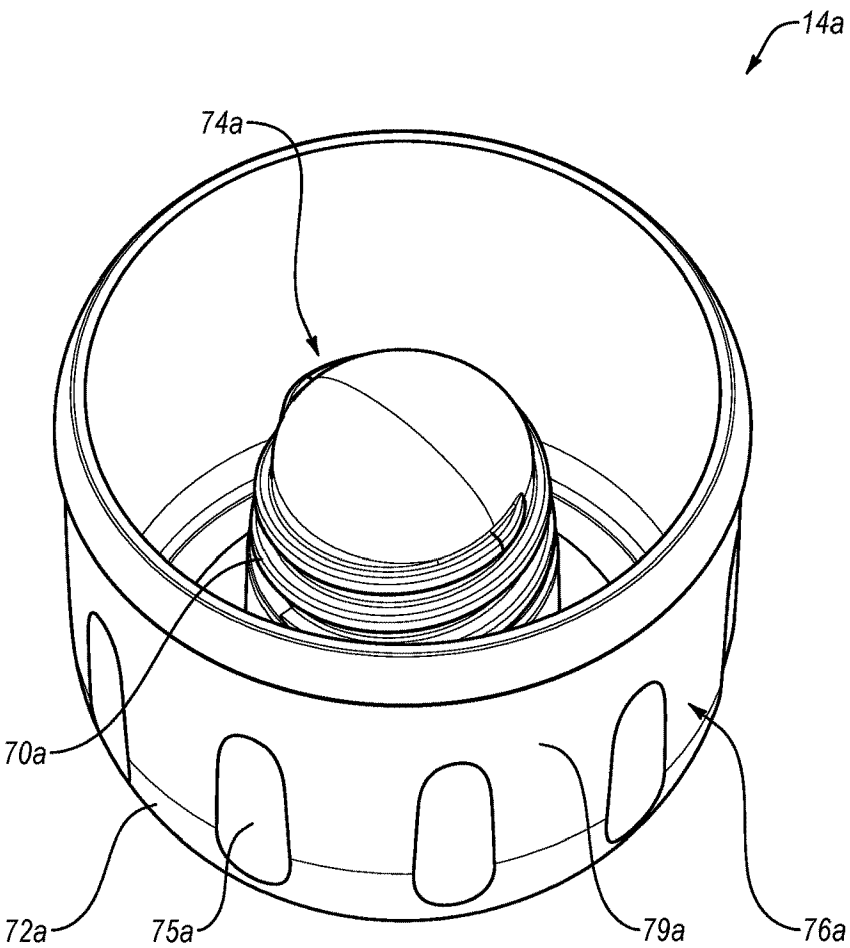
FIG. 8B is a lower perspective view of the closure of FIG. 8A.
Figure 8A:
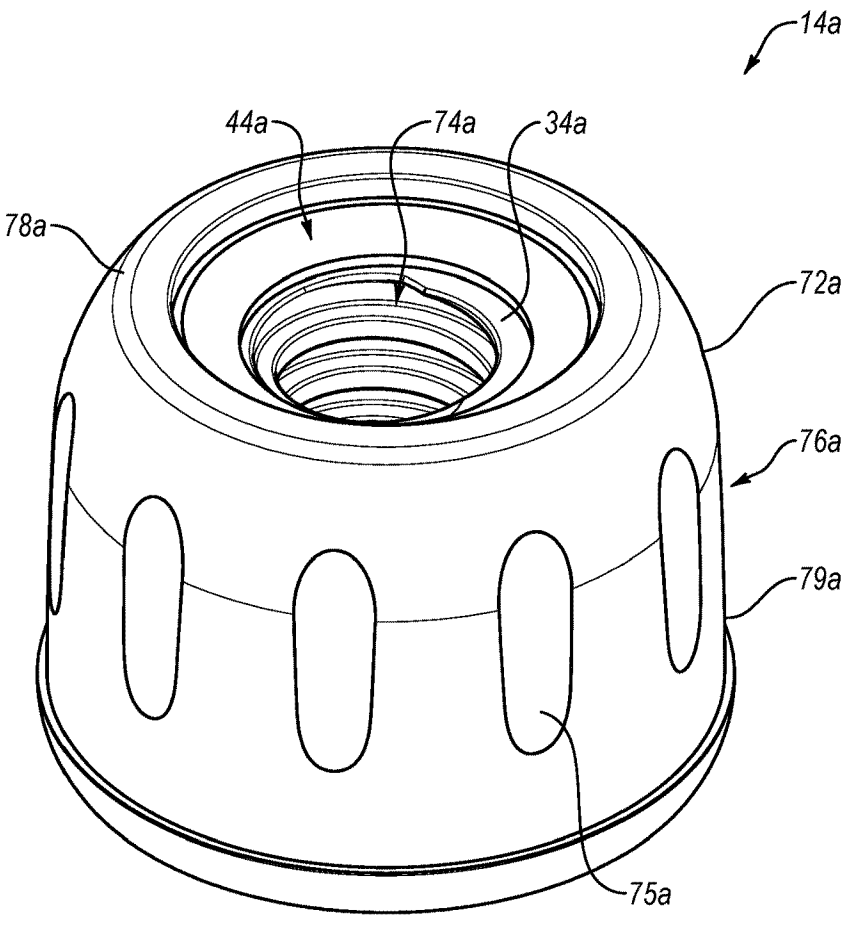
FIG. 8A is an upper perspective view of an example closure of the container of FIG. 1.

FIG. 8A is an upper perspective view of the closure 14*a* of the container 10*a* of FIG. 1. FIG. 8B is a lower perspective view of the closure 14*a* of FIG. 8A. The closure 14*a* can selectively close and/or prevent fluid flow through the container top 12*a*. In particular, the closure 14*a* can close and/or prevent fluid flow through the first and second openings 50*a*, 52*a* in the container top 12*a*. The closure 14*a* can be made of plastic, glass, metal, and\or other materials with suitable properties and characteristics.

The closure 14*a* can be selectively connected to the container 10*a*. For example, the closure 14*a* can be selectively connected to the container top 12*a* by threading, snapping, twisting, sliding, or screwing the closure to the container top 12*a*. For example, an inner portion of the container top 12*a* can include one or more threads 68*a*, and an inner portion 74*a* of the closure 14*a* can include one or more corresponding threads 70*a*. As illustrated, the threads 68*a* of the container 12*a* are internal while the threads 70*a* of the closure 14*a* are external. The threads 68*a*, 70*a* can mate to allow the closure 14*a* to be selectively connected to the container top 12*a*. The threaded connection can require multiple turns to securely connect the closure 14*a* and the container top 12*a*, and it will be appreciated that the closure 14*a* and the container top 12*a* can be connected by any suitable number of turns. The closure 14*a* and the container top 12*a* can also be connected using other suitable types of connections and structures, such as a bayonet-style connection or other suitable type of connection or structure.

In some embodiments in which the inner portion of the container top 12*a* includes the threads 68*a*, and the inner portion 74*a* of the closure 14*a* includes corresponding threads 70*a*, the threads 68*a* of the container top 12*a* can have an offset portion. The offset portion can be a terminal portion of one or more of the threads 68*a*. The offset portion can be positioned to be generally diametrically opposing a location of an upwardly protruding portion of the container top 12*a*, which can correspond to a location of the second opening 52*a* of the container top 12*a*. The offset portion can be positioned to engage and to urge upwardly the threads 70*a* of the inner portion 74*a* of the closure 14*a* during a time when the upwardly protruding portion of the container top 12*a* is engaged by a surface of the closure 14, e.g., a surface of a closure seal 40*a* (see FIGS. 7A and 7B). In some embodiments, an upper surface and a lower surface of the threads 68*a* can each comprise an offset, while in other embodiments an upper surface of the threads 68*a* comprises an offset and the lower surface does not comprise an offset. In some embodiments in which the container top 12*a* comprises an upwardly extending portion, the offset portion can advantageously assist in keeping the closure and the container top 12*a* aligned during the process of tightening them together. FIG. 6A illustrates a container top 12*a* having an inner portion comprising two threads 68*a*, with each thread having an offset portion of the upper and lower thread surfaces.

The connection of the container top 12*a* to the container 10*a* can be of the same or a different type than that of the connection of the closure 14*a* to the container top 12*a*. For example, a different number of turns, a different direction or angle of rotation, and/or a different amount of force can be required to connect the container top 12*a* to the container 10*a* than the closure 14*a* to the container top 12*a*. For example, the container top 12*a* can be more firmly or tightly connected to the container 10*a* than the closure 14*a* to the container top 12*a*. Thus, the closure 14*a* can be more easily connected and/or disconnected from the container top 12*a*, and the container top 12*a* can be more difficult to disconnect from the container 10*a*. These different connections can facilitate removal and attachment of the closure 14*a* without disconnecting the container top 12*a* from the container 10*a*.

The closure 14*a* can include a body 72*a* with the inner portion 74*a* and an outer portion 76*a*. The inner portion 74*a* can be centrally disposed and aligned with a center axis of the closure 14*a* and the outer portion 76*a* can be radially disposed about the inner portion 74*a*. The inner and outer portions 74*a*, 76*a* of the closure 14*a* can be coupled by an upper portion 78*a* of the closure 14*a*. The inner portion 74*a* of the closure 14*a* can have a generally circular configuration and can include one or more outer or external threads 70*a* that are sized and configured to be selectively connected to the threads 68*a* on the inner portion of the container top 12*a*. The outer threads 70*a* on the inner portion 74*a* of the closure 14*a* can be sized, shaped, positioned, and/or configured to allow the closure to be axially aligned with a central axis of the container top 12*a* when the closure 14*a* is connected to the container top 12*a*. Thus, the threaded connection can cause the central axis of the closure 14*a* and the central axis of the container top 12*a* to be generally aligned when the closure 14*a* is connected to the container top 12*a*. This can allow the closure 14*a* to be consistently connected to the container top 12*a* in a similar manner.

The outer portion 76*a* of the closure 14*a* can extend downwardly and can be sized and configured to encircle or enclose at least a portion of the container top 12*a*. For example, the outer portion 76*a* of the closure 14*a* can include a downwardly extending annular flange 79*a* that can cover all or substantially all of the exposed portion of the container top 12*a*. If desired, a lower surface of the outer portion 76*a* of the closure 14*a* can contact an outer surface of the upper seal 26*b* disposed between the container top 12*a* and the container 10*a*. Thus, the closure 14*a* can help prevent dirt, debris, and the like from contacting the container top 12*a* when the closure is attached to the container top 12*a*.

The closure 14*a* can include one or more gripping portions 75*a*, and the gripping portions 75*a* can be at least partially disposed in an outer surface of the closure 14*a*. The gripping portions 75*a* can include inwardly or outwardly extending portions that facilitate gripping of the closure 14*a*. For example, a plurality of the gripping portions 75*a* can be generally equally spaced about an outer perimeter of the closure 14*a*, e.g., on the outer portion 76*a*, and the gripping portions 75*a* can be inwardly extending portions such as recesses, depressions, and the like. After reviewing this disclosure, it will be appreciated that the gripping portions 75*a* are not required.

Figure 9B:
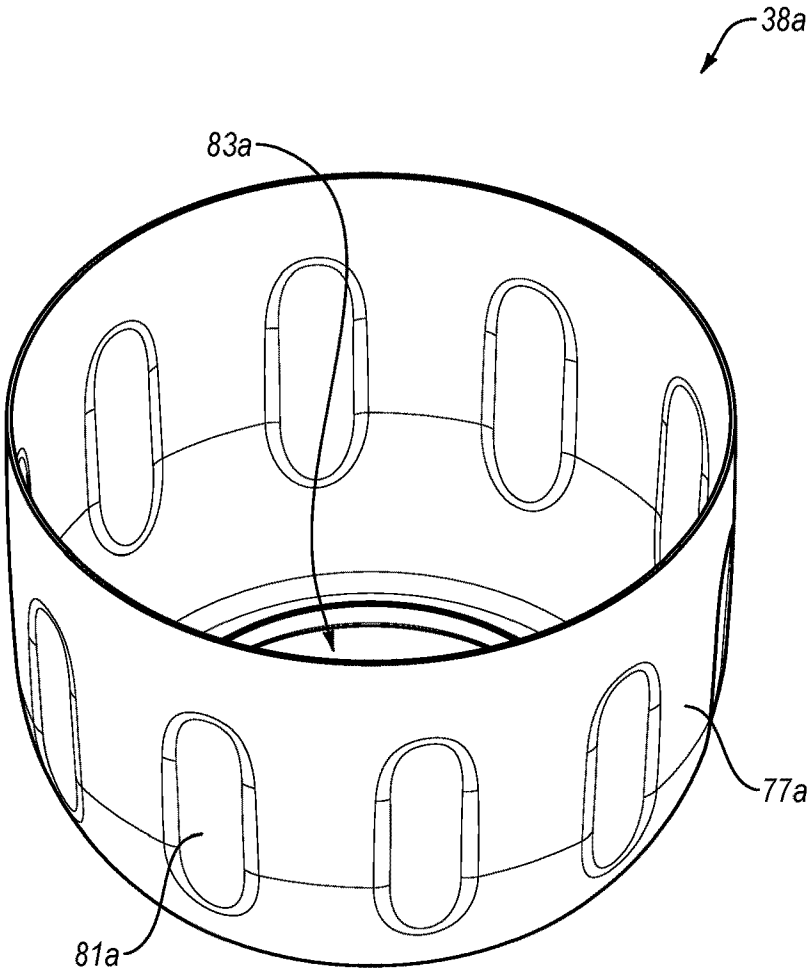
FIG. 9B is a lower perspective view of the cover of FIG. 9A.
Figure 9A:
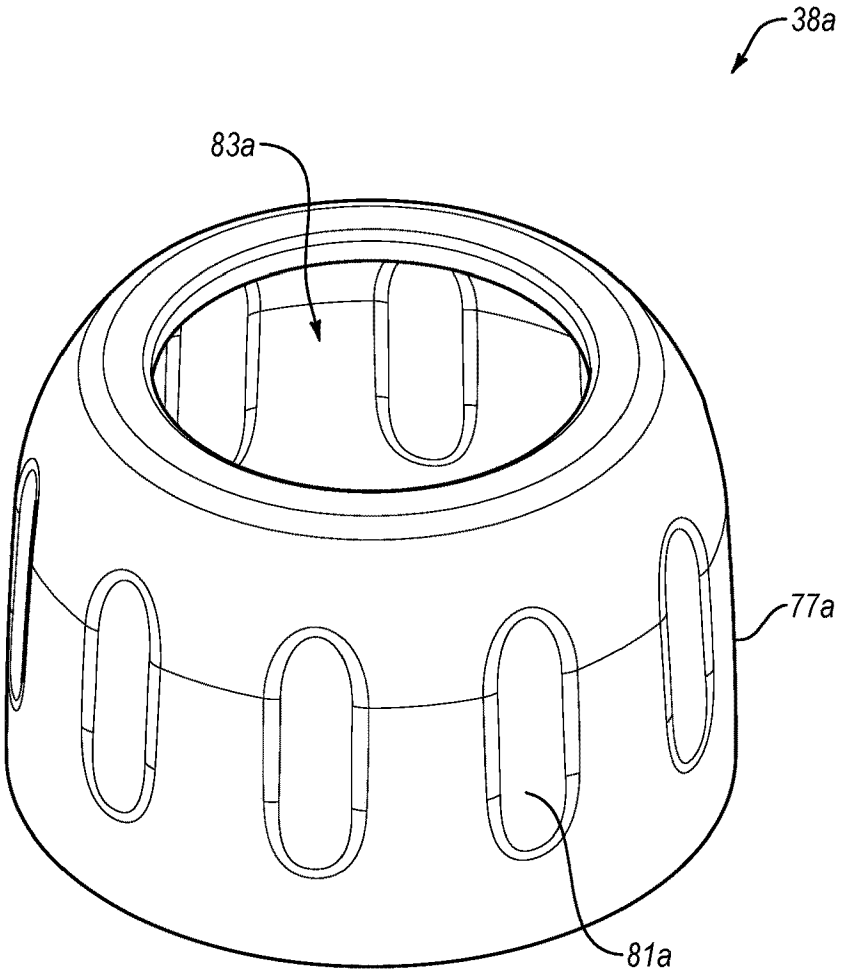
FIG. 9A is an upper perspective view of an example cover of the container of FIG. 1.

FIG. 9A is an upper perspective view of an example cover 38*a* of the container 10*a* of FIG. 1. FIG. 9B is a lower perspective view of the cover 38*a* of FIG. 9A. The cover 38*a* can shield, protect and/or enclose at least a portion of the closure 14*a*. The cover 38*a* can include an outer annular wall 77*a* with gripping portions 81*a* that generally match the gripping portions 75*a* of the closure 14*a*. The cover 38*a* can also include a central opening 83*a* that is aligned with a recess 44*a* in the upper surface of the closure 14*a*. The cover 38*a* and the closure 14*a* can be separate components that are connected by a friction or interference fit, adhesives, or other suitable connection structure(s) or method(s). The cover 38*a* and closure 14*a* can also be an integral, one-piece structure. The closure 14*a* and cover 38*a* can be constructed from the same or different materials, such as plastic, glass, metal, and other materials with suitable characteristics and properties. After reviewing the disclosure, it will be appreciated that the cover 38*a* may not be required.

Figure 10B:
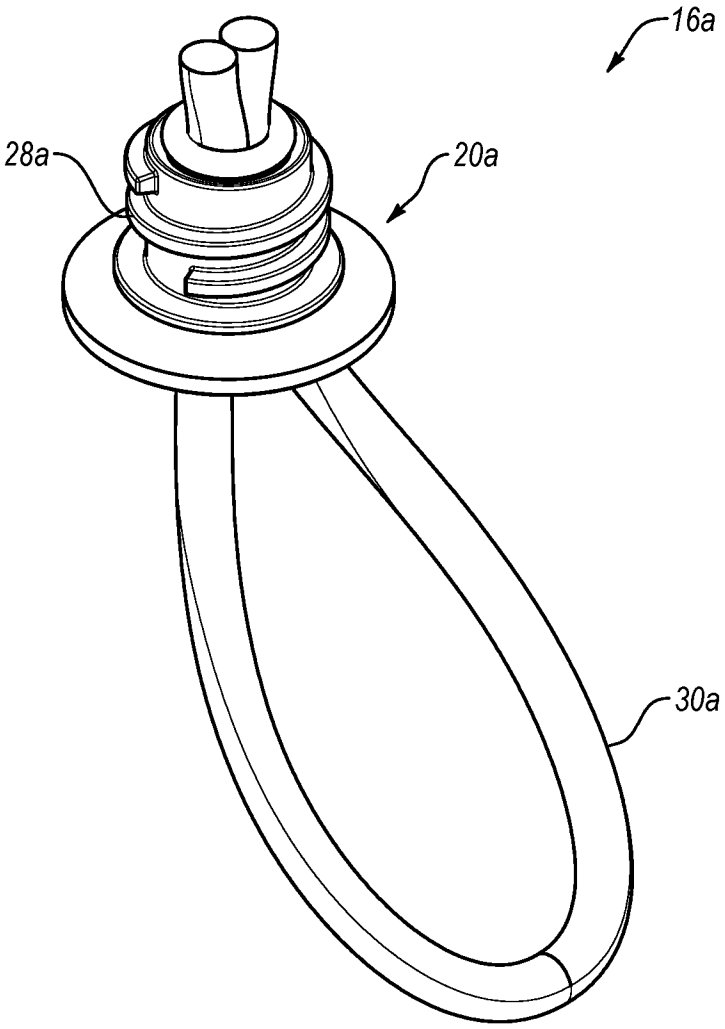
FIG. 10B is a lower perspective view of the carrying assembly of FIG. 10A.
Figure 10A:
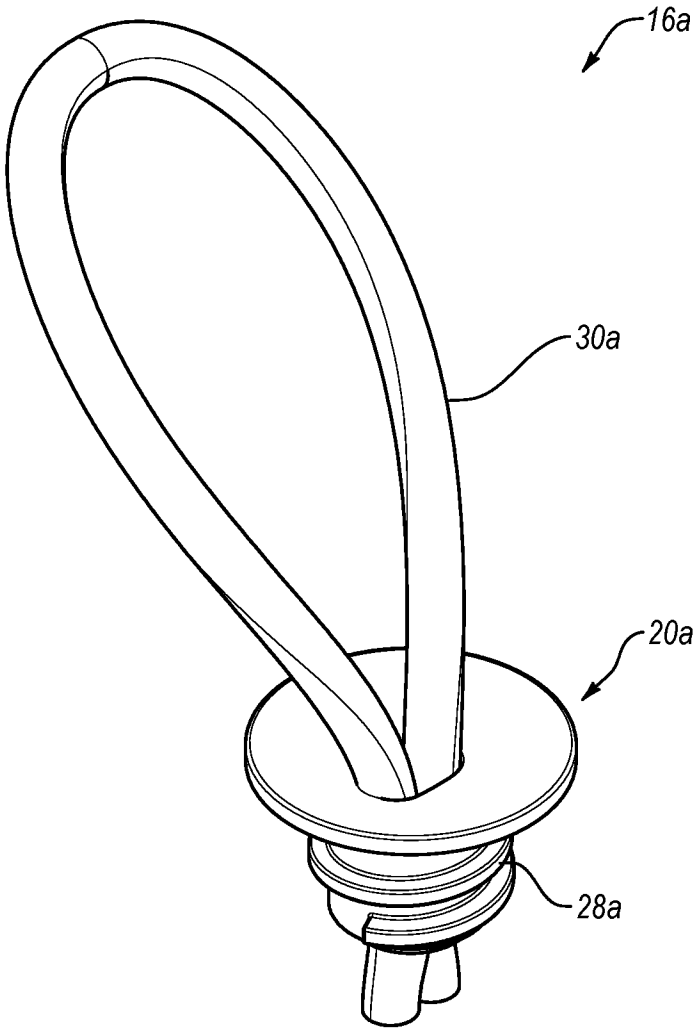
FIG. 10A is an upper perspective view of an example carrying assembly of the container of FIG. 1.

FIG. 10A is an upper perspective view of the carrying assembly 16*a* of the container 10*a* of FIG. 1. FIG. 10B is a lower perspective view of the carrying assembly 16*a* of FIG. 10A. The carrying assembly 16*a* can be connected to the closure 14*a*. The carrying assembly 16*a* can be centrally aligned with the central axis of the closure 14*a* and/or the container top 12*a*. The carrying assembly 16*a* can be selectively connected to the closure 14*a* by threading, snapping, twisting, sliding, or screwing the carrying assembly 16*a* to the closure. For example, the inner portion 74*a* of the closure 14*a* can include one or more internal or inner threads 34*a*, and the carrying assembly 16*a* can include an attachment member 20*a* with one or more corresponding outer threads 28*a*. The threads 34*a*, 28*a* can mate to allow the carrying assembly 16*a* to be selectively connected to the closure 14*a*. The carrying assembly 16*a* and the closure 14*a* can also be connected using other suitable types of connections and structures, depending, for example, upon the intended use of the container 10*a*.

The carrying assembly 16*a* can include a carrying loop 30*a*, which can aid in carrying the container 10*a* and/or attaching the container 10*a* to other objects. Advantageously, the carrying loop 30*a* can be selectively attached to a variety of different structures, and a variety of different carrying loops can be connected to the closure 14*a*. The carrying loop 30*a* can facilitate carrying, storing and transportation of the container by the user. The carrying loop 30*a* can be selectively connected and disconnected from the carrying assembly 16*a*. The carrying loop 30*a* can also be selectively removable or replaceable. For example, the attachment member 20*a* can include a central opening and a portion of the carrying loop 30*a* can be disposed in the opening. A locking member can be connected to the carrying loop 30*a* and the locking member can prevent the carrying loop 30*a* from being pulled upwardly and out of the attachment member 20*a*. The locking member, however, can allow the carrying loop 30*a* to be removed from the attachment member 20*a* by pulling downwardly on the carrying loop 30*a* and/or locking member when the carrying assembly 16*a* is not connected to the closure 14*a*. Thus, the carrying assembly 16*a* can be selectively connected to the closure 14*a*, and the carrying loop 30*a* can be selectively connected to the attachment member 20*a*. Advantageously, this can allow the carrying assembly 16*a* and/or the carrying loop 30*a* to be removed and/or replaced.

The carrying assembly 16*a* and/or the carrying loop 30*a* can facilitate functional and/or aesthetics changes. For example, the carrying loop 30*a* can be constructed from a line, cord, cable, rope, chain, carabiner, or the like. The carrying loop 30*a* can also be constructed from plastic, glass, metal, and other materials with suitable characteristics and properties. The carrying loop 30*a* can be constructed from flexible or inflexible materials, materials with different textures, and materials of different colors, patterns, and the like. Because the carrying assembly 16*a* and/or the carrying loop 30*a* can be selectively connected to the closure 14*a*, this can allow the carrying assembly 16*a* and/or the carrying loop 30*a* to be changed according to the desired use or appearance of the user. Thus, the user can change the carrying assembly 16*a* and/or the carrying loop 30*a* (along with other portions such as the cover 38*a* and/or the container top 12*a*) for functional or aesthetic reasons. Advantageously, the ability to change the carrying assembly 16*a*, the carrying loop 30*a*, the cover 38*a* and/or the container top 12*a* can increase the number of environments and potential uses of the container 10*a*.

FIG. 11 is a cross sectional side view of a portion of the container 10*a* of FIG. 1 along lines 11-11 shown in FIG. 1. As shown in, e.g., FIG. 11, the carrying loop 30*a* can be connected to the top of the closure 14*a* and the base of the carrying loop 30*a* can be centrally aligned with a center axis of the closure 14*a*, the container top 12*a*, and/or the container body 18*a*. The axial alignment of the carrying loop 30*a*, the closure 14*a*, the container top 12*a*, and the container body 18*a* can facilitate carrying of the container 10*a*. Because the carrying loop 30*a* can be selectively connected to the closure 14*a*, a placeholder or other structure can be connected to the closure 14*a*. After reviewing this disclosure, it will be appreciated that the carrying loop 30*a* and/or the carrying assembly 16*a* may not be required.

One or more seals, such as a gasket, washer, O-ring, or other seal, can be used in connection with the container top 12*a* and/or the closure 14*a*. For example, when the closure 14*a* is coupled to the container top 12*a*, the closure seal 40*a* can be positioned between the closure 14*a* and the container top 12*a*. The closure seal 40*a* can be configured as, for example, an insert and/or a gasket. The closure seal 40*a* can be generally disposed between the inner and outer portions 74*a*, 76*a* of the closure 14*a* and the closure seal 40*a* can be centrally aligned with a central axis of the closure 14*a*. The closure seal 40*a* can be used to seal the first and/or second openings 50*a*, 52*a* in the container top 12*a*.

Figure 7B:
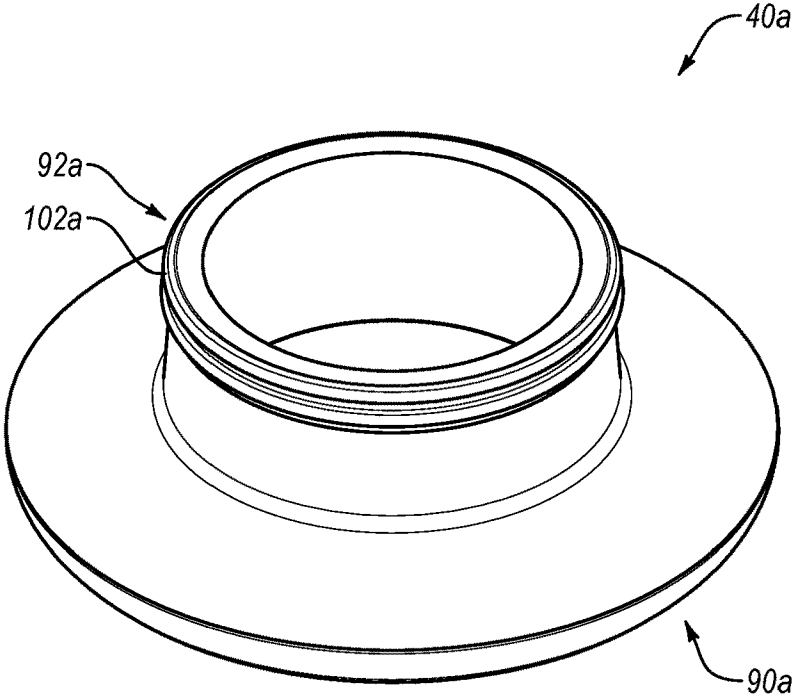
FIG. 7B is a lower perspective view of the closure seal of FIG. 7A.
Figure 7A:
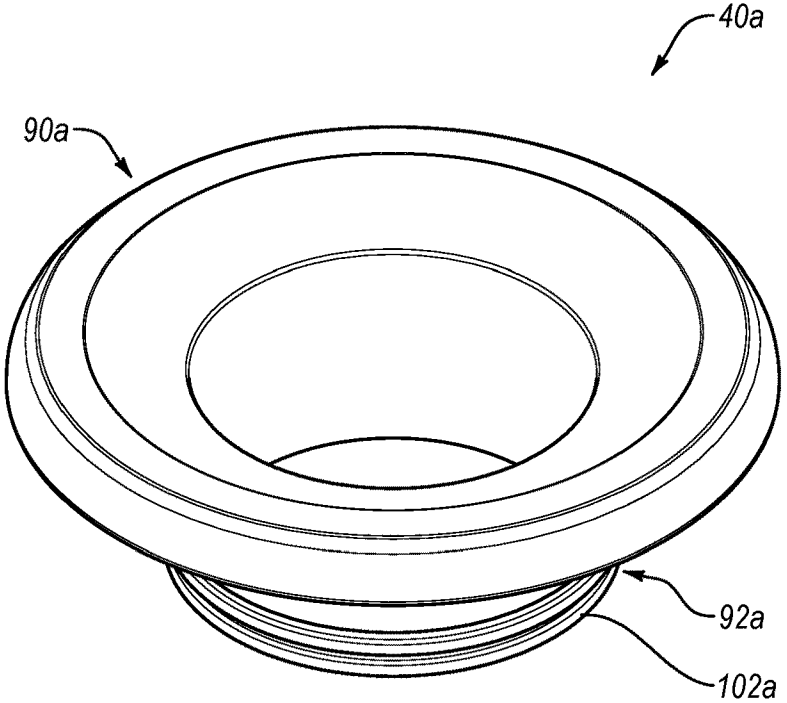
FIG. 7A is an upper perspective view of an example closure seal of the container of FIG. 1.
Figure 7C:
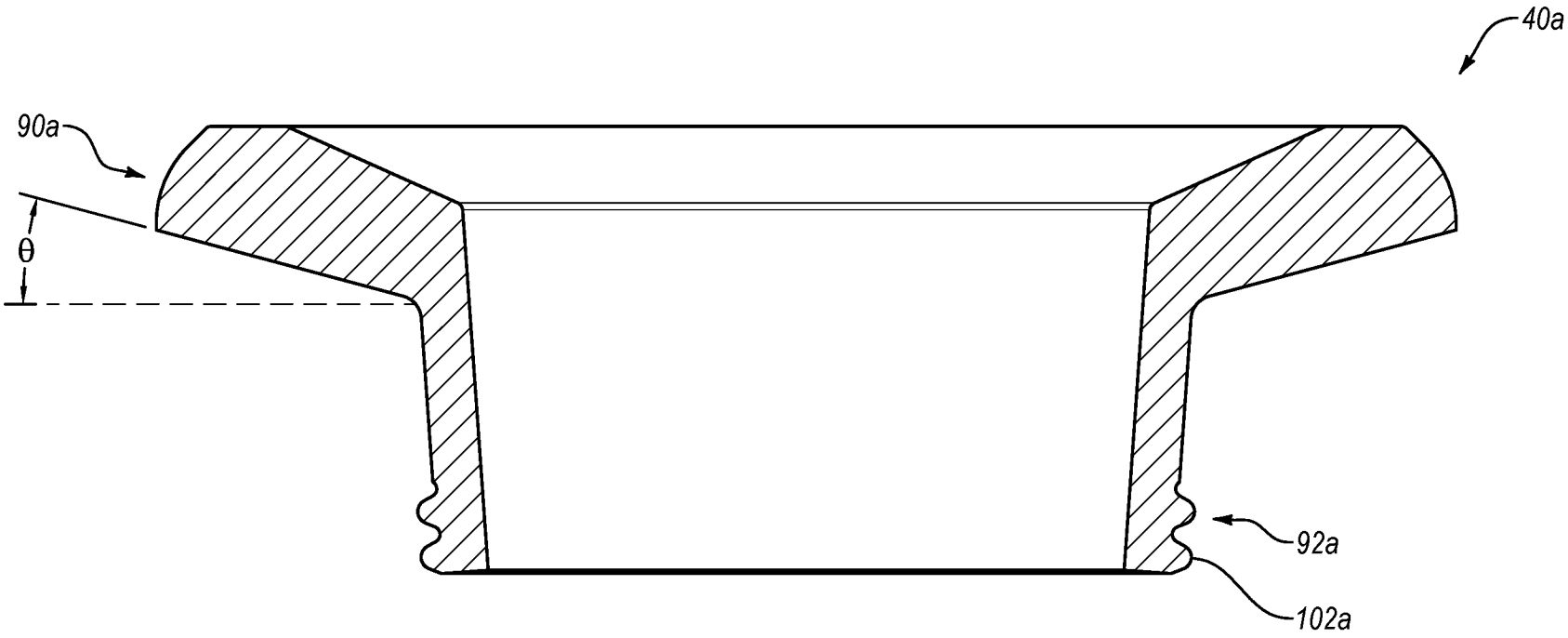
FIG. 7C is a cross-sectional side view of the closure seal of FIG. 7A.

FIG. 7A is an upper perspective view of the closure seal 40*a* of the container of FIG. 1. FIG. 7B is a lower perspective view of the closure seal 40*a* of FIG. 7A. FIG. 7C is a cross-sectional side view of the closure seal 40*a* of FIG. 7A. The closure seal 40*a*, for example, can include a first portion 92*a* that is sized and configured to at least partially seal the first opening 50*a* in the container top 12*a*, and a second portion 90*a* that is sized and configured to at least partially seal the second opening 52*a* in the container top 12*a*.

The first portion 92*a* of the closure seal 40*a* can include a downwardly extending annular flange 102*a*, and the first portion 92*a* of the closure seal 40*a* can enclose or encircle a portion of the inner portion 74*a* of the closure 14*a*. The first portion 92*a* of the closure seal 40*a* can be sized and configured to contact an inner surface of the first opening 50*a* when the closure 14*a* is attached to the container top 12*a*. For example, the first portion 92*a* of the closure seal 40*a* can have a shape that is sized and configured to contact an inner surface of the first opening 50*a* in the container top 12*a*. The inner surface of the first opening 50*a* of the container top 12*a* can include one or more corresponding surfaces that are sized and configured to contact the first portion 92*a* of the closure seal 40*a* when the closure 14*a* is connected to the container top 12*a*. The first portion 92*a* of the closure seal 40*a* and the inner surface of the first opening 50*a* can have matching or complementary surfaces that at least partially contact when the closure 14*a* is connected to the container top 12*a* with the closure seal 40*a* disposed therebetween. The first portion 92*a* of the closure seal 40*a* and the inner surface of the first opening 50*a* can be configured to engage each other at a region that extends contiguously and completely around an interior of the first opening 50*a*. The first portion 92*a* of the closure seal 40*a* and the inner surface of the first opening 50*a* can be configured to engage each other at multiple regions that each extend contiguously and completely around an interior of the first opening 50*a*. In some embodiments, a lower portion of the first portion 92*a* of the closure seal 40*a* can include one or more engaging portions, such as outwardly extending projections or protrusions, which are sized and configured to contact the inner surface of the first opening 50*a*. The first portion 92*a* of the closure seal 40*a* and the inner portion 74*a* of the closure 14*a* can at least partially seal the first opening 50*a* when the closure 14*a* is connected to the container top 12*a*. The first portion 92*a* of the closure seal 40*a* can contact and seal against the inner portion 74*a* of the closure 14*a*.

The second portion 90*a* of the closure seal 40*a* can comprise an annular ring with an upper surface that contacts an inner surface of the closure 14*a*, and a lower sealing surface that is sized and configured to seal the second opening 52*a* in the container top 12*a* when the closure 14*a* is connected to the container top 12*a*.

In at least one embodiment in which the closure 14*a* is secured to the container top 12*a* by screwing the closure 14*a* to the container top 12*a* or in attachment types involving alignment of central axes of the closure 14*a* and the container top 12*a* and rotation of one relative to the other about the aligned central axes, the lower sealing surface of the second portion 90*a* can be radially symmetric. All or a portion of the lower sealing surface can be defined by complete or partial revolution of a line around an axis, such as, for example, the axis 51 illustrated in FIG. 11. The line can be straight, curved, or comprise a combination of straight and curved segments. Curvature of the line can be concave or convex. In some embodiments, the lower sealing surface can have a generally flat or frustoconical configuration. The lower sealing surface of the second portion 90*a* can have a complementary shape to the upper surface of the second opening 52*a*. In some embodiments, the lower sealing surface of the second portion 90*a* can be a circular-bounded planar surface and the upper surface of the second opening 52*a* can lie in a plane. In some embodiments, the lower sealing surface of the second portion 90*a* can be a frustoconical surface (with radius increasing vertically up or down) and the upper surface of the second opening 52*a* can lie in a complementary frustoconical surface. The axis of revolution for this region can be aligned (e.g., coincident or coaxial) with an axis of movement (e.g., rotation and/or translation) of the closure 14*a* relative to the container body 18*a* and/or container top 12*a* as the closure 14*a* is attached to the container body 18*a* and/or container top 12*a*.

Alternatively or additionally, with reference to the cross-sectional view of FIG. 7C, the lower sealing surface of the second portion 90*a* can be disposed at an angle θ relative to a horizontal reference, which angle θ can be approximately the same angle as the upper surface of the second opening 52*a* considered from the same reference frame. The foregoing configuration can help create a fluid tight seal when the closure 14*a* is connected to the container top 12*a*.

In some embodiments, the lower sealing surface of the second portion of the closure seal 40*a* can have an at least partially frustoconical shape that is sized and configured to contact the upper surface of the second opening 52*a* in the container top 12*a* which has at least a portion of a complementary frustoconical shape. In embodiments wherein the central axis of the closure 14*a* is aligned with the central axis of the container top 12*a* when the closure 14*a* is attached to the container top 12*a*, an axis of revolution of a frustoconical portion of the lower sealing surface of the second portion 90*a* of the closure seal 40*a* can be brought into substantially coaxial alignment with an axis of revolution of a frustoconical surface of (e.g., surrounding) in which the upper surface of the second opening 52 lies when the closure 14*a* is being attached to the container top 12*a*, such that the complementary frustoconical shapes are brought into sealing engagement. Thus, the lower sealing surface of the second portion 90*a* of the closure seal 40*a* can consistently contact the upper surface of the second opening 52*a*.

In addition, because the lower sealing surface of the second portion 90*a* of the closure seal 40*a* can be symmetrical relative to the central axis of the closure 14*a*, the lower sealing surface of the second portion 90*a* of the closure seal 40*a* can consistently contact the upper surface of the second opening 52*a*. Further, because the lower sealing surface of the second portion 90*a* of the closure seal 40*a* can be complementary to the upper surface of the second opening 52*a*, the lower sealing surface of the second portion 90*a* of the closure seal 40*a* can consistently contact the upper surface of the second opening 52*a*. In some embodiments, the lower sealing surface of the second portion 90*a* of the closure seal 40*a* and the upper surface of the second opening 52*a* can be planar and their planes can be normal to an axis of rotation of the closure 14*a* relative to the container top 12*a*.

In some embodiments, the first and second portions 92*a*, 90*a* of the closure seal 40*a* are formed as a single, integral component, while in other embodiments, the first and second portions 92*a*, 90*a* can be formed as separate components, which can be joined together or spaced from each other when assembled to the closure 14*a*.

One or more components, such as the lower seal 26*a*, the upper seal 26*b*, and/or the closure seal 40*a*, for example, can be constructed from materials that are flexible, bendable, compressible, and/or expandable. The components, such as the lower seal 26*a*, the upper seal 26*b*, and/or the closure seal 40*a*, for example, can also be constructed from materials that are elastic, malleable, flexible and/or resilient. For example, the lower seal 26*a*, the upper seal 26*b*, the closure seal 40*a*, and/or other components can be constructed from rubber, plastic, or other materials with suitable properties and characteristics.

Advantageously, the container body 18*a*, the container top 12*a*, the closure 14*a*, the carrying assembly 16*a*, and the carrying loop 30*a* can be quickly and easily connected and disconnected, which can facilitate use, cleaning, and manufacturing. For example, the container top 12*a* can be quickly and easily connected to the container body 18*a*, e.g., by a threaded connection. The lower seal 16*a* (see FIG. 4), which can have a generally ring-shaped configuration, can help prevent fluid disposed inside the container body 18*a* from entering into the area of the threaded connection of the container top 12*a* to the container body 18*a*. The upper seal 26*b* (see FIGS. 5A and 5B) can help prevent dirt, debris, and other objects from outside the container body 18*a* entering into the area of the threaded connection of the container top 12*a* to the container body 18*a*. The upper seal 26*b* can include an outer surface that is sized and configured to engage the closure 14*a* when the closure 14*a* is attached to the container top 12*a*, which can help prevent dirt, debris, and other objects from entering into the area of the threaded connection of the container top 12*a* and the container body

18*a*. The closure 14*a* can be quickly and easily connected to the container top 12*a*, e.g., by the threaded connection. The closure seal 40*a* (see FIGS. 7A and 7B), which can be connected to the closure 14*a* by an interference fit, friction fit, adhesive, or the like, can help seal the first and/or second openings 50*a*, 52*a* in the container top 12*a*. Because the central axis of the closure 14*a* and the closure seal 40*a* can be generally aligned with the central axis of the container top 12*a* when the closure 14*a* is being connected to the container top 12*a*, the lower sealing surface in the second portion 90*a* of the closure seal 40 can consistently and repeatedly seal the second opening 52*a* in the container top 12*a*.

One of ordinary skill in the art will appreciate after reviewing this disclosure that the container 10*a*, the container top 12*a*, the closure 14*a*, and the carrying assembly 16*a*, along with other parts and components, can have other suitable shapes, sizes, configurations and arrangements.

In operation, the container top 12*a* can be connected to the container body 18*a* and fluid can be dispensed through the one or more openings 50*a*, 52*a* in the container top 12*a* (e.g., with one, both, or neither of the lower seal 26*a* and the upper seal 26*b* between the container top 12*a* and the container body 18*a*). For example, the user can quickly consume a large volume of fluid through the first opening 50*a* by tipping the container 10*a*. The user can more slowly consume fluid by sipping or sucking on the second opening 52*a* when the container 10*a* is in a generally upright configuration. When the user desires to seal the container 10*a*, the closure 14*a* can be connected to the container top 12*a* and the closure 14*a* and the closure seal 40*a*, if present, can prevent fluid flow through the one or more openings in the container top 12*a*. The user can carry the container 10*a* by the carrying assembly 16*a* and/or carrying loop 30*a* when the carrying assembly 16*a* is connected to the closure 14*a*. Advantageously, the container 10*a* and the container top 12*a* can be selectively connected, the container top 12*a* and the closure 14*a* can be selectively connected, the closure 14*a* and the carrying assembly 16*a* can be selectively connected, and/or the carrying assembly 16*a* and the carrying loop 30*a* can be selectively connected. The selective connection of the one or more parts and components can facilitate using, cleaning, manufacturing, and/or other actions. The selective connection can facilitate interchanging one or more parts and/or components. Advantageously, because the parts and components can have different shapes, colors, textures, patterns, or other aspects, the aesthetics and functionality can be changed. Further, the selective connection can facilitate repair and/or replacement of the container body 18*a*, the container top 12*a*, the closure 14*a*, the carrying assembly 16*a*, and/or the carrying loop 30*a*.

Figure 12:
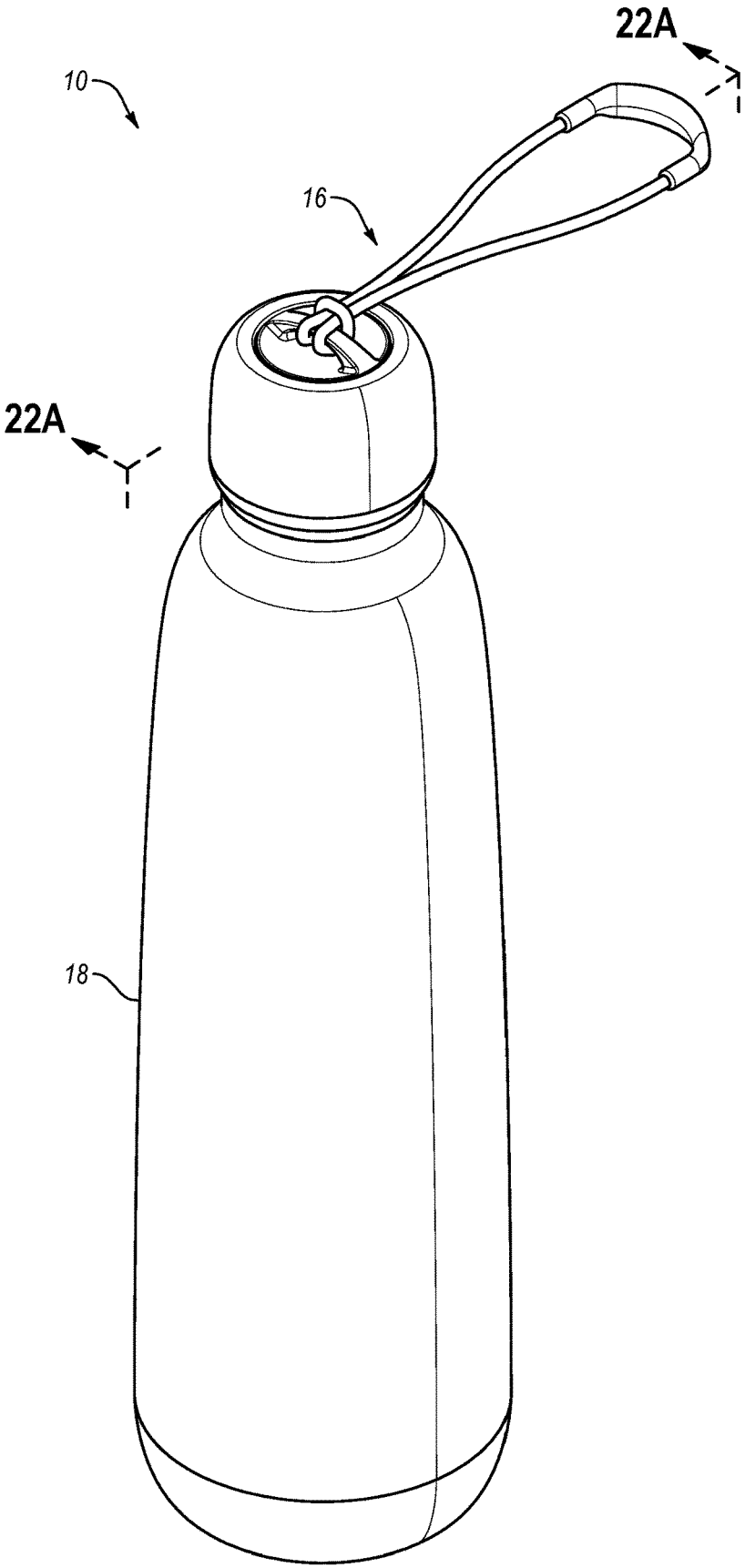
FIG. 12 is an upper perspective view of another example container.

FIG. 12 is an upper perspective view of an example container 10. As shown in FIG. 12, the container 10 can include a container body 18 and a carrying assembly 16. The container body 18 can be sized and shaped to hold, retain and/or store one or more liquids and/or solids. The carrying assembly 16 can permit the container 10 to be carried, for example, by a user.

Figure 13:
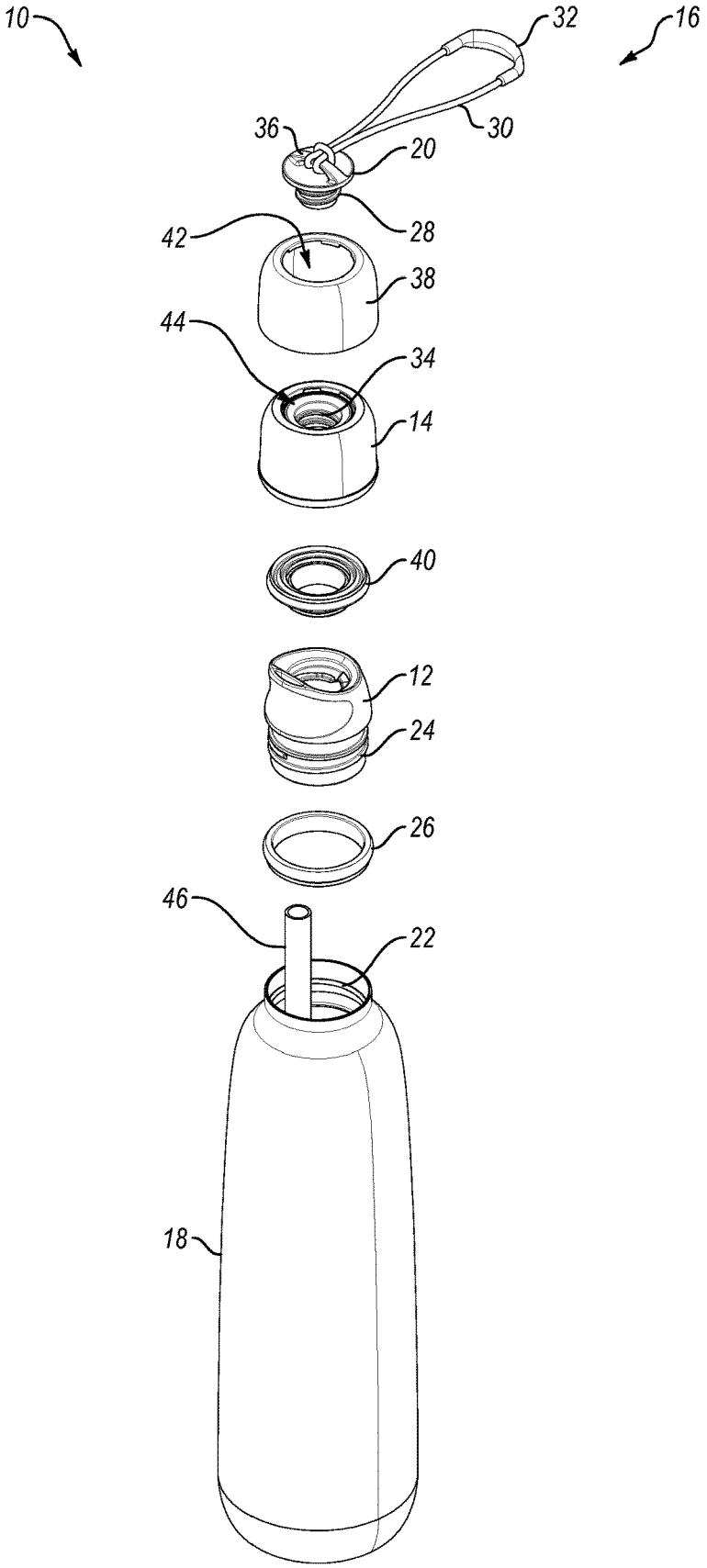
FIG. 13 is an exploded upper perspective view of the container of FIG. 12.

FIG. 13 is an exploded upper perspective view of the example container 10 of FIG. 12. The container 10 can include a container top 12 and a closure 14. The container top 12 can permit a user to access the contents, e.g., liquids and/or solids, positioned in the container body 18. The closure 14 can removably cover the container top 12 to secure the liquids and/or solids inside of the container body 18.

The container top 12 can be selectively connected to the container body 18. For example, the container top 12 can be selectively connected to the container body 18 by threading, snapping, twisting, sliding, or screwing the container top to the container. An upper portion of the container body 18 can include one or more threads 22 and a lower portion of the container top 12 can include one or more corresponding threads 24, for example, as illustrated. The threads 22, 24 can mate to allow the container top 12 to be selectively connected to the container body 18. The threaded connection can require multiple turns to securely connect the container body 18 and the container top 12, and it will be appreciated that the container body 18 and the container top 12 can be connected by any suitable number of turns. The container body 18 and the container top 12 can also be connected using other suitable types of connections and structures depending, for example, upon the intended use of the container. The engagement between the container top 12 and the container body 18 can provide (by itself or with the aid of other component(s), such as a seal, for example) a secure, airtight, watertight and/or leak-proof seal between the container top 12 and the container body 18.

One or more seals, such as a gasket, washer, O-ring or other suitable seal, can be used in connection with the connection of the container body 18 and the container top 12. When the container top 12 is coupled to the container body 18, a seal 26 can be positioned between the container top 12 and the container body 18. The seal 26 can be disposed at least proximate a lower portion of the container top 12. The seal 26 can form an airtight, watertight and/or leak-proof seal between the container body 18 and the container top 12. In some embodiments, the seal 26 can remain with the container top 12, and can be attached to and removed from the container body 18 with the container top 12. In other embodiments, the seal 26 can remain with the container body 18 and can be attached to and removed from the container top 12 with the container body 18.

The carrying assembly 16 can include an attachment member 20, a carrying loop 30, and a handle 32. The attachment member 20 can be connected to the closure 14, such as to an upper portion of the closure 14. The attachment member 20 can be centrally aligned with the central axis of the closure 14 and/or the container top 12. The attachment member 20 can be permanently connected to the closure 14, for example, by welding (sonic, spin, or form of welding) or gluing. The attachment member 20 can be selectively connected to the closure 14, for example, by threading, snapping, twisting, sliding, or screwing the carrying assembly 16 to the closure 14. For example, an inner portion of the closure 14 can include one or more inner threads 34, and the attachment member 20 of the carrying assembly 16 can include one or more corresponding outer threads 28. The threads 34, 28 can mate to allow the attachment member 20 to be selectively connected to the closure 14. The attachment member 20 and the closure 14 can alternatively or additionally be connected using other suitable types of connections and structures, depending, for example, upon the intended use of the container body 18.

The carrying loop 30 can aid in carrying the container body 18 and/or attaching the container 10 to other objects. The handle 32 can be coupled to the carrying loop 30. In the illustrated configuration, the carrying loop 30 extends into and/or through the handle 32, although other configurations can be implemented. Advantageously, the carrying loop 30 can be selectively attached to a variety of different structures, and a variety of different carrying loops can be connected to the attachment member 20 or the closure 14. The carrying loop 30 can facilitate carrying, storing and/or transporting the container 10 by a user. The carrying loop 30 can be selectively connected and disconnected from the attachment member 20. In some configurations, the carrying assembly 16 can omit an attachment member 20, and the loop 30 and/or the handle 32 can be connected directly to the closure.

The carrying loop 30 can be selectively removable or replaceable. For example, as shown, the attachment member 20 can include a connecting portion 36 to which the carrying loop 30 can be coupled. In some configurations, the closure 14 can include the connecting portion 36. In the illustrated configuration, the connecting portion 36 is a loop member having an opening that permits the carrying loop 30 to be looped through or tied to the connecting portion 36. Nonetheless, other configurations can be implemented. In the illustrated configuration, the carrying assembly 16 is selectively connected to the closure 14, and the carrying loop 30 can be selectively connected to the attachment member 20. Advantageously, this can allow the carrying assembly 16 and/or the carrying loop 30 to be removed and/or replaced.

The carrying assembly 16 and/or carrying loop 30 can facilitate functional and/or aesthetics changes. For example, the carrying loop 30 can be constructed from a line, cord, cable, rope, chain, or other material and/or structure. The carrying loop 30 can be constructed from flexible or inflexible materials, materials with different textures, and materials of different colors, patterns, or other features. Because the carrying assembly 16 and/or carrying loop 30 can be selectively connected to the closure 14, this can allow the carrying assembly 16 and/or carrying loop 30 to be changed according to the desired use or appearance of the user. Thus, the user can change the carrying assembly 16 and/or the carrying loop 30 (along with other portions of the container 10) for functional or aesthetic reasons. Advantageously, the ability to change the carrying assembly 16, the carrying loop 30, the closure 14 and/or the container top 12 can increase the number of environments and potential uses of the container 10.

As shown in FIG. 13, the carrying loop 30 can be connected to the top of the attachment member 20, which in turn can be connected to the closure 14, with the attachment member 20 centrally aligned with a center axis of the closure 14, the container top 12, and/or the container body 18. The axial alignment of the carrying loop 30, the closure 14, the container top 12, and the container body 18 can facilitate carrying of the container 10. Because the carrying loop 30 can be selectively connected to the closure 14, a placeholder or other structure can be connected to the closure 14. In other configurations, a carrying loop 30 or the carrying assembly 16 may not be included.

One or more seals, such as a gasket, washer, O-ring, or other seal, can be used in connection with the closure 14 and the container top 12. When the closure 14 is coupled to the container top 12, a closure seal 40 (see e.g., FIG. 13) can be positioned between the closure 14 and the container top 12. The closure seal 40 can form an airtight, watertight and/or leak-proof connection between the closure 14 and the container top 12. In some embodiments, the closure seal 40 can remain with the closure 14, and can be attached to and removed from the container top 12 with the closure 14. The closure seal 40 can be disposed at least proximate a downwardly facing portion of the closure. In some embodiments, the closure seal 40 can remain with the container top 12 and can be attached to and removed from the closure 14 with the container top 12. The closure seal 40 is described in further detail below in connection with FIGS. 10A-10F.

The container 10 can include a cover 38 that can cover, shield, protect and/or enclose at least a portion of the closure 14. The cover 38 can have an opening with a shape and/or size that generally corresponds with an outer portions of the closure 14. The cover 38 can also include a central opening 42 that is aligned with a recess 44 in the upper surface of the closure 14. In some configurations, the cover 38 and closure 14 can be separate components that are connected by a friction or interference fit, adhesives, or other connector or fastener. In some configurations, the cover 38 and closure 14 can be overmolded or an integral, one-piece structure. The closure 14 and cover 38 can be constructed from the same or different materials, such as plastic, glass, metal, or other materials with suitable characteristics and properties. In some configurations, the cover 38 may not be included in the container 10.

The container 10 can include a conduit 46 that facilitates removal of fluids and/or solids from the container body 18. In some configurations, the conduit 46 can be positioned at least partially in the container body 18 and can be removably or permanently coupled to the container top 12. The conduit 46 can have a length that extends from the container top to a lower portion of a reservoir within the container body 18, and can terminate at its lower end near a bottom of the reservoir. The conduit 46 will be described in further detail below in connection with FIGS. 5A-5B.

Figure 14B:
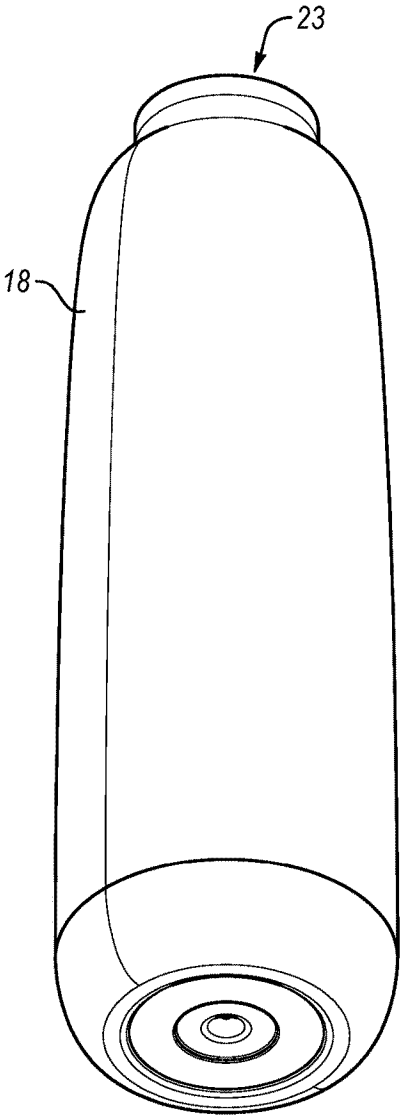
FIG. 14B is a lower perspective view of the container body of FIG. 14A.
Figure 14A:
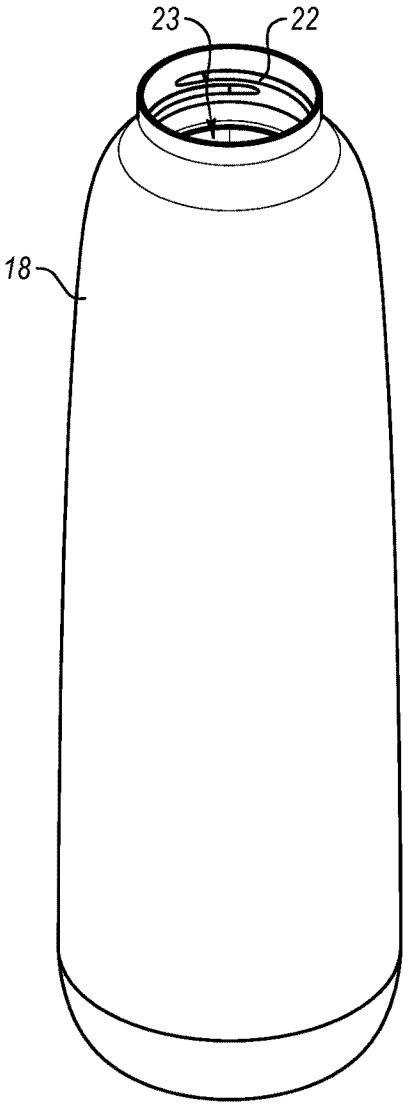
FIG. 14A is an upper perspective view of an example container body of the container of FIG. 12.

FIG. 14A is an upper perspective view of the example container body 18 of FIGS. 1 and 2, and FIG. 14B is a lower perspective view of the same container body 18 as shown in FIG. 14A. As mentioned above, the container body 18 can be sized and configured to hold, retain and/or store one or more liquids and/or solids. The container body 18 can be a vessel or bottle. The container can have a reservoir 23 and can be used to store liquids such as water, flavored water, vitamin enhanced water, or other liquids. The container body 18 can store fluids and solutions such as juices, energy drinks, thirst-quenchers, or other types of beverages. The container body 18 can also be used to store solids such as powders, concentrates, mixes, or foodstuffs.

The container body 18 can be of any suitable size. For example, the container body 18 can hold approximately 8, 12, 16, 20, 24, 28, 32, or 45 ounces, or about 200, 300, 400, 500, 600, 700, 800, 900, 1000, 1100, 1200, 1300, 1400 ml, or a liter. The container body 18 can have any suitable size, including smaller and larger sizes. In addition, the container body 18 can have other shapes and configurations other than those disclosed herein, depending, for example, upon the intended use of the container. Further, the container body 18 can be insulated to help keep the contents at a desired temperature. The container body 18 can be made of plastic, glass, metal, and/or other materials with suitable properties and characteristics.

Figure 15B:
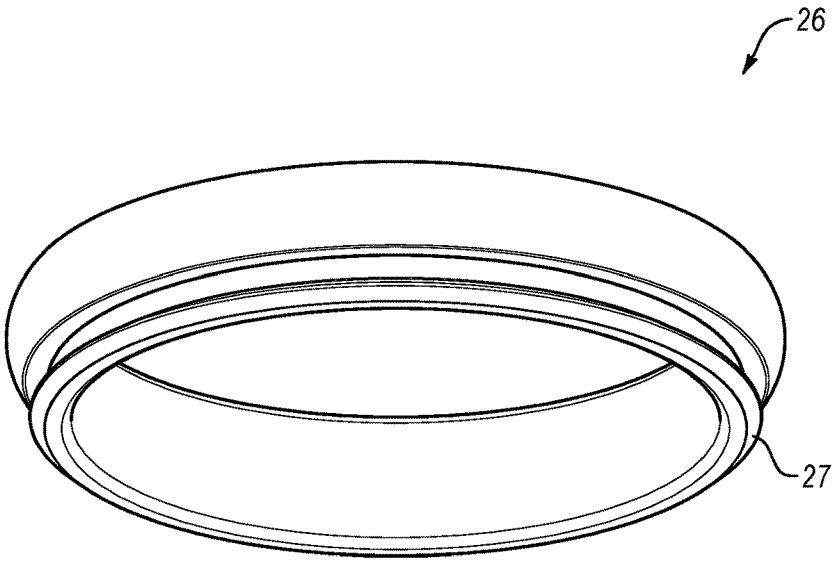
FIG. 15B is a lower perspective view of the seal of FIG. 15A.
Figure 15A:
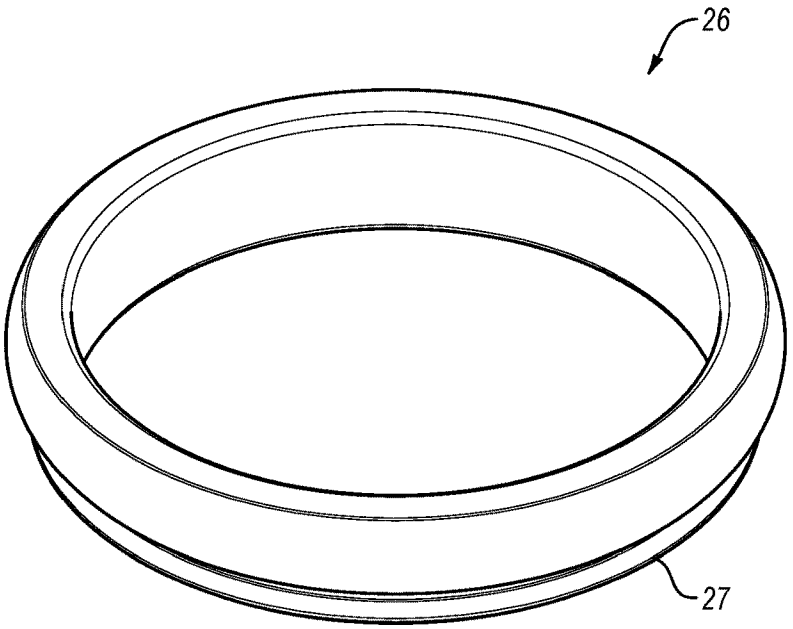
FIG. 15A is an upper perspective view of an example seal of the container of FIG. 12.

FIG. 15A is an upper perspective view of the example seal 26 of FIG. 13, and FIG. 15B is a lower perspective view of the same seal as shown in FIG. 15A. The seal 26 can be configured as a seal, gasket, washer, O-ring or other sealing component. The illustrated seal 26 is annular and includes a wider portion proximate the top of the seal 26, a narrower portion proximate the bottom of the seal 26, and an even narrower portion between the wider portion and the narrower portion. However, the seal 26 can include any suitable configuration that can be implemented depending on the application and/or the size and shape of the container top 12 and a neck of the container body 18.

The seal 26 can include a radially extending annular flange 27, for example as illustrated in FIGS. 4A and 4B. In some configurations, the seal 26 can inhibit or prevent passage of fluid between the container body 18 and the container top 12.

As mentioned, in some configurations the seal 26 can be retained with the container top 12. In such configurations, the seal 26 can be sized and shaped to be positioned in a recess of the container top 12. The seal 26 can be constructed from materials that are flexible, bendable, compressible, and/or expandable. Additionally or alternatively, the closure seal 40 can be constructed from materials that are elastic, malleable, flexible and/or resilient. For example, the seal 26 can be constructed from rubber, plastic, or other materials with suitable properties and characteristics. The resilience of the seal 26 can contribute in retaining the seal 26 in the recess of the container top 12. For example, the seal 26 can exert a radial force on the container top 12 toward a central axis of the container top 12 and/or the seal 26, thereby retaining the seal 26 in the recess of the container top 12. In other configurations, the seal 26 can be retained with the container body 18, for example, in a recess of the container body 18.

Figure 16B:
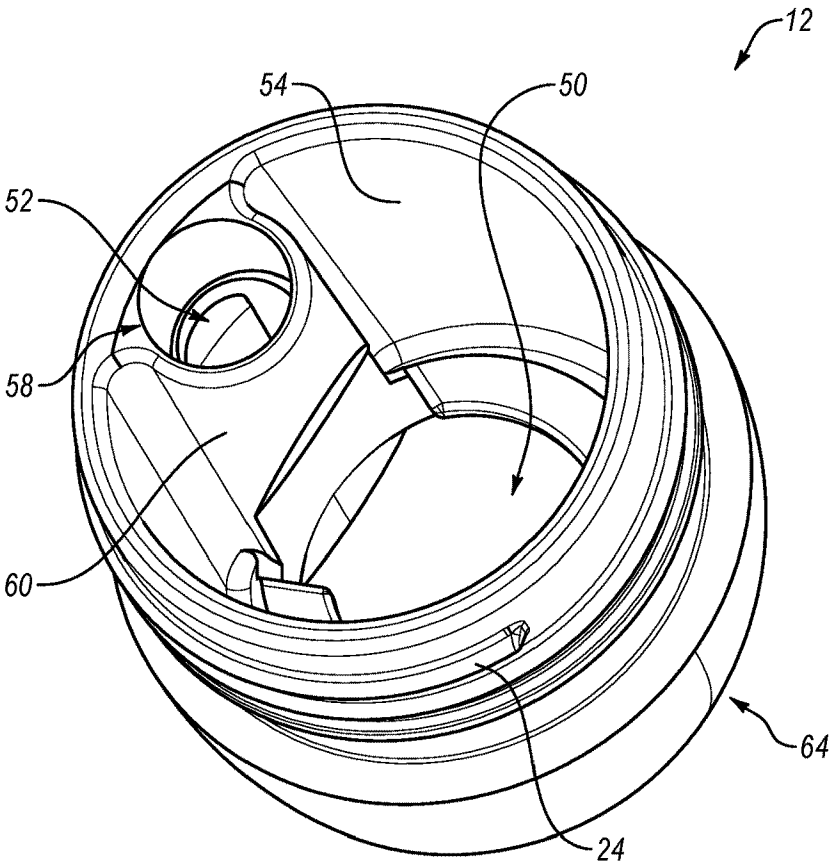
FIG. 16B is a lower perspective view of the container top of FIG. 16A.
Figure 16A:
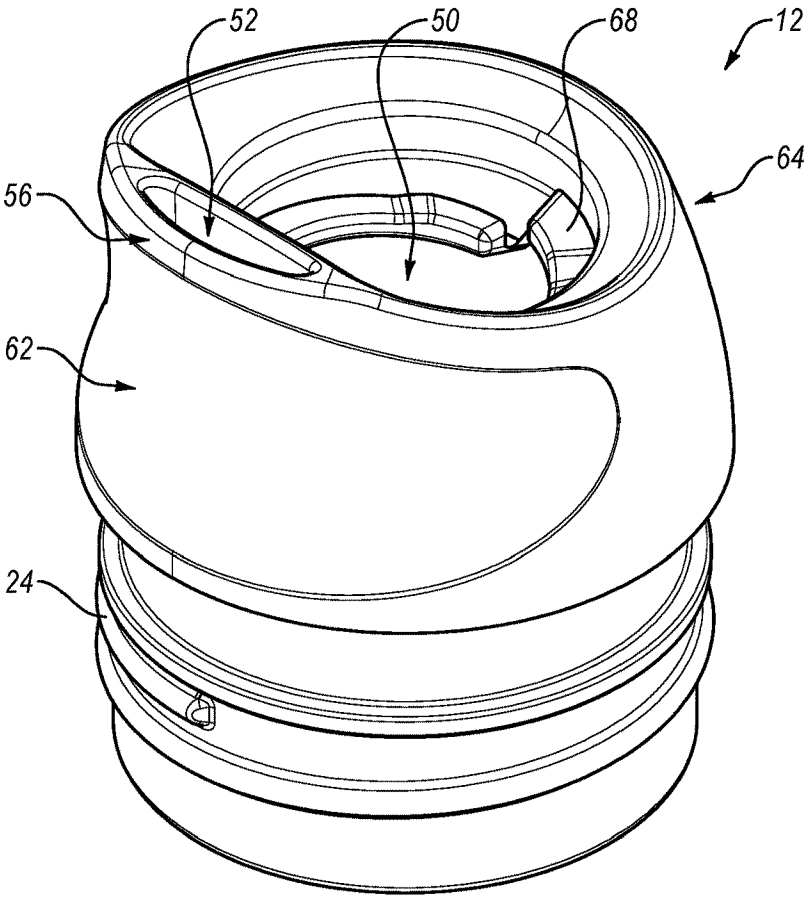
FIG. 16A is an upper perspective view of an example container top of the container of FIG. 12.

FIG. 16A is an upper perspective view of the example container top 12 of FIG. 13, and FIG. 16B is a lower perspective view of the same container top 12 as shown in FIG. 16A. The container top 12 can include one or more openings and the openings can provide access to the contents of the container body 18. For example, as shown in FIG. 16A-5B, the container top 12 can include a first opening 50 and a second opening 52. The first opening 50 can provide direct access to the contents of the container body 18 and the contents of the container can be poured or otherwise discharged through the first opening 50.

The first opening 50 can be larger than the second opening 52 and can allow a larger rate of fluid flow through the first opening 50 in comparison to the second opening 52. For example, the first opening 50 can be two, three, four, five, six or more times the size of the second opening 52. In other configurations, the first opening 50 can be smaller than the second opening 52 and the openings can have various sizes depending, for example, upon the intended use of the container 10. The first opening 50 can comprise a portion having a generally cylindrical configuration and the first opening 50 can be at least partially defined by an inwardly facing wall 54 of the container top 12. For example, the generally cylindrical portion of the first opening 50 can have a substantially circular cross-section.

In some configurations, the second opening 52 can be implemented for drinking through a straw. In some such configurations, a top portion 56 of the second opening 52 can be shaped to facilitate forming a seal between a user's lips and the container top 12 around the second opening 52. The top portion 56 can include a generally oval, round, arcuate, curved, rounded or other suitable configuration. Additionally or alternatively, the container top 12 can include a shape that facilitates positioning a user's lips for drinking out of the container 10 through the first opening 50.

A coupling portion 58 of the second opening 52 can be sized and shaped to interface with a conduit 26, such as example conduit 46 shown in FIG. 13. For example, the coupling portion 58 can be sized and shaped to receive an end portion of the conduit 46. In some configurations, the conduit 46 can be a tube or a straw. The shape of the coupling portion 58 of the second opening 52 can be complementary to a shape of the conduit 46.

The conduit 46 can be removably or permanently coupled to the container top 12 and/or the second opening 52. For example, the conduit 46 can be removably retained in the second opening 52 by a press fit, friction fit, or interference fit. In other configurations, the conduit 46 can be permanently retained in the second opening 52 by an adhesive, fastener, fastening structure, clip, or any suitable retention configuration. In further configurations, the conduit 46 can be coupled to the container top 12 without being positioned in the second opening 52. In such configurations, the conduit 46 can nevertheless be fluidly coupled to the second opening 52. In some configurations, the container top 12 can include a coupling portion, such as a receiving portion, and an end of the conduit 46 can be connected to the receiving portion. The container top 12 can include an engaging portion and an end of the conduit 46 can be connected to the engaging portion. The end of the conduit 46 can engage with an interior or exterior of the coupling portion or the engaging portion.

When the conduit 46 is fluidly coupled to the second opening 52, the conduit 46 can permit a user to drink from a bottom portion of the container body 18 (see, for example, FIGS. 3A-3B), or other portion of the container body 18 depending on a length and shape (e.g., straightness or curvature) of the conduit 46 and how deep a bottom of the conduit 46 extends into the container body 18. In such configurations, a user can drink out of the container body 18 without tipping or inverting the container 10. The conduit 46 can facilitate comfortably drinking and/or emptying the container of fluid via suction from a user. Accordingly, the conduit 46 can be used in connection with the second opening 52 and the conduit 46 can aid in drinking from the container body 18. Thus, a user can sip or drink by sucking on the second opening 52 and fluid can flow through the conduit 46, the second opening 52, and into the mouth of the user.

The conduit 46 can have a length such that the conduit extends into the container body 18. For example, the conduit 46 can extend at least a portion, a majority, substantially all or an entire length of the container body 18. A lower end of the conduit 46 can be disposed towards a bottom or lower portion of the container body 18, which can allow the lower end of the conduit 46 to be in fluid communication with fluids disposed in the lower portion of the container body 18. A lower end of the conduit 46 can be disposed towards a sidewall the container body 18, which can allow a user to tip the bottle to accumulate a small remaining amount of container contents near the lower end of the conduit 46.

The second opening 52 can be proximate to and extend along a portion of the first opening 50. The first opening 50 and the second opening 52 can extend to an upper portion of the container top 12 and the first opening 50 and the second opening 52 can be disposed within and/or at least partially defined by wall(s) of the container top.

A divider 60 can at least partially separate or divide the first opening 50 and second opening 52. For example, the first opening 50 and the second opening 52 can be disposed adjacent or near each other and the divider 60 can at least partially separate the first opening 50 and the second opening 52. The divider 60, which can include a wall or a partition, can be a common wall for the first opening 50 and the second opening 52, and the divider 60 can form or define at least a portion of the first opening 50 and the second opening 52. For example, the divider 60 can include a first surface that forms or defines a portion of the first opening 50 and a second surface that forms or defines a portion of the second opening 52. In other configurations, the first opening 50 and the second opening 52 may not be separated by a divider, and the first opening 50 and the second opening 52 can be independently formed and/or defined.

As shown in FIGS. 5A-5B, a portion of the container top 12 can extend upwardly. For example, a front portion 62 of the container top 12 can extend farther upwardly than does a rear portion 64 of the container top 12. In some configurations, at least a portion of the second opening 52 can be disposed upwardly relative to a rear portion 64 of the container top 12. A front portion of the second opening 52 can also be disposed upwardly relative to a rear portion of the second opening 52.

In addition or alternative to a portion of the container top 12 extending upwardly, the front portion 62 can be curved and/or can comprise a recess to accommodate a user's lip (e.g., a user's lower lip) when the user is drinking through the first opening 50 and/or the second opening 52. The front portion 62 of the container top 12 can be proximate the second opening 52.

The front portion 62 of the container top 12 can be disposed at a different angle than the rear portion 64 of the container top 12. For example, the front portion 62 and the rear portion 64 can be angled with respect to a longitudinal axis of the container top 12. However, in some configurations, an angle of the front portion 62 can be different than an angle of the rear portion 64. For example, in some configurations an angle of the front portion 62 can be greater or less than an angle of the rear portion 64.

As shown, the front portion 62 extends upward with respect to the rear portion 64. A plane can be generally aligned with an upper surface of the front portion 62 and another plane can be generally aligned with an upper surface of the rear portion 64, and the planes can be separated by a distance. In the illustrated embodiment, the plane generally aligned with the upper surface of the front portion 62 is disposed above the plane generally aligned with the upper surface of the rear portion 64. The planes can be normal to the same one or more of a longitudinal axis of the container top, an axis of rotation for coupling the container top and the closure 14, a direction of flow as it leaves the first opening during drinking, or a direction of flow as it leaves the second opening during drinking. Stated another way, the front portion 62 of the container top 12 can extend to a first height and the rear portion 64 of the container top 12 can extend to a second height lower than the first height.

In addition or alternative to extending upwardly and/or comprising curvature or a recess, the front portion 62 of the container top 12 can extend outwardly or forwardly. For example, the front portion 62 of the container top 12 can extend outwardly or be angled forward relative to other portions of the outer wall of the container top 12 and/or relative to vertical. If the second opening 52 is located in the front portion 62 of the container top 12, at least a portion of the second opening 52 can extend outward relative to other portions of the outer wall of the container top 12 and/or relative to vertical. For example, an upper portion of the front portion of the second opening 52 can be disposed at an angle between about 0° and about 20° relative to other portions of the outer wall of the container top 12 and/or relative to vertical. For example, the upper portion of the front portion of the second opening 52 can be disposed at an angle between about 5° and about 10° relative to other portions of the outer wall of the container top 12 and/or relative to vertical.

In some embodiments, an upper surface of the first opening 50 can be generally aligned and generally disposed in the same plane. Thus, the upper surface of the front and rear portions of the first opening 50 can be generally aligned and generally disposed in the same plane. The upper surface of the divider 60 separating the first opening 50 and the second opening 52 can also be generally aligned and disposed in the same plane as the upper surface of the front portion of the first opening 50 and the rear surface of the second opening 52.

The container top 12 can comprise one or more surfaces configured for engagement with one or more seals for the first opening 52. For example, the first opening 50 can comprise one or more surfaces configured for engagement with one or more seals. As more specific examples, the first opening can comprise one or more horizontal surface(s), cylindrical surface(s), frustoconical surface(s), or a combination or portion thereof. In some embodiments, the first opening 50 can be shaped or otherwise configured as disclosed herein with reference to the first opening 50*a*. The surface(s) can be sized and positioned for engagement with one or more sealing portions 96.

In some embodiments, the upper surface of the front portion of the first opening 50 and/or the rear portion of the second opening 52 can be disposed upwardly and in a different plane, e.g., at a different height, than the rear portion of the first opening 50. Additionally or alternatively, the upper surface of the front portion of the second opening 52 can be disposed upwardly and in a different plane, e.g., at a different height, than the rear portion of the second opening 52, the front portion of the first opening 50, and/or the rear portion of the first opening 50. The front portion of the second opening 52 can be generally aligned with a plane that is a first distance away from a plane that is generally aligned with a rear portion of the first opening 50. The rear portion of the second opening 52 can be generally aligned with a plane that is a second distance away from the plane that is generally aligned with the rear portion of the first opening 50. In some embodiments, the first distance can be larger than the second distance, and/or the second distance can be zero, depending, for example, upon the intended use of the container 10. In some embodiments, the first distance can be smaller than or equal to the second distance.

In some embodiments, the upper surface of the first opening 50 can generally curve upward from the rear portion of the first opening 50 to the front portion of the first opening 50. Alternatively or additionally, from the rear portion to the front portion of the first opening 50, the upper surface of the first opening 50 can curve downward a first distance before curving upward a second distance greater than the first distance.

The container top 12 can comprise one or more surfaces configured for engagement with one or more seals for the second opening 52. For example, an upper surface of the container top 12 that surrounds the second opening 52 can in some embodiments lie on cylindrical, horizontal, and/or frustoconical surface(s) or a combination or portion thereof. In some embodiments, the top portion 56 can be shaped or otherwise configured as disclosed herein with reference to the top portion 56*a*, for covering and/or sealing the second opening 50.

The upper surfaces of the first opening 50, the second opening 52, and the divider 60 can facilitate fluid flow through the first opening 50 and the second opening 52. For example, the first opening 50, the second opening 52, and/or the divider 60 can include upwardly extending, curved, sloping, angled, and/or downwardly extending surfaces that facilitate fluid flow through the first opening 50 and the second opening 52. For example, the upwardly and/or forwardly curved surfaces can facilitate sipping or sucking fluid through the second opening 52. This configuration can also allow fluid to be poured or dispensed from the first opening 50.

In some configurations, the front portion 62 of the container top 12 can include a recessed portion that can be an indentation or depression. The recessed portion can be disposed at least proximate the second opening 52 and the recessed portion can be disposed in the outer wall of the container top 12. The recessed portion can form a receiving portion that is sized and configured to receive a lower lip of a person consuming a fluid flowing through the second opening of the container top 12. Advantageously, the recessed portion can allow a user to more easily and conveniently position their mouth and lips to sip or suck fluid through the second opening 52. In other configurations, the recessed portion may not be included.

The first opening 50 and the second opening 52 can provide or form parts of different flow pathways. For example, the first opening 50 can provide or form parts of a first pathway with direct access to the container body 18, and fluid can flow through the first opening 50 when the container 10 is tilted or inverted. Thus, fluid can flow through the first opening 50 when the container body 18 is tilted such that fluid in the container 10 reaches the upper portion of the first opening 50. The large size of the first opening 50 can allow a large quantity of fluid to flow through the first opening 50, which can allow the contents of the container body 18 to be quickly consumed, poured or emptied. The first opening 50 can also allow the container body 18 to be quickly refilled, replenished, and/or topped off.

The second opening 52 can provide or form parts of a second pathway in which fluid can be sipped or sucked from the container body 18. The second opening 52 can be used in connection with the conduit 46 and, in this example embodiment, fluid can be sipped or sucked through the second opening 52 when the container body 18 is in a generally upright position. Therefore, fluid can flow through the second opening 52 as long as the end of the conduit 46 is disposed within the fluid in the container body 18. Thus, the positioning of the container body 18 (e.g., upright, tilted, angled, inverted) can affect whether fluid is capable of flowing through the first opening 50 and the second opening 52.

Advantageously, the multiple openings (e.g., the first opening 50 and the second opening 52) can provide increased functionality and flexibility by allowing fluid to be poured, sipped or sucked from the container body 18. In addition, the multiple openings can allow fluid to be discharged or dispensed when the container body 18 is disposed in upright, tilted, and inverted positions. The openings included in the container 10 can have other suitable sizes, shapes, configurations, and arrangements depending, for example, upon the intended use of the container 10.

As mentioned, in some configurations, the lower portion of the container top 12 can include one or more threads 24 corresponding to the threads 22 on an upper portion of the container body 18. The threads 22, 24 can mate to allow the container top 12 to be selectively connected to the container body 18. Additionally or alternatively, the container top 12 can include threads 68 to selectively couple the closure 14 to the container top 12. For example, the closure 14 can include threads corresponding to the threads 68 of the container top 12 to selectively connect the closure 14 to the container top 12, as will be described in further detail below with respect to FIGS. 6A-6B.

In some embodiments in which an inner portion of the container top 12 includes the threads 68, and an inner portion 74 of the closure 14 includes corresponding threads 70, the threads 68 of the container top 12 can have an offset portion. The offset portion can be a terminal portion of one or more of the threads 68. The offset portion can be positioned to be generally diametrically opposing a location of an upwardly protruding portion of the container top 12, which can correspond to a location of the second opening 52 of the container top 12. The offset portion can be positioned to engage and to urge upwardly the threads of the inner portion 74 of the closure 14 during a time when the upwardly protruding portion of the container top 12 is engaged by a surface of the closure 14 (e.g., a surface of the closure seal 40, see FIGS. 10A-10F). In some embodiments, an upper surface and a lower surface of the thread 68 can each comprise an offset, while in other embodiments an upper surface of the thread 68 comprises an offset and the lower surface does not comprise an offset. In some embodiments in which the container top 12 comprises an upwardly extending portion, the offset portion can advantageously assist in keeping the closure 14 and the container top 12 aligned during the process of tightening them together and/or while the closure is tightened onto the container top. As illustrated in FIG. 16A, the container top 12 can include an inner portion having two threads 68, with each thread having an offset portion of the upper and lower thread surfaces.

Figure 17B:
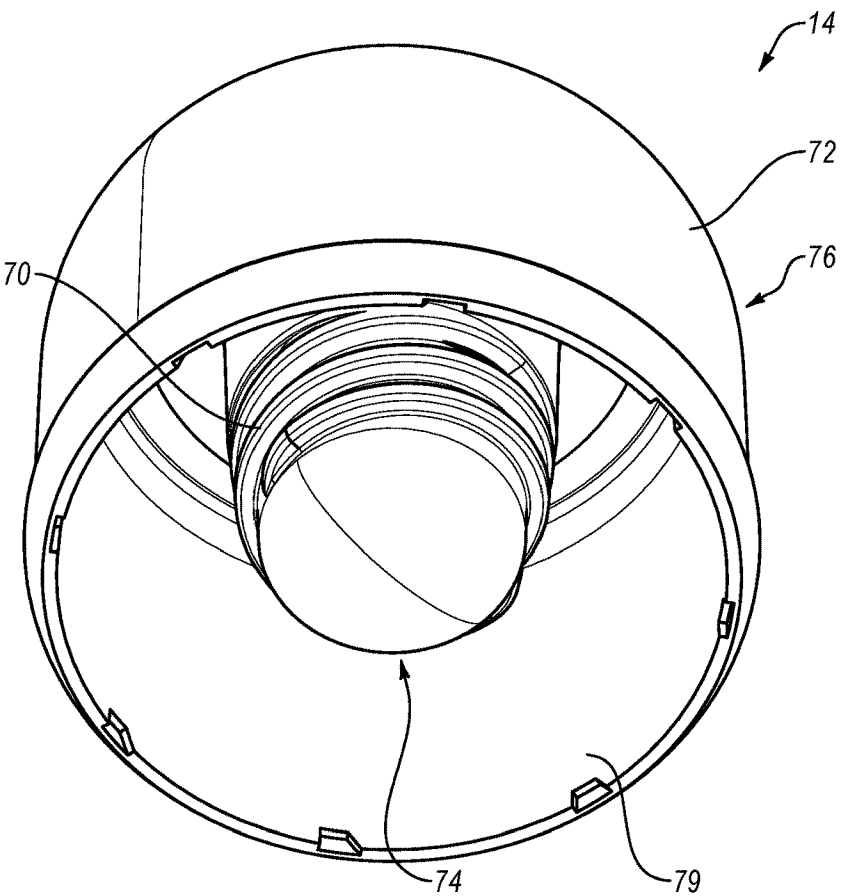
FIG. 17B is a lower perspective view of the closure of FIG. 17A.
Figure 17A:
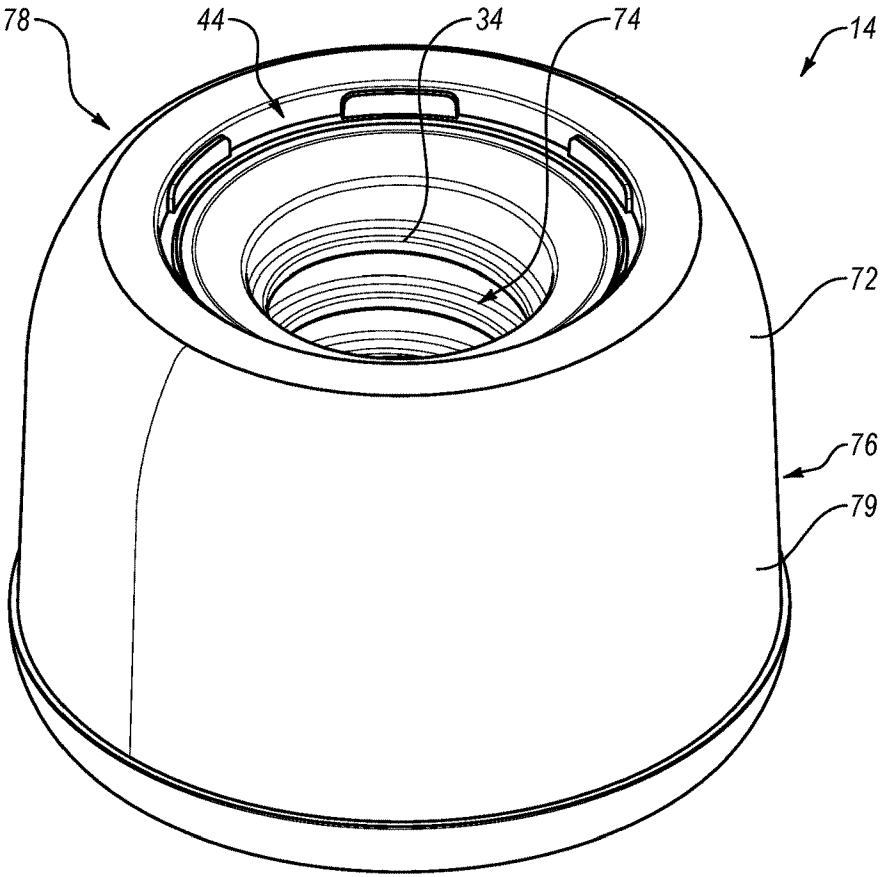
FIG. 17A is an upper perspective view of an example closure of the container of FIG. 12.

FIG. 17A is an upper perspective view of the example closure 14 of FIGS. 1 and 2, and FIG. 17B is a lower perspective view of the same closure 14 as shown in FIG. 17A. Attachment of the closure 14 to the container top 12 can, alone or in combination with other components, selectively close, inhibit, and/or prevent fluid flow through the container top 12. For example, the closure 14 can close, inhibit, and/or prevent fluid flow through the first opening 50 and the second opening 52 of the container top 12. The closure 14 can be made of plastic, glass, metal, and\or other materials with suitable properties and characteristics.

The closure 14 can be selectively connected to the container top 12. For example, the closure 14 can be selectively connected to the container top 12 by threading, snapping, twisting, sliding, or screwing the closure to the container top. As described above, the inner portion of the container top 12 can include the threads 68, and inner portion 74 of the closure 14 can include one or more corresponding threads 70, for example. The threads 68, 70 can mate to allow the closure 14 to be selectively connected to the container top 12. The threaded connection can require multiple turns to securely connect the closure 14 and container top 12. The closure 14 and the container top 12 can be connected by any suitable number of turns. The closure 14 and the container top 12 can also be connected using other suitable types of connections and structures.

The connection of the closure 14 to the container top 12 can be of the same or a different type than that of the connection of the container top 12 to the container body 18. For example, a different number of turns, a different direction or angle of rotation, and/or a different amount of force can be required to connect the closure 14 to the container top 12 than the container top 12 to the container body 18. For example, the container top 12 can be more firmly or tightly connected to the container body 18 than the closure 14 to the container top 12. Thus, the closure 14 can be more easily connected and/or disconnected from the container top 12, and the container top 12 can be more difficult to disconnect from the container body 18. These different connections can facilitate removal and attachment of the closure 14 without disconnecting the container top 12 from the container body 18.

The closure 14 can include a body 72 with the inner portion 74 and an outer portion 76. The inner portion 74 can be centrally disposed and aligned with a center axis of the closure 14 and the outer portion 76 can be radially disposed about the inner portion 74. The inner and outer portions 74, 76 of the closure 14 can be coupled by an upper portion 78 of the closure 14. The inner portion 74 of the closure 14 can have a generally circular configuration and can include one or more outer threads 70 that are sized and configured to be selectively connected to the threads 68 on the inner portion of the container top 12. The outer threads 70 on the inner portion of the closure 14 can be sized, shaped, positioned, and/or configured to allow the closure 14 to be axially aligned with a central axis of the container top 12 when the closure 14 is connected to the container top 12. Thus, the threaded connection can cause the central axis of the closure 14 and the central axis of the container top 12 to be generally aligned when the closure 14 is connected to the container top 12. This can allow the closure 14 to be consistently connected to the container top 12 in a similar manner.

Figure 22A:
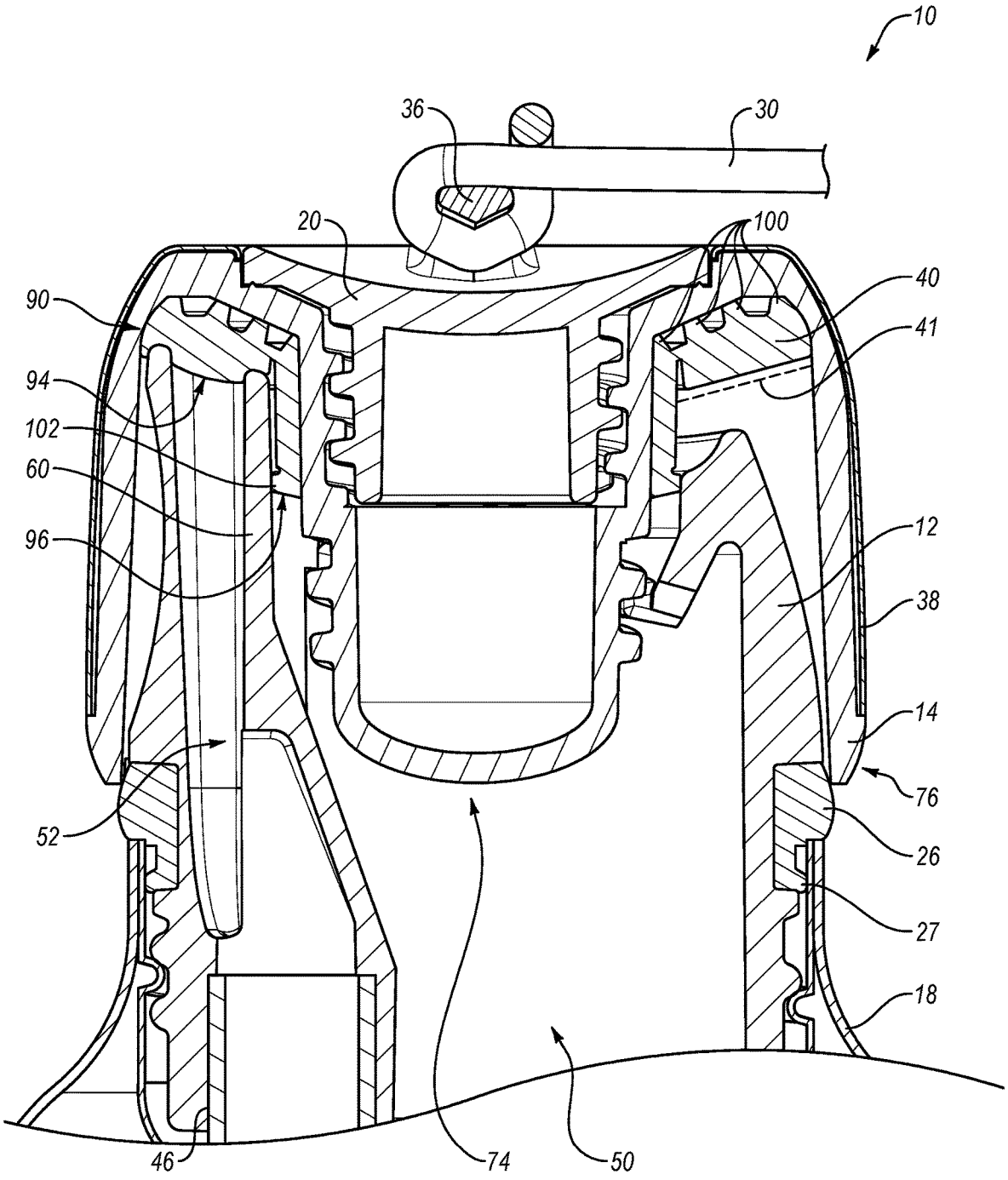
FIG. 22A is a cross-sectional side view of a portion of the container of FIG. 12.

The outer portion 76 of the closure 14 can extend downwardly and can be sized and configured to cover, encircle or enclose at least a portion of the container top 12. For example, the outer portion 76 of the closure 14 can include a downwardly extending annular flange 79 that can cover some, all or substantially all of the exposed portion of the container top 12. In some configurations, a lower surface of the outer portion 76 of the closure 14 can contact and/or partially or completely cover an outer surface of the seal 26 disposed between the container top 12 and the container body 18, for example, as illustrated in FIG. 22A. In such configurations, the closure 14 can help prevent dirt, debris, and the like from contacting the container top 12 when the closure 14 is attached to the container top 12.

Figure 18B:
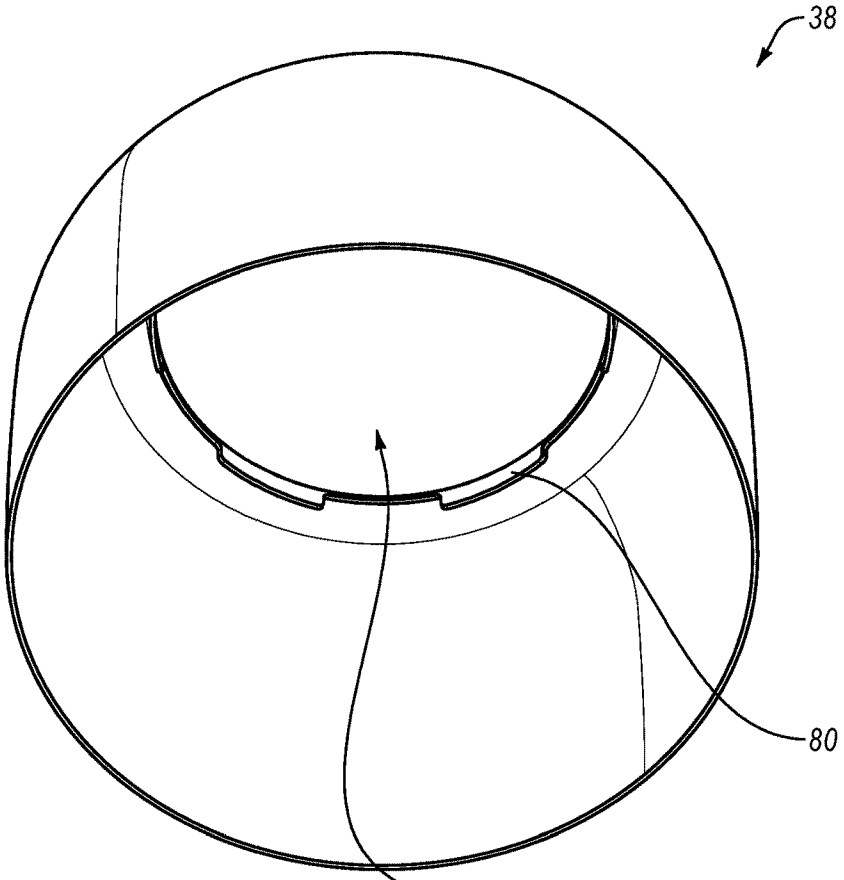
FIG. 18B is a lower perspective view of the cover of FIG. 18A.
Figure 18A:
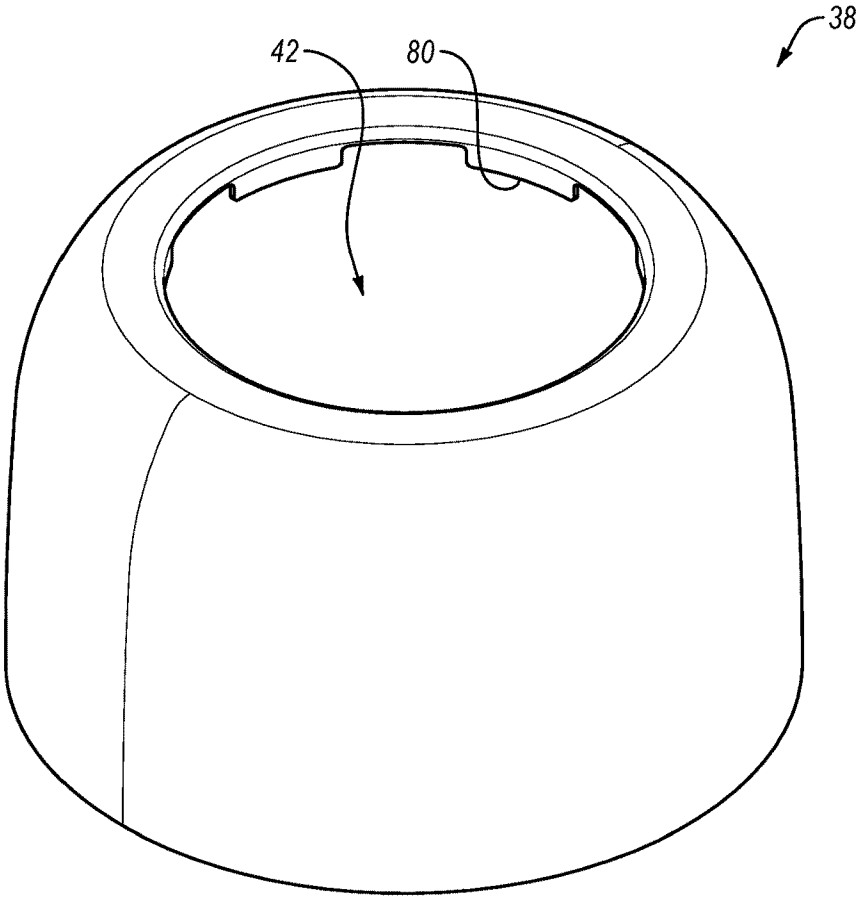
FIG. 18A is an upper perspective view of an example cover of the container of FIG. 12.

FIG. 18A is an upper perspective view of the example cover 38 of FIG. 13, and FIG. 18B is a lower perspective view of the same cover 38 as shown in FIG. 18A. The cover 38 can shield, protect and/or enclose at least a portion of the closure 14. As mentioned above, the cover 38 can include the central opening 42 that can be aligned with the recess 44 in the upper surface of the closure 14 (see FIG. 17A). The cover 38 and closure 14 can be separate components that are connected by a friction or interference fit, adhesives, or other fastener or connector. As illustrated, the cover 38 can include one or more keyed members 80 for coupling or retaining the cover 38 and the closure 14 with respect to one another. In other configurations, the cover 38 and closure 14 can be an integral, one-piece structure. The closure 14 and cover 38 can be constructed from the same or different materials, such as plastic, glass, metal, and other materials with suitable characteristics and properties. In other configurations, the cover 38 may not be included with the container 10.

Figure 19B:
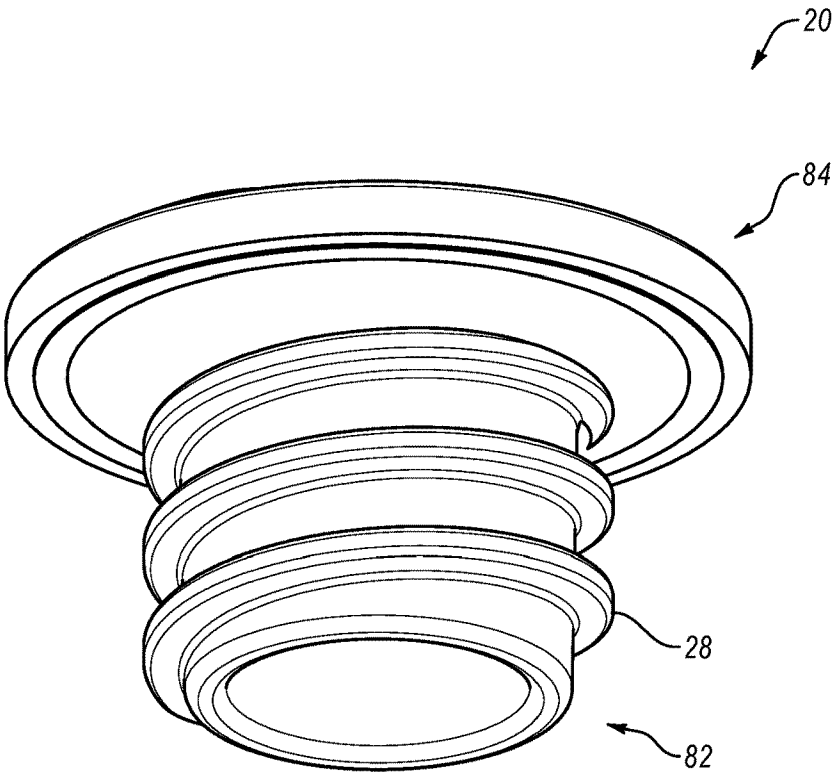
FIG. 19B is a lower perspective view of the attachment member of FIG. 19A.
Figure 19A:
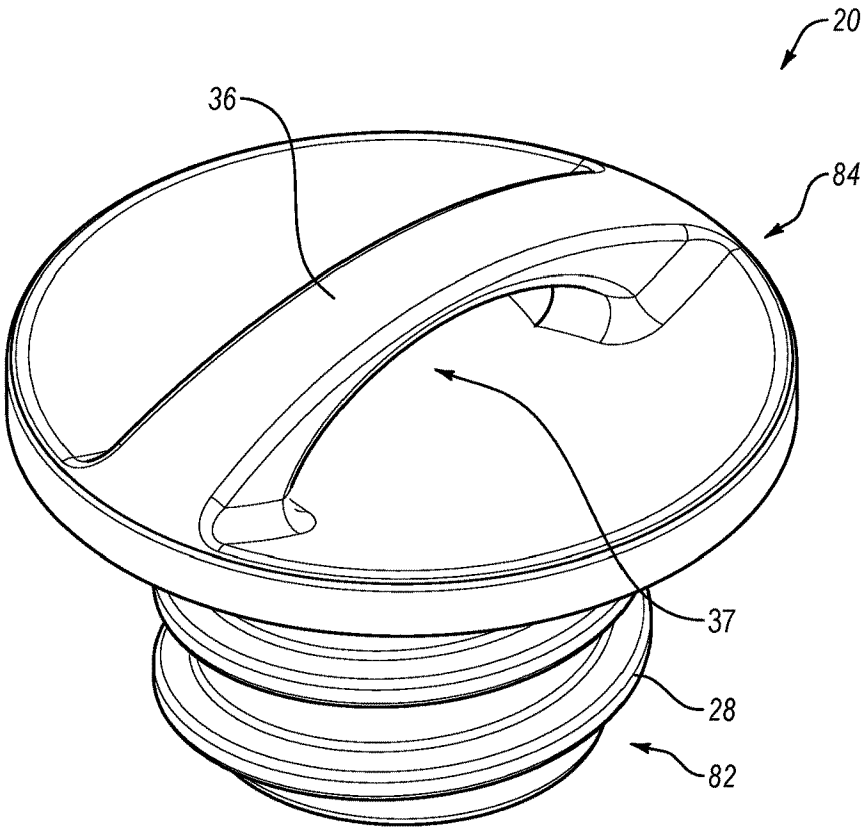
FIG. 19A is an upper perspective view of an attachment member of the container of FIG. 12.

FIG. 19A is an upper perspective view of the example attachment member 20 of FIG. 13, and FIG. 19B is a lower perspective view of the same attachment member 20 as shown in FIG. 19A. The attachment member 20 can be attached to the closure 14. An O-ring, gasket or seal can be disposed between the attachment member 20 and the closure 14 to inhibit or prevent liquid from entering a space in the closure 14 under the attachment member 20 when the attachment member is attached to the closure. The attachment member 20 can comprise threads 28 corresponding and/or complementary to the threads 34 of the closure 14 such that the attachment member 20 and the closure 14 can be removably coupled to one another. In some configurations, the threads 28 can be outwardly facing and/or disposed on a lower portion 82 of the attachment member 20. In some configurations, the cover 38 can extend and/or be retained between the closure 14 and the attachment member 20. In such configurations, the threads 28, 34 can facilitate in coupling the attachment member 20, the cover 38, and the closure 14 with respect to one another.

The connecting portion 36 can be positioned on an upper portion 84 of the attachment member 20. The connecting portion 36 can be sized and shaped to permit the carrying loop 30 to be attached thereto. For example, the carrying loop 30 can be looped around or tied to the connecting portion 36 and can pass through an opening 37 adjacent the connecting portion 36.

Figure 20B:
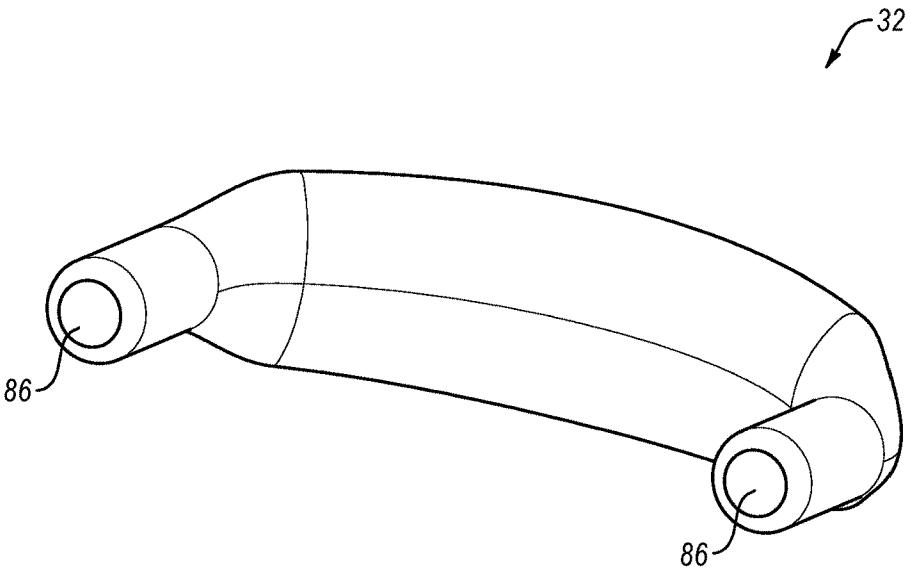
FIG. 20B is another perspective view of the handle of FIG. 20A.
Figure 20A:
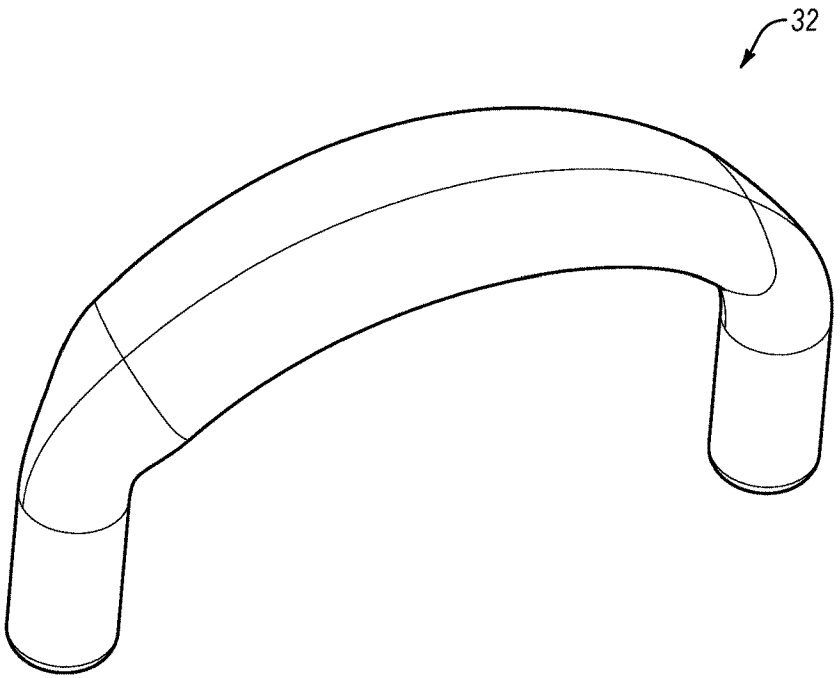
FIG. 20A is a perspective view of a handle of the container of FIG. 12.

FIG. 20A is a perspective view of the example handle 32 of FIG. 13, and FIG. 20B is another perspective view of the same handle 32 as shown in FIG. 20A. The handle 32 can aid in carrying the container body 18 and/or attaching the container to other objects. The handle 32 can be sized and shaped to permit a user to carry or hold the container 10. The handle 32 can be selectively attached to a variety of different structures, and a variety of different handles can be connected to the attachment member 20. The handle 32 can facilitate carrying, storing and transporting the container 10 by a user. The handle 32 can be selectively connected and disconnected from the container 10. The handle 32 can be constructed from plastic, glass, metal, and other materials with suitable characteristics and properties.

The handle 32 can be constructed from flexible or inflexible materials, materials with different textures, and materials of different colors, patterns, or other features. Because the handle 32 can be selectively connected to the attachment member 20, this can allow the handle 32 to be changed according to the desired use or appearance of the user. Thus, the user can change the handle 32 for functional or aesthetic reasons. Advantageously, the ability to change the handle 32 can increase the number of environments and potential uses of the container 10.

The handle 32 can include openings 86 in a first end and a second end of the handle 32. A passage can extend between the openings 86, and can permit the carrying loop 30 to be inserted therethrough to be coupled to the handle 32. In other configurations, the handle 32 may not include the passage and the carrying loop 30 can be removably or permanently attached to the handle 32 in any suitable manner at the openings 86 or otherwise.

FIGS. 10A-10F respectively show upper perspective, lower perspective, top, bottom, side, and cross-sectional views of the example closure seal 40 of FIG. 13. The closure seal 40 can be used in connection with the container top 12 and/or the closure 14. The closure seal 40 can be configured as, for example, an insert and/or a gasket. The closure seal 40 can be generally disposed between the inner portion 74 and the outer portion 76 of the closure 14 and the closure seal 40 can be centrally aligned with a central axis of the closure 14. The closure seal 40 can be used to seal the first opening 50 and/or second opening 52 in the container top 12.

As illustrated, the closure seal 40 can extend between a first portion 92 and a second portion 90. The first portion 92 may be located vertically lower than the second portion 90 such that the first and second portions 92, 90 may instead be referred to, respectively, as a bottom portion 92 and a top portion 90. The closure seal 40 can include a sealing portion 96, which can be disposed at or near the bottom portion 92, sized and shaped to completely or at least partially cover, close or seal the first opening 50 in the container top 12. Additionally or alternatively, the closure seal 40 can include a sealing portion 94, which can be disposed at or near the top portion 90, sized and shaped to completely or at least partially cover, close or seal the second opening 52 in the container top 12. In configurations wherein the closure seal 40 comprises both the sealing portion 94 and the sealing portion 96, a portion of the closure seal 40 joining the sealing portion 94 and the sealing portion 96 can comprise a downwardly extending annular flange 102. In some configurations, the sealing portion 96 can be configured as a seal, gasket, washer, O-ring, or other suitable component. Although the illustrated closure seal 40 comprises both the sealing portion 94 and the sealing portion 96, in some configurations the sealing portion 94 and the sealing portion 96 can be separate components from each other. For example, each of the sealing portion 94 and the sealing portion 96 can be comprised by a seal, gasket, washer, O-ring or other suitable component that is separate from the other of the sealing portion 94 and the sealing portion 96.

In the illustrated configuration, the closure seal 40 has a generally annular shape and an opening 98. The opening 98 can pass entirely through the closure seal 40 or can have a closed end. The opening 98 can be positioned in the center of the closure seal 40 and can be sized and shaped to receive a portion of the closure 14 and/or the attachment member 20. In some configurations of the closure seal 40 including an opening 98, the sealing portion 94 can include an annular or frustoconical surface that extends around the opening 98, and can seal the second opening 52 regardless of the rotational position of the closure seal 40 and the container top 12 with respect to one another. In some configurations, the closure seal 40 and/or the sealing portion 94 may not be annular or frustoconical, and the sealing portion 94 can be positioned on a specific side of the closure seal 40. In such configurations, the closure seal 40 can include a shape such that the sealing portion 94 is positioned over the second opening 52 when the closure 14 is coupled to the container top 12. Thus, in such configurations, the shape of the closure seal 40 can be keyed such that the sealing portion 94 is positioned over the second opening 52 when the closure 14 is in a closed position. In some embodiments, the sealing portion 94 can be shaped or otherwise configured as disclosed herein with reference to the lower sealing surface of the second portion 90*a*.

In at least one embodiment in which the closure 14 is secured to the container top 12 by screwing the closure 14 to the container top 12 or in other attachment methods involving alignment of central axes of the closure 14 and the container top 12 and rotation of one relative to the other about the aligned central axes, the sealing portion 94 can be radially symmetric. In some embodiments, the sealing portion 94 can have a complementary shape to the upper surface of the second opening 52. For example, the sealing portion 94 can be a circular-bounded planar surface and the upper surface of the second opening 52 can lie in a plane. In some embodiments, the sealing portion 94 can be a frustoconical surface (with radius increasing vertically up or down) and the upper surface of the second opening 52 can lie in a complementary frustoconical surface.

Further details regarding seals and sealing portions are disclosed in and described with respect to FIGS. 1-11. Any suitable aspects disclosed in and described with respect to FIGS. 1-11 can be implemented in FIGS. 12-22F, and vice versa. For example, aspects of the sealing portions disclosed in and described with respect to FIGS. 1-11 can be implemented in the sealing portion 94 of FIGS. 21A-21F.

The closure seal 40 can be constructed from materials that are flexible, bendable, compressible, and/or expandable. Additionally or alternatively, the closure seal 40 can be constructed from materials that are elastic, malleable, flexible and/or resilient. For example, the closure seal 40 can be constructed from rubber, plastic, or other materials with suitable properties and characteristics. The resilience of the closure seal 40 can contribute in retaining the closure seal 40 in a recess of the closure 14 between the inner portion 74 and the outer portion 76. For example, the closure seal 40 can exert a radial force on the closure 14 toward a central axis of the closure 14 and/or the closure seal 40, thereby retaining the closure seal 40 on or in the closure 14.

Figure 21B:
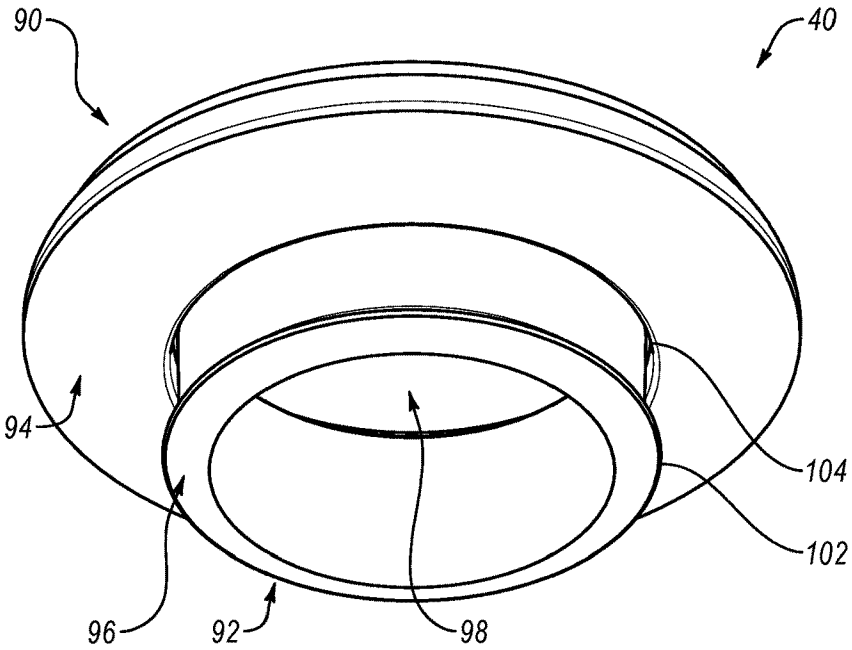
FIG. 21B is a lower perspective view of the seal of FIG. 21A.
Figure 21A:
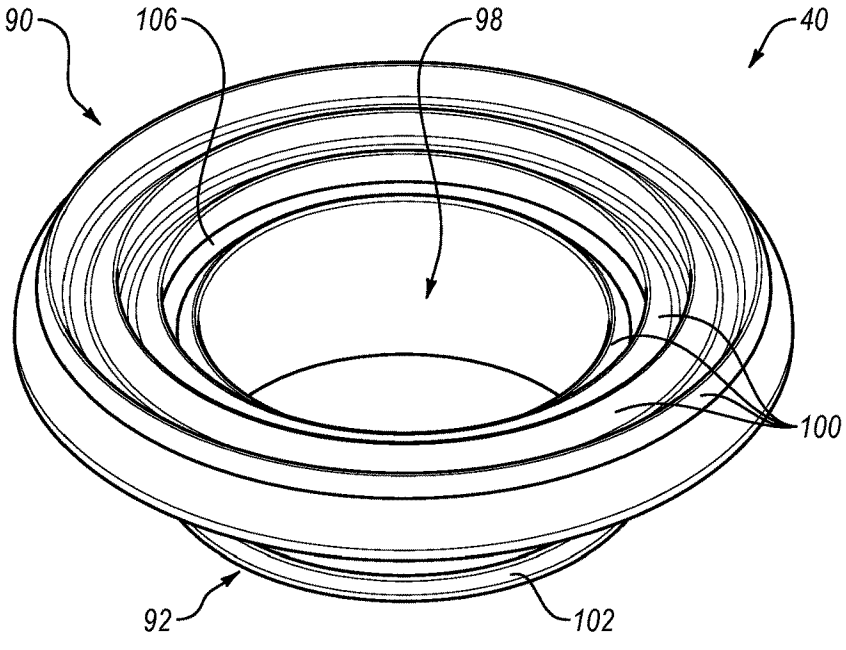
FIG. 21A is an upper perspective view of another example seal of the container of FIG. 12.
Figure 21D:
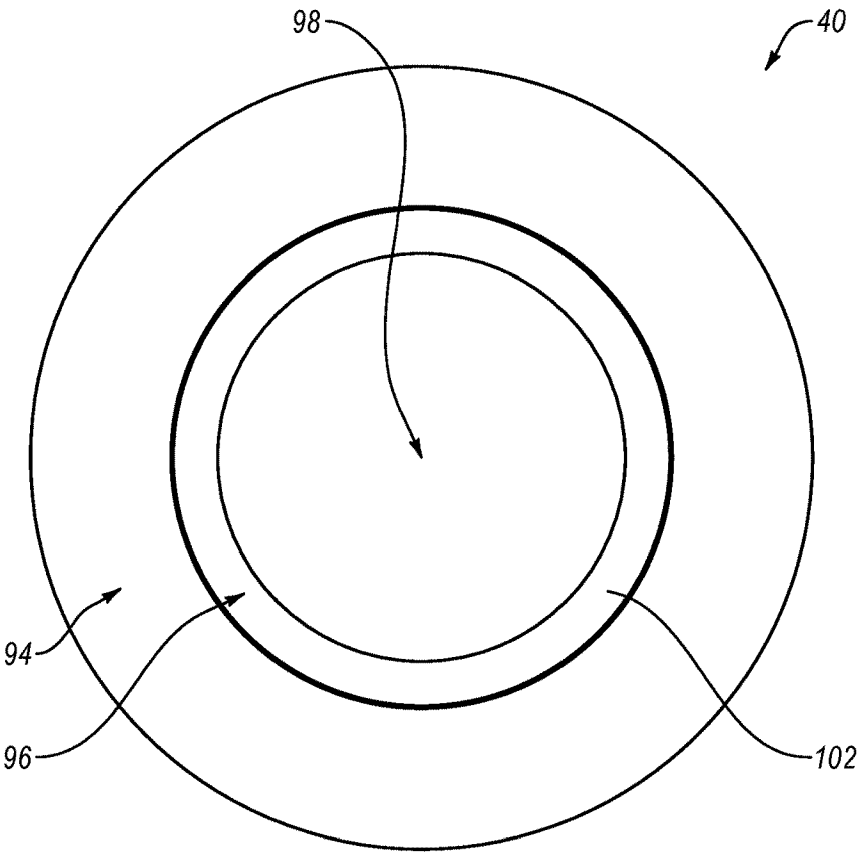
FIG. 21D is a bottom view of the seal of FIG. 21A.
Figure 21C:
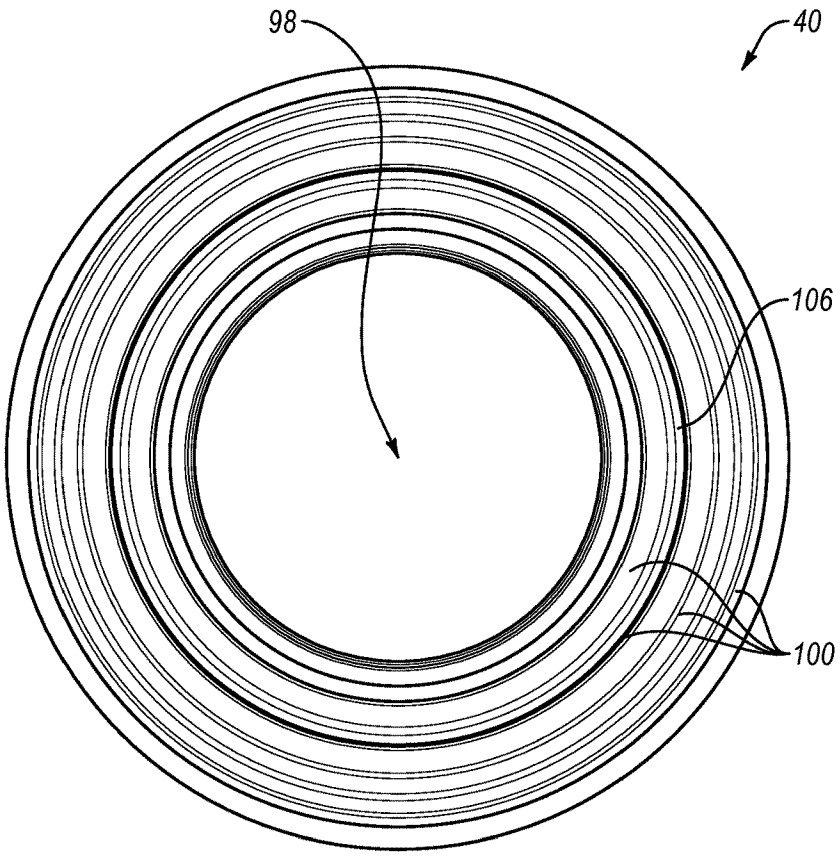
FIG. 21C is a top view of the seal of FIG. 21A.
Figure 21F:
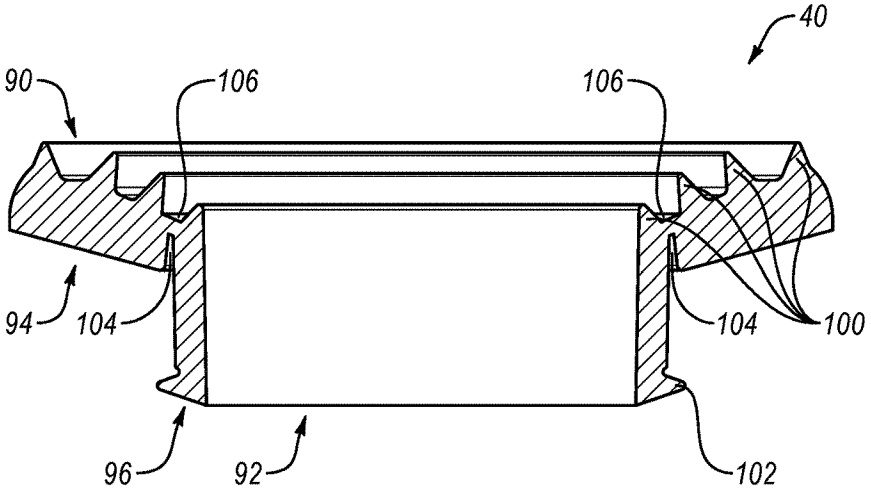
FIG. 21F is a cross-sectional view of the seal of FIG. 21A.
Figure 21E:
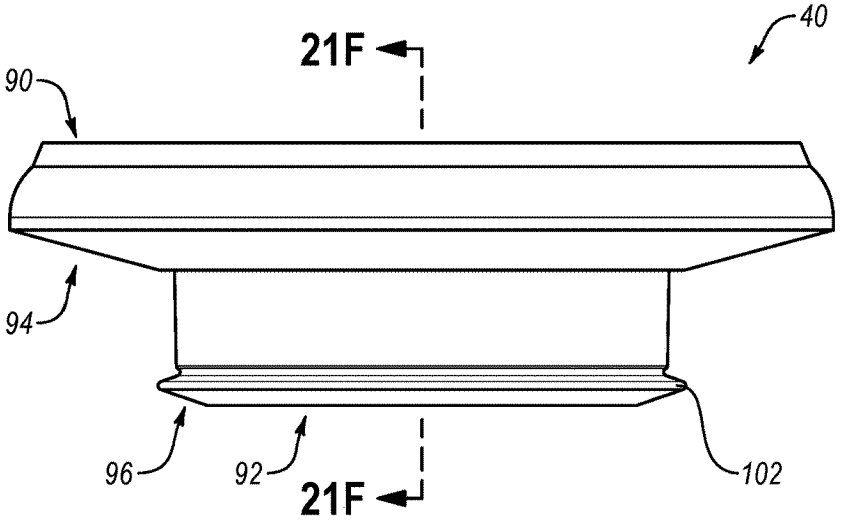
FIG. 21E is a side view of the seal of FIG. 21A.

The closure seal 40 can include one or more biasing members, such as biasing members 100. The shape of the biasing members 100 can be configured to permit the biasing members 100 to be compressed. For example, as shown in FIG. 21F, the biasing members 100 can be fin-shaped and/or can include a triangular cross-section. Each biasing member 100 can include an annular fin positioned on or above the sealing member 90, for example, as illustrated in FIG. 21A. As will be discussed in further detail below, the biasing members 100 can fold over, can radially widen, and/or can otherwise elastically or semi-elastically deform to permit the biasing members 100 to be compressed. In other configurations, the biasing members 100 can include any suitable shape or cross-section. For example, the biasing members 100 can include rounded, rectangular, or accordion-like shapes or cross-sections to permit the biasing members 100 to be compressed. In some embodiments, the sealing portion 94 and the biasing members 100 can be comprised by one component while the sealing portion 96 is comprised by another, separate component.

The closure seal 40 can comprise one or more grooves 104, 106 disposed operatively between the sealing portion 94 and the sealing portion 96. The grooves 104, 106 can be disposed in upwardly, downwardly, inwardly and or outwardly facing surfaces of the closure seal 40. The grooves 104, 106 can allow some movement of the sealing portion 94 and the sealing portion 96 relative to each other.

Further details regarding seals, sealing portions, containers and closures are disclosed in and described with respect to FIGS. 1-11. Any suitable aspects disclosed in and described with respect to FIGS. 1-11 can be implemented in FIGS. 12-22F, and vice versa. For example, aspects of seals or sealing portions disclosed in and described with respect to FIGS. 1-11 can be implemented in the closure seal 40 or the sealing portion 96 of FIGS. 21A-21F.

FIG. 22A is a cross-sectional side view of a portion of the container 10 of FIGS. 1 and 2. As illustrated, for example, the closure seal 40 can be positioned between the inner portion 74 and the outer portion 76 of the closure 14. The sealing portion 96 of the closure seal 40 can enclose or encircle a portion of the inner portion 74 of the closure 14. The sealing portion 96 can be sized and shaped to contact an inner surface of the first opening 50 when the closure 14 is attached to the container top 12. For example, the sealing portion 96 can have a shape that is sized and shaped to contact an inner surface of the first opening 50 in the container top 12.

The inner surface of the first opening 50 of the container top 12 can include one or more corresponding surfaces that are sized and configured to contact the sealing portion 96 when the closure 14 is connected to the container top 12. The sealing portion 96 and the inner surface of the first opening 50 can have matching or complementary surfaces that at least partially contact when the closure 14 is connected to the container top 12. The sealing portion 96 and the inner surface of the first opening 50 can be configured to engage each other at a region that extends contiguously and completely around an interior of the first opening 50. The sealing portion 96 and the inner surface of the first opening 50 can be configured to engage each other at multiple regions that each extend contiguously and completely around an interior of the first opening 50. In some embodiments, the lower portion of the sealing portion 96 can include one or more engaging portions, such as outwardly extending projections or protrusions, which can be sized and shaped to contact the inner surface of the first opening 50 completely, or at least partially, around the interior of the first opening 50. The sealing portion 96 and/or the inner portion 74 of the closure 14 can completely or at least partially cover, close or seal the first opening 50 when the closure 14 is connected to the container top 12. The sealing portion 96 can contact and optionally seal against the inner portion of the closure 14.

The top portion 90 of the closure seal 40 can include an annular ring with the biasing members 100 positioned thereon. The biasing members 100 can contact an inner surface of the closure 14, and the sealing portion 94 can be sized and shaped to seal the second opening 52 of the container top 12 when the closure 14 is connected to the container top 12. The sealing portion 94 can be disposed at approximately the same angle as the upper surface of the second opening 52, which can contribute to creating a fluid tight seal when the closure 14 is connected to the container top 12. Engagement between the sealing portion 94 and the upper surface of the second opening 52 can create or contribute to creating a fluid tight seal when the closure 14 is connected to the container top 12.

In some embodiments, the sealing portion 94 can have an at least partially frustoconical shape that is sized and configured to contact the upper portion of the second opening 52 of the container top 12 having a complementary frustoconical shape. Additionally or alternatively, both the sealing portion 94 of the closure seal 40 and the upper portion of the second opening 52 of the container top 12 can be horizontally planar. Additionally or alternatively, the sealing portion 94 can be positioned at substantially the same angle as the upper portion of the second opening 52. More generally, however, both the sealing portion 94 and the upper portion of the second opening 52 of the container top 12 can be sized, positioned, and oriented in a complementary manner to interface with each other at a common surface, such that the sealing portion 94 interfaces with the upper portion of the second opening 52 to completely or at least partially cover, close or seal the second opening 52. As illustrated in FIG. 22A, the sealing portion 94 can compress and/or otherwise elastically or semi-elastically deform to at least partially adapt to the shape of the second opening 52 by virtue of the resilience of the closure seal 40. Such configurations can contribute in sealing the second opening 52.

In embodiments where the central axis of the closure 14 is aligned with the central axis of the container top 12 when the closure 14 is attached to the container top 12, an axis of revolution of a frustoconical portion of the sealing portion 94 of the closure seal 40 can be brought into substantially coaxial alignment with an axis of revolution of a frustoconical surface that includes the upper surface of the second opening 52 when the closure 14 is being attached to the container top 12, such that the complementary frustoconical shapes are brought into sealing engagement. Thus, the sealing portion 94 can consistently contact the upper surface of the second opening 52. In addition, because the sealing portion 94 can be symmetrical relative to the central axis of the closure 14, the sealing portion 94 can consistently contact the upper surface of the second opening 52. Further, because the sealing portion 94 can be complementary to the upper surface of the second opening 52, the sealing portion 94 can consistently contact the upper surface of the second opening 52. In some embodiments, the sealing portion 94 and the upper portion of the second opening 52 can be planar and their planes can be normal to an axis of rotation of the closure 14 relative to the container top 12.

In some embodiments, the sealing portion 94 and the sealing portion 96 are formed as a single, integral component, while in other embodiments, the sealing portion 94 and the sealing portion 96 can be formed as separate components, which can be joined together or spaced from each other when assembled.

Embodiments of the closure seal 40 are not limited to containers 10 having connections involving alignment of central axes of the closure 14 and the container top 12 and rotation of one of the closure 14 or the container top 12 relative to the other about the aligned central axes. Indeed, the closure seal 40 and/or variations thereof can be modified for use in containers with closures and container tops that do not rotate relative to each other about aligned central axes of the container top and the closure. For example, some containers include container tops with two or more openings, similar to the container top 12, but with a closure that connects to the container top without alignment of central axes of the container top and the closure and/or without rotation of at least one of the container top and the closure relative to the other about the aligned central axes. These and other containers can still realize the benefits of the closure seal 40 by providing the closure seal with a first sealing portion that seals a first opening in the container top and second sealing portion that seals a second opening in the container top, where, e.g., the second sealing portion includes biasing members, similar to the biasing members 100. Such biasing members in the second sealing portion can help ensure that the second opening remains sealed by the second sealing portion until after the first sealing portion is removed from the first opening. In these and other configurations, the first and second sealing portions can be implemented in an integral closure seal or the first and second sealing portions can be implemented as separate components.

As mentioned above, the seal 26 and/or the closure seal 40 can be formed of a resilient material. FIG. 22A illustrates an example manner in which the resilience of the seals 26, 40 can contribute to retaining the seals 26, 40 in the container 10 and/or a manner in which the resilience of the seals 26, 40 can contribute to forming a seal to prevent liquid from escaping the container 10 in undesired circumstances.

As illustrated in FIG. 22A, for example, the seal 26 can be positioned at least partially between the container top 12 and the container body 18. The resilience of the seal 26 can permit the seal 26 to deform into the position shown between the container top 12 and the container body 18. As the seal 26 deforms, it can exert a force on contacting surfaces of the container top 12 and the container body 18, which can contribute to sealing the container body 18 to prevent liquid from escaping proximate the seal 26. For example, as illustrated, the flange 27 of the seal 26 is deformed to contribute to sealing the space between the container top 12 and the container body 18. Additionally or alternatively, as illustrated, an upper portion of the seal 26 can be deformed over a lip of the container body 18 to contribute to sealing the space between the container top 12 and the container body 18. Although not shown, the seal 26 can also deform in configurations where the closure 14 contacts the seal 26. In such configurations, the seal 26 can prevent contaminants or other materials from entering the closure 14. The resilience of the seal 26 can contribute in retaining the seal 26 in between the container top 12 and the container body 18. For example, the seal 26 can exert a radial force on the container top 12 toward a central axis of the container top 12 and/or the seal 26, thereby retaining the seal 26 in between the container top 12 and the container body 18.

The closure seal 40 can be positioned at least partially between the closure 14 and the container top 12. The resilience of the closure seal 40 can permit the closure seal 40 to deform into the position between the closure 14 and the container top 12, for example as illustrated. As the closure seal 40 deforms, it can exert a force on contacting surfaces of the closure 14 and the container top 12, which can contribute to sealing the first opening 50 and/or the second opening 52 to prevent liquid from escaping proximate the closure seal 40.

For example, as illustrated, the sealing portion 96 is deformed to contribute to sealing the space between the closure 14 and the container top 12. Additionally or alternatively, the sealing portion 94 can be deformed in the space between the inner portion 74 of the closure 14 and the container top 12, for example as illustrated, to contribute to sealing the space between the closure 14 and the container top 12. The resilience of the closure seal 40 can contribute in retaining the closure seal 40 in between the inner portion 74 and the outer portion 76 of the closure 14. For example, the closure seal 40 can exert a radial force on the closure 14 toward a central axis of the closure 14 and/or the closure seal 40, thereby retaining the closure seal 40 on or in the closure 14.

The biasing members 100 can be deformed and can bias the sealing portion 94 against the container top 12 to seal the second opening 52. For example, the biasing members 100 can be deformed and their resilience can exert a force against the upper surface of the second opening 52 such that the sealing portion 94 at least partially deforms and seals the second opening 52.

In FIG. 22A, the deformation of the biasing members 100 along with the sealing portion 94 is shown on the left side of the closure seal 40. On the right side of the closure seal 40, the biasing members 100 are also shown as being deformed. In some configurations, the biasing members 100 can be deformed around the entire closure seal 40. However, as illustrated, on the right side of the closure seal 40 there is a space under the closure seal 40, and in some configurations, the closure seal 40 can be positioned in the space illustrated below the closure seal 40 rather than having the biasing members 100 be deformed. For example, in some configurations the biasing members 100 may not be deformed and the closure seal 40 can be positioned lower in the space, for example, to the position denoted at dashed line 41. Accordingly, in some configurations the biasing members 100 are only deformed and/or compressed proximate the second opening 52. Whether the biasing members 100 are deformed in the areas that are not proximate the second opening 52 can depend on the resilience of the closure seal 40 (including the biasing members 100), the shape and size of the closure seal 40, and the shape and size of the opening that the closure seal 40 is positioned in. The deformation of the biasing members 100 will be described in further detail below with respect to FIGS. 11B-11F.

As mentioned above, in some circumstances the container 10 can be used to store different types of liquids. If the container 10 is used to store or transport certain types of liquids, pressure can be built up in the container 10. For example, if carbonated liquid, such as soda, is stored in the container 10, pressure can be built up inside of the container 10, especially if the container 10 is shaken. In another example, if a heated liquid, such as a hot beverage, is stored in the container 10, pressure can be built up inside of the container 10.

The container 10 can be configured such that fluid does not unintentionally come out of the first opening 50 or the second opening 52 when the container 10 is opened while pressure is built up inside it. As illustrated in FIG. 22A, in a fully closed position the closure 14 and/or the closure seal 40 can cover both the first opening 50 and the second opening 52 when the closure 14 is coupled to the container top 12.

When the closure 14 is removed from the container top 12, the closure 14 and/or the closure seal 40 can be configured such that the first opening 50 opens before the second opening 52, thereby relieving any pressure built up inside of the container 10. For example, as the closure 14 is being removed (e.g., turned), the biasing members 100, which are compressed, continue to bias the closure seal 40 against the second opening 52. Since the closure seal 40 continues to exert a force on the upper surface of the second opening 52 until the biasing members 100 are substantially decompressed, the second opening 52 remains sealed as the closure 14 is being removed. Meanwhile, the first opening 50 becomes unsealed, which can relieve some or all of any pressure built up inside of the container body 18. For example, the first opening 50 can become unsealed by movement of the sealing portion 96 before the second opening 52 is unsealed. As the closure 14 continues to be removed from the container top 12, the second opening 52 is also uncovered, but since the second opening 52 is uncovered after the first opening 50 is uncovered and the pressure has been at least partially released, liquid does not unintentionally escape through the second opening 52 forming part of a flow pathway including the straw 46, as a result of a pressure differential between the container body 18 and the surrounding environment.

Configurations in which pressure is released from the container before any straw-including flow pathways are opened can avoid or prevent fluid from unintentionally coming out of the container body 18, and getting on a user of the container 10 or the surrounding environment. For example, if a heated or carbonated liquid is stored in the container 10, the closure 14 can be removed from the container top 12, and as it is being removed, the pressure can be at least partially relieved via the first opening 50 because it is opened before the second opening 52. Accordingly, liquid may not unintentionally exit the container body 18 via the second opening 52. Accordingly, such configurations can contribute to preventing, or can entirely prevent, pressurized liquid from unintentionally exiting the container 10 as a result of depressurization.

Advantageously, the container body 18, the container top 12, the closure 14, the carrying assembly 16, and the carrying loop 30 can be quickly and easily connected and disconnected, which can facilitate use, cleaning, and manufacturing. For example, the container top 12 can be quickly and easily connected to the container body 18, e.g., by a threaded connection. The seal 26, which can have a generally ring-shaped configuration, can help prevent fluid disposed inside the container body 18 from entering into the area of the threaded connection of the container top 12 and the container body 18. Additionally or alternatively, the seal 26 can help prevent dirt, debris, and other objects from outside the container body 18 entering into the area of the threaded connection of the container top 12 to the container body 18.

The seal 26 can include an outer surface that is sized and configured to engage the closure 14 when the closure 14 is attached to the container top 12, which can help prevent dirt, debris, and other objects from entering into the area between the container top 12 and the closure 14. The closure 14 can be quickly and easily connected to the container top 12, e.g., by the threaded connection.

The closure seal 40, which can be connected to the closure 14 by an interference fit, friction fit, adhesive, or other suitable connection, can help seal the first opening 50 and/or the second opening 52 in the container top 12. Because the central axis of the closure 14 and the closure seal 40 can be generally aligned with the central axis of the container top 12 when the closure 14 is being connected to the container top 12, the closure seal 40 can consistently and repeatedly seal the second opening 52 in the container top 12.

In some embodiments, the container body 18, the container top 12, the closure 14, and the carrying assembly 16, along with other parts and components, can have other suitable shapes, sizes, configurations and arrangements.

In operation, the container top 12 can be connected to the container body 18 and fluid can be dispensed through the one or more openings in the container top 12 (e.g., the first opening 50 and/or the second opening 52) For example, the user can quickly consume a large volume of fluid through the first opening 50 by tipping the container body 18. The user can more slowly consume fluid by sipping or sucking on the second opening 52 when the container body 18 is in a generally upright configuration. When the user desires to seal the container body 18, the closure 14 can be connected to the container top 12 and the closure 14 and the closure seal 40, if present, can prevent fluid flow through the first opening 50 and/or the second opening 52 of the container top 12. The user can carry the container 10 by the handle 32 and/or the carrying loop 30 when the carrying assembly 16 is connected to the closure 14. Advantageously, the container body 18 and the container top 12 can be selectively connected, the container top 12 and the closure 14 can be selectively connected, the closure 14 and the carrying assembly 16 can be selectively connected, and/or the carrying assembly 16 and the carrying loop 30 can be selectively connected. The selective connection of the one or more parts and components can facilitate using, cleaning, manufacturing, and/or other activities. The selective connection can facilitate interchanging one or more parts and/or components. Advantageously, because the parts and components can have different shapes, colors, textures, patterns, and the like, the aesthetics and functionality can be changed. Further, the selective connection can facilitate repair and/or replacement of the container body 18, the container top 12, the closure 14, the carrying assembly 16, the carrying loop 30 and/or other components of the container 10.

FIGS. 11B-11D are cross-sectional side views of an example biasing member 100 of the container 10 of FIG. 12. FIGS. 11E-11F are cross-sectional side views of another example biasing member 100 that can be implemented in containers of the subject disclosure.

Figure 22B:
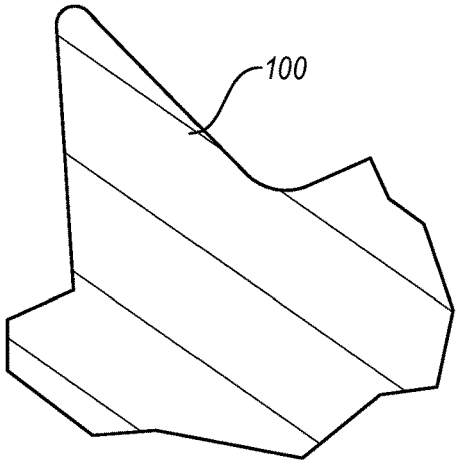
FIGS. 22B-22D are cross-sectional side views of an example biasing member of the container of FIG. 12.
Figure 22C:
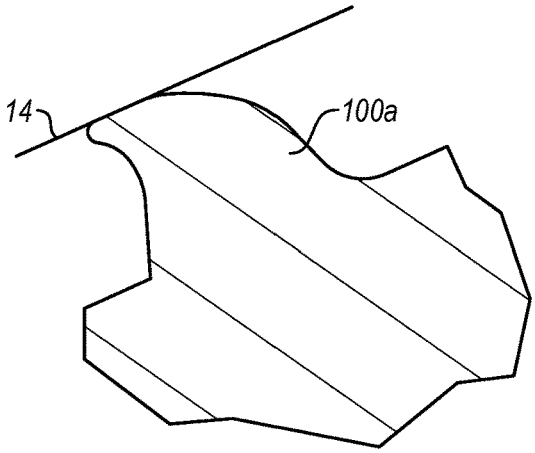

FIG. 22B illustrates one of the biasing members 100 of the container 10 of FIG. 12. As mentioned above, in the illustrated example configuration the biasing member 100 includes a fin-shaped or triangular configuration in which the biasing member 100 can include an annular fin. FIG. 22C illustrates one example of a deformation position of the biasing member 100 of FIG. 22B, denoted at 100*a* in FIG. 22C. In some circumstances, the deformed biasing member 100*a* can be caused by a portion of the closure 14. As illustrated, in some circumstances the biasing member 100*a* can be deformed and at least partially folded over itself. In some circumstances, the biasing member 100*a* can be folder over further than the position show in FIG. 22C, or the biasing member 100*a* may not be folded over as far as the position shown. The disclosed biasing members can be deformed in any suitable manner, and can be configured in any suitable shape or configuration to bias the closure seal 40 against the second opening 52.

Figure 22D:
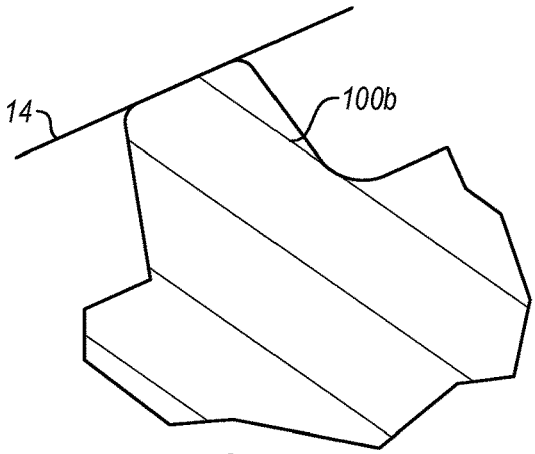

FIG. 22D illustrates another example of a deformation position of the biasing member 100 of FIG. 22B, denoted at 100*b* in FIG. 22D. In some circumstances, the deformed biasing member 100*b* can be caused by a portion of the closure 14. As illustrated, in some circumstances the biasing member 100*b* can be deformed such that it becomes flattened and/or widened with respect to its original shape (see FIG. 22B). In some circumstances, the biasing member 100*b* can be flattened and/or widened further than the position show in FIG. 22D, or the biasing member 100*b* may not be flattened and/or widened as much as shown.

Figure 22E:
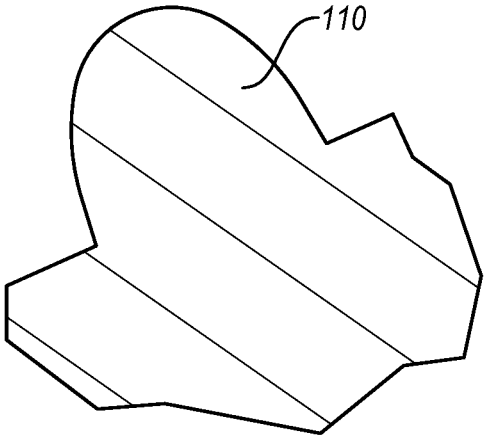
FIGS. 22E-22F are cross-sectional side views of another example biasing member that can be implemented in the container of FIG. 12.
Figure 22F:
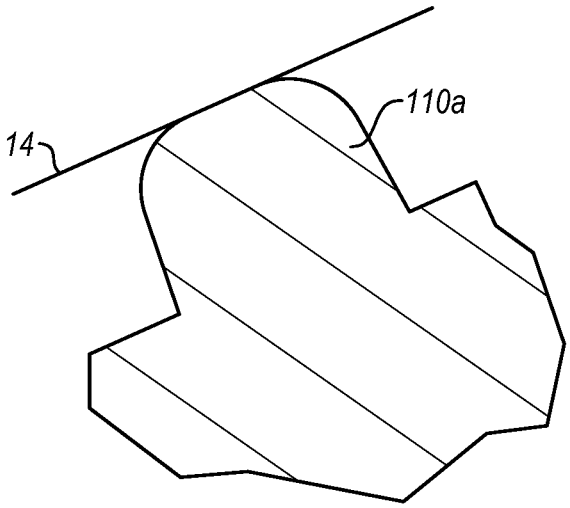

FIG. 22E illustrates another example embodiment of a biasing member 110. The biasing member 110 can be included in a seal, such as the closure seal 40 of FIGS. 10A-10F, instead of or in addition to the biasing member 100. FIG. 22E includes a cross-sectional side view of the biasing member 110, which in its entirety can include, at least in some embodiments, an annular fin or flange with the cross-sectional shape of FIG. 22E at one or more locations around a circumference of such an annular fin or flange. As shown, the biasing member 110 can include a rounded configuration, although any suitable configuration can be implemented. FIG. 22F illustrates one example of a deformation position of the biasing member 110 of FIG. 22E, denoted at 110*a* in FIG. 22F. In some circumstances, the deformed biasing member 110*a* can be caused by a portion of the closure 14. As illustrated, in some circumstances the biasing member 110*a* can be deformed such that it becomes flattened and/or widened with respect to its original shape (see FIG. 22E). In some circumstances, the biasing member 110*a* can be flattened and/or widened further than the position show in FIG. 22F, or the biasing member 110*a* may not be flattened and/or widened as much as shown.

The container 10, the container body 18, container top 12, closure 14, the carrying assembly 16, and/or any other features described herein can include any suitable number of parts and components. The container 10, the container body 18, container top 12, closure 14, the carrying assembly 16, and/or any other features described can have appropriate shapes, sizes, configurations and arrangements other than those explicitly disclosed, depending, for example, upon the intended use of the container 10.

In some embodiments of the disclosed technology, the container can be used to store, transport, and/or dispense one or more liquids, such as water, beverages, drinks, juices, vitamin enhanced beverages, energy drinks, thirst-quenchers, flavored waters, protein drinks, shakes, foodstuffs, dressings, sauces, liquid meal replacements, solutions, suspensions, and the like. The container can also be used to store, transport, and/or dispense solutions and/or solids such as energy drinks, protein drinks, shakes, liquid meal replacements, etc.

In some embodiments, the container can be a shaker cup and the contents can be shaken, stirred, mixed and/or blended as desired, such as supplements, vitamins, protein powders, etc. This can allow the container to be used to mix or otherwise prepare protein drinks, shakes, smoothies, dressings, sauces, etc. The container can be used as a water bottle in which water and other types of fluids can be transported and/or consumed. The container could further include foodstuffs such as fruits, vegetables, soups, and the like.

Advantageously, in some embodiments, the container can be reusable and refillable, which can allow the container to be used for many different purposes over an extended period of time. The container can also be easily carried and portable. For example, the container can be conveniently held in one-hand by the user. Additionally, the container can be insulated to help keep the contents at a desired temperature, such as at a lower or higher temperature.

In some embodiments, the container can include a small number of parts and components, which can facilitate manufacturing and assembly. In some embodiments, the container can be easily disassembled and cleaned. As discussed in greater detail above, the container can include a lid, cap or closure that allows the container to be easily filled from various sources. The container, body, and lid can include any number of parts and components depending, for example, upon the intended use of the container.

The subject technology is illustrated, for example, according to various aspects described below. Numbered clauses are provided below for convenience. These are provided as examples, and do not limit the subject technology.

1. A container comprising:

a container body;

a container top connected to the container body, the container top including a first opening and a second opening;

a closure selectively connected to the container top to control access to the first opening and the second opening; and a closure seal positioned between the closure and the container top, the closure seal comprising:

a first sealing surface that is sized and configured to at least partially seal the first opening when the closure is connected to the container top; and a second sealing surface that is sized and configured to at least partially seal the second opening when the closure is connected to the container top.

2. The container of clause 1, further comprising a carrying loop selectively connected to the closure.

3. The container of clause 1, wherein:

the first opening in the container top includes a central portion that is generally aligned with a central axis of the container top;

the closure includes an inner portion that is generally aligned with the central axis of the container top when the closure is connected to the container top, the inner portion of the closure at least partially sealing the first opening in the container top; and the second sealing surface of the closure seal has a generally ring-shaped configuration and the second sealing surface is complementary to an upper surface of the second opening of the container top.

4. The container of clause 3, wherein the central portion of the first opening includes inner threads and the inner portion of the closure includes outer threads configured to mate with the inner threads of the central portion of the first opening to connect the closure to the container top.

5. The container of clause 1, wherein the closure seal, including both the first sealing surface and the second sealing surface, comprises a single unitary component.

6. The container of clause 1, wherein the closure seal comprises two separate components that are not directly connected to each other, including a first component that includes the first sealing surface and a second component that includes the second sealing surface.

7. The container of clause 1, wherein:

the second sealing surface of the closure seal comprises a first frustoconical surface; and an upper surface of the second opening lies on a second frustoconical surface that is complementary to the first frustoconical surface.

8. The container of clause 1, wherein:

the second sealing surface of the closure seal lies on a first frustoconical surface; and an upper surface of the second opening lies on a second frustoconical surface that is complementary to the first frustoconical surface.

9. The container of clause 1, wherein:

the second sealing surface of the closure seal lies in a first planar surface; and an upper surface of the second opening lies on a second planar surface that is complementary to the first planar surface.

10. The container of clause 1, wherein the closure seal is coupled to the closure and remains coupled to the closure when the closure is disconnected from the container top.

11. A container comprising:

a container body that includes a reservoir;

a container top selectively connected to the container body, the container top defining a first opening and a second opening;

a closure removably connected to the container top;

a first sealing portion that selectively covers and seals the first opening;

a second sealing portion that selectively covers and seals the second opening; and at least one biasing member that selectively biases the second sealing portion against the second opening;

wherein the biasing member is configured to bias the second sealing portion against the second opening as the closure is removed from the container top such that the first opening is configured to open before the second opening as the closure is removed from the container top.

12. The container of clause 11, wherein the first sealing portion, the second sealing portion, and the biasing member are comprised by a single, monolithic closure seal sized and shaped to be connected to the closure.

13. The container of clause 12, wherein the closure comprises an inner portion and an outer portion and the seal is positioned at least partially between the inner portion and the outer portion of the closure.

14. The container of clause 11, wherein the second sealing portion has an opening sized and shaped to receive a portion of the closure.

15. The container of clause 14, wherein the second sealing portion comprises an annular surface or a frustoconical surface that extends at least partially around the opening of the second sealing portion.

16. The container of clause 11, wherein the biasing member comprises a resilient material such that the biasing member biases the second sealing portion against the second opening when the biasing member is compressed between the closure and the container top.

17. The container of clause 11, wherein the first opening is configured to open and at least partially release pressure from the container body as the closure is removed before the second opening opens.

18. The container of clause 11, further comprising a conduit coupled to the container top and fluidly coupled to the second opening, the conduit extending at least partially into the container body.

19. The container of clause 11, wherein the first sealing portion comprises a first seal and the second sealing portion comprises a second seal.

20. The container of clause 11, wherein the second sealing portion is configured to deform to be positioned at least partially into the second opening when the biasing member biases the second sealing portion against the second opening.

21. The container of clause 11, wherein the first sealing portion comprises an annular flange extending at least partially around at least a portion of the closure.

22. The container of clause 11, wherein the first opening is larger than the second opening.

23. The container of clause 11, wherein the closure is connectable to and removable from the container top by rotation of at least one of the closure or the container top relative to the other about aligned central axes of the closure and the container top.

24. A closure assembly for a container comprising:

a container top having a first opening and a second opening;

a closure removably connected to the container top; and one or more seals, the one or more seals comprising:

a first sealing portion sized and shaped to seal the first opening;

a second sealing portion sized and shaped to seal the second opening; and at least one biasing member configured to bias the second sealing portion against the second opening;

wherein the biasing member is configured to bias the second sealing portion against the second opening as the closure is removed from the container top such that the first opening opens before the second opening as the closure is removed from the container top.

25. The closure assembly of clause 24, wherein the second sealing portion is sized and shaped to be inserted between an inner portion and an outer portion of the closure.

26. The closure assembly of clause 24, wherein the second sealing portion has an opening sized and shaped to receive a portion of the closure.

27. The closure assembly of clause 24, wherein the first sealing portion is sized and shaped to be inserted between an inner portion of the closure and the container top.

28. The closure assembly of clause 24, wherein the second sealing portion comprises an annular surface or a frusto-conical surface that extends at least partially around at least a portion of the closure and the second sealing portion is configured to deform to be positioned at least partially into the second opening when the biasing member biases the second sealing portion against the second opening.

29. The closure assembly of clause 24, wherein the first opening is larger than the second opening.

30. The closure assembly of clause 24, wherein the closure comprises a first thread and the container top comprises a second thread complementary to the first thread.

31. The closure assembly of clause 24, wherein the container top is selectively connectable to a container body and the container top comprises a first thread complementary to a second thread of the container body.

A phrase such as "an aspect" does not imply that such aspect is essential to the subject technology or that such aspect applies to all configurations of the subject technology. A disclosure relating to an aspect can apply to all configurations, or one or more configurations. An aspect can provide one or more examples of the disclosure. A phrase such as "an aspect" can refer to one or more aspects and vice versa. A phrase such as "an embodiment" does not imply that such embodiment is essential to the subject technology or that such embodiment applies to all configurations of the subject technology. A disclosure relating to an embodiment can apply to all embodiments, or one or more embodiments. An embodiment can provide one or more examples of the disclosure. A phrase such "an embodiment" can refer to one or more embodiments and vice versa. A phrase such as "a configuration" does not imply that such configuration is essential to the subject technology or that such configuration applies to all configurations of the subject technology. A disclosure relating to a configuration can apply to all configurations, or one or more configurations. A configuration can provide one or more examples of the disclosure. A phrase such as "a configuration" can refer to one or more configurations and vice versa.

To the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Moreover, nothing disclosed herein is intended to be dedicated to the public regardless of whether such disclosure is explicitly recited in the above description.

Although the subject technology has been described in terms of certain embodiments, these have been presented by way of example only, and are not intended to limit the scope of the subject technology. Other embodiments apparent to those of ordinary skill in the art are also within the scope of the subject technology. The scope of the invention is intended to be defined only by the claims which follow.

What is claimed is:

1. A container comprising:

a container body;

a container top connected to the container body, the container top including a first opening and a second opening;

a closure selectively connected to the container top to control access to the first opening and the second opening; and a closure seal positioned between the closure and the container top, the closure seal comprising:

a first sealing surface that is sized and configured to at least partially seal the first opening when the closure is connected to the container top; and a second sealing surface that is sized and configured to at least partially seal the second opening when the closure is connected to the container top, wherein:

the closure is selectively connected to the container top via a threaded connection;

the first opening in the container top includes a central portion that is aligned with a central axis of the container top;

the closure includes an inner portion that is aligned with the central axis of the container top when the closure is connected to the container top, the inner portion of the closure at least partially sealing the first opening in the container top; and the second sealing surface of the closure seal has a ring-shaped configuration and the second sealing surface is complementary to an upper surface of the second opening of the container top.

2. The container of claim 1, wherein the threaded connection comprises inner threads located around the first opening in the container top and outer threads located on an inner portion of the closure.

3. The container of claim 1, wherein the closure seal, including both the first sealing surface and the second sealing surface, comprises a single unitary component.

4. The container of claim 1, wherein the closure seal comprises two separate components that are not directly connected to each other, including a first component that includes the first sealing surface and a second component that includes the second sealing surface.

5. The container of claim 1, wherein:

the second sealing surface of the closure seal comprises a first frustoconical surface; and an upper surface of the second opening lies on a second frustoconical surface that is complementary to the first frustoconical surface.

6. The container of claim 1, wherein:

the second sealing surface of the closure seal lies on a first frustoconical surface; and an upper surface of the second opening lies on a second frustoconical surface that is complementary to the first frustoconical surface.

7. The container of claim 1, wherein:

the second sealing surface of the closure seal lies in a first planar surface; and an upper surface of the second opening lies on a second planar surface that is complementary to the first planar surface.

8. The container of claim 1, wherein the closure seal is coupled to the closure and remains coupled to the closure when the closure is disconnected from the container top.

9. A container comprising:

a container body that includes a reservoir;

a container top selectively connected to the container body, the container top defining a first opening and a second opening;

a closure removably connected to the container top;

a first sealing portion that selectively covers and seals the first opening;

a second sealing portion that selectively covers and seals the second opening; and a biasing member that selectively biases the second sealing portion against the second opening;

wherein the biasing member is configured to bias the second sealing portion against the second opening as the closure is removed from the container top such that the first opening is configured to open before the second opening as the closure is removed from the container top.

10. The container of claim 9, wherein the first sealing portion, the second sealing portion, and the biasing member are comprised by a single, monolithic closure seal sized and shaped to be connected to the closure.

11. The container of claim 10, wherein the closure comprises an inner portion and an outer portion and the seal is positioned at least partially between the inner portion and the outer portion of the closure.

12. The container of claim 9, wherein the second sealing portion has an opening sized and shaped to receive a portion of the closure.

13. The container of claim 12, wherein the second sealing portion comprises an annular surface or a frustoconical surface that extends at least partially around the opening of the second sealing portion.

14. The container of claim 9, wherein the biasing member comprises a resilient material such that the biasing member biases the second sealing portion against the second opening when the biasing member is compressed between the closure and the container top.

15. The container of claim 9, wherein the first opening is configured to open and at least partially release pressure from the container body as the closure is removed before the second opening opens.

16. The container of claim 9, further comprising a conduit coupled to the container top and fluidly coupled to the second opening, the conduit extending at least partially into the container body.

17. The container of claim 9, wherein the first sealing portion comprises a first seal and the second sealing portion comprises a second seal.

18. The container of claim 9, wherein the second sealing portion is configured to deform to be positioned at least partially into the second opening when the biasing member biases the second sealing portion against the second opening.

19. The container of claim 9, wherein the first sealing portion comprises an annular flange extending at least partially around at least a portion of the closure.

20. The container of claim 9, wherein the first opening is larger than the second opening.

21. The container of claim 9, wherein the closure is connectable to and removable from the container top by rotation of at least one of the closure or the container top relative to the other about aligned central axes of the closure and the container top.

22. A closure assembly for a container comprising:

a container top having a first opening and a second opening;

a closure removably connected to the container top; and one or more seals, the one or more seals comprising:

a first sealing portion sized and shaped to seal the first opening;

a second sealing portion sized and shaped to seal the second opening; and a biasing member configured to bias the second sealing portion against the second opening;

wherein the biasing member is configured to bias the second sealing portion against the second opening as the closure is removed from the container top such that the first opening opens before the second opening as the closure is removed from the container top.

23. The closure assembly of claim 22, wherein the second sealing portion is sized and shaped to be inserted between an inner portion and an outer portion of the closure.

24. The closure assembly of claim 22, wherein the second sealing portion has an opening sized and shaped to receive a portion of the closure.

25. The closure assembly of claim 22, wherein the first sealing portion is sized and shaped to be inserted between an inner portion of the closure and the container top.

26. The closure assembly of claim 22, wherein the second sealing portion comprises an annular surface or a frustoconical surface that extends at least partially around at least a portion of the closure and the second sealing portion is configured to deform to be positioned at least partially into the second opening when the biasing member biases the second sealing portion against the second opening.

27. The closure assembly of claim 22, wherein the first opening is larger than the second opening.

28. The closure assembly of claim 22, wherein the closure comprises a first thread and the container top comprises a second thread complementary to the first thread.

29. The closure assembly of claim 22, wherein the container top is selectively connectable to a container body and the container top comprises a first thread complementary to a second thread of the container body.

* * * * *